US011719478B2

(12) United States Patent
Lee et al.

(10) Patent No.: US 11,719,478 B2
(45) Date of Patent: Aug. 8, 2023

(54) ICE MAKER AND REFRIGERATOR INCLUDING THE SAME

(71) Applicant: LG ELECTRONICS INC., Seoul (KR)

(72) Inventors: Donghoon Lee, Seoul (KR); Wookyong Lee, Seoul (KR); Seungseob Yeom, Seoul (KR); Sunggyun Son, Seoul (KR); Donghoon Lee, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/281,805

(22) PCT Filed: Oct. 2, 2019

(86) PCT No.: PCT/KR2019/012941

§ 371 (c)(1),
(2) Date: Mar. 31, 2021

(87) PCT Pub. No.: WO2020/071802

PCT Pub. Date: Apr. 9, 2020

(65) Prior Publication Data

US 2021/0389034 A1 Dec. 16, 2021

(30) Foreign Application Priority Data

Oct. 2, 2018 (KR) ..... 10-2018-0117783
Nov. 16, 2018 (KR) ..... 10-2018-0142117
Jul. 6, 2019 (KR) ..... 10-2019-0081688

(51) Int. Cl.
*F25C 1/18* (2006.01)
*F25C 1/24* (2018.01)
*F25C 5/08* (2006.01)

(52) U.S. Cl.
CPC ..... *F25C 1/18* (2013.01); *F25C 1/24* (2013.01); *F25C 5/08* (2013.01); *F25C 2400/10* (2013.01);
(Continued)

(58) Field of Classification Search
CPC ..... F25C 1/18; F25C 1/24; F25C 5/08; F25C 2400/04; F25C 2700/12; F25C 2400/10;
(Continued)

(56) References Cited

U.S. PATENT DOCUMENTS 4,910,974 A * 3/1990 Hara ..... F25C 1/045 62/352
9,234,688 B2 * 1/2016 Son ..... F25C 5/06
(Continued)

FOREIGN PATENT DOCUMENTS

JP H 04-124571 A 4/1992
JP 2011-185541 A 9/2011
(Continued)

OTHER PUBLICATIONS

International Search Report dated Feb. 6, 2020 issued in Application No. PCT/KR2019/012941.

*Primary Examiner* — Cassey D Bauer
(74) *Attorney, Agent, or Firm* — KED & Associates LLP

(57) ABSTRACT

An ice maker, according to the present invention, comprises: a first tray forming a part of an ice-making cell; a second tray forming another part the ice-making cell; and a heater which is disposed so as to be adjacent to the first or the second tray, wherein the heater turns on during a period when cold air is being supplied to the ice-making cell, and the output of the on heater can vary.

19 Claims, 41 Drawing Sheets

(52) U.S. Cl.
CPC ..... *F25C 2600/04* (2013.01); *F25C 2700/12* (2013.01)

(58) Field of Classification Search
CPC ..... F25C 2600/04; F25C 2600/02; F25D 2317/061; F25D 2400/02
See application file for complete search history.

(56) References Cited

U.S. PATENT DOCUMENTS

| | | | | |
|---|---|---|---|---|
| 2010/0018226 | A1* | 1/2010 | Kim | F25C 1/18 62/73 |
| 2013/0014535 | A1 | 1/2013 | Son et al. | |
| 2018/0187941 | A1* | 7/2018 | An | F25C 1/18 |

FOREIGN PATENT DOCUMENTS

| | | | |
|---|---|---|---|
| KR | 10-0781261 | B1 | 11/2007 |
| KR | 10-2013-0009521 | A | 1/2013 |
| KR | 10-2018-0080021 | A | 7/2018 |

* cited by examiner (a)

(b)

(a)

(b)

ICE MAKER AND REFRIGERATOR INCLUDING THE SAME

CROSS-REFERENCE TO RELATED PATENT APPLICATIONS

This application is a U.S. National Stage Application under 35 U.S.C. § 371 of PCT Application No. PCT/KR2019/012941, filed Oct. 2, 2019, which claims priority to Korean Patent Application Nos. 10-2018-0117783, filed Oct. 2, 2018, 10-2018-0142117, filed Nov. 16, 2018, and 10-2019-0081688, filed Jul. 6, 2019, whose entire disclosures are hereby incorporated by reference.

TECHNICAL FIELD

The present disclosure relates to an ice maker and a refrigerator including the same.

BACKGROUND ART

Ice manufactured using an ice maker applied to a general refrigerator is frozen in a way that it freezes in all directions. Therefore, air is trapped inside the ice, and because the freezing speed is fast, opaque ice is created.

In order to make transparent ice, there is also a method of making ice while growing ice in one direction by flowing water from top to bottom or by sprinkling water from bottom to top. However, since ice has to be made at sub-zero temperatures in the refrigerator, water cannot flow or be sprinkled. Therefore, this method cannot be applied to an ice maker applied to a refrigerator.

Therefore, it is necessary to devise a new method in order to make ice having a spherical shape while being transparent in an ice maker used in a refrigerator.

DISCLOSURE

Technical Problem

Embodiments provide an ice maker capable of providing transparent and spherical ice, and a refrigerator including the same.

Technical Solution

According to an aspect, an ice maker includes a first tray configured to define a portion of an ice making cell, a second tray configured to define another portion of the ice making cell, and a heater configured to be disposed adjacent to any one of the first and second trays, in which the heater is turned on while cold air is supplied to the ice making cell, and an output of the turned on heater is varied.

The second tray may be located below the first tray, and the heater may be an ice maker positioned adjacent to the second tray rather than the first tray.

The heater may be in contact with the second tray.

A temperature of the heater may be maintained in a first temperature range by varying the output of the heater, may be maintained the second temperature range, and then may be maintained in the third temperature range. The average value of the first temperature range may be smaller than the average value of the second temperature range. The average value of the third temperature range may be smaller than the average value of the second temperature range. The average value of the third temperature range may be smaller than the average value of the first temperature range. During the ice making process, the output of the heater may increase. After the output of the heater increases, the output of the heater may decrease.

The output of the heater may be varied from a first output to a second output and may be varied from a second output to a third output. The second output may be greater than the first output, and the third output may be smaller than the second output. The third output may be smaller than the first output.

A time driven by the first output may be shorter than a time driven by the second output or driven by the third output.

According to another aspect, a refrigerator includes a storage chamber configured to store food; a cold air supply part configured to supply cold air to the storage chamber; a first tray configured to define a first cell that is a space in which water is changed into ice by the cold air, a second tray configured to have a second cell to define an ice making cell together with the first cell, and a heater configured to be disposed adjacent to any one of the first and second trays, in which, for ice making, an output of the heater may increase to a second output while the heater is operated with a first output.

Before completion of ice making, the output of the heater may be reduced to a third output that is smaller than the first output.

Advantageous Effects

According to an embodiment of the present disclosure, since the heater contacts a tray made of a soft material as necessary, transparent ice of various shapes, such as a spherical shape or a square shape, can be implemented.

According to an embodiment of the present disclosure, in order to make transparent ice, an area with a high ice making speed increases the heating amount of a heater to slow the ice making speed, and an area with a relatively slow ice making speed decreases the heating amount of the heater to increase the ice making speed. In conclusion, by keeping the ice making speed constant as a whole, transparent ice can be provided to the user.

In addition, by controlling the heater in multiple stages, it is possible to reduce the heating amount of the heater and increase the amount of ice making.

According to an embodiment of the present disclosure, heat is supplied using a heater adjacent to the first tray to separate ice from the first tray, and additional heating is performed after rotating the second tray by a predetermined angle, thereby securing reliability of ice separation. In addition, ice already separated from the first tray can be prevented from excessively melting due to additional heating.

In addition, after separating the ice from the first tray, by waiting in a state in which the second tray is rotated by a predetermined angle, the phenomenon can be prevented that the residual water generated when heating the first tray falls into the ice bin, and a mat of the ice cubes is generated.

According to an embodiment of the present disclosure, ice may be detected by rotating the full ice detection lever in a swing type. In addition, when ice is guided to the ice bin located at the bottom of the tray, it is possible to induce the ice to accumulate in one direction in the ice bin, so that it is possible to detect whether ice is full even in the ice bin with a low height.

MODE FOR INVENTION

Figure 1:
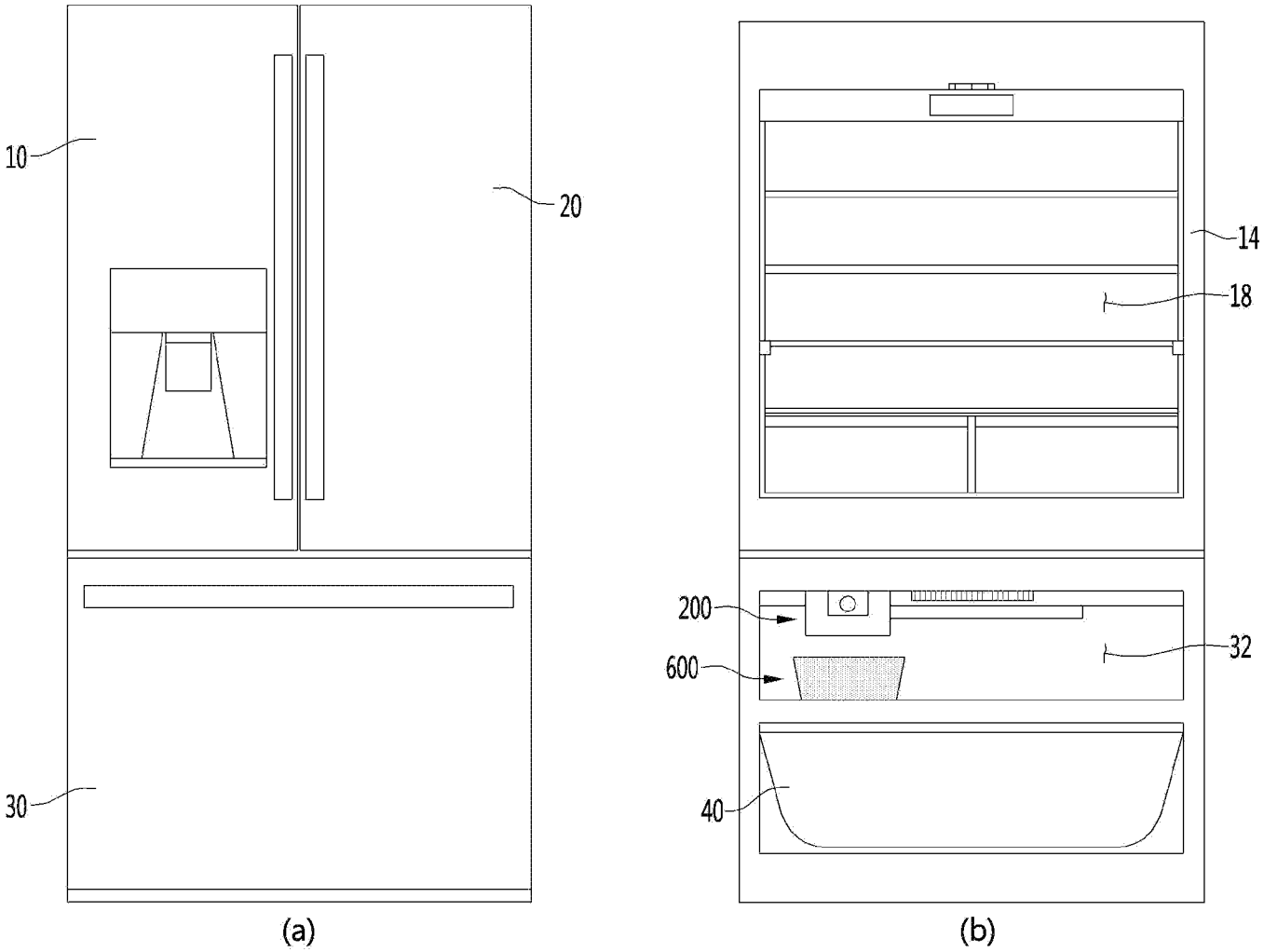
FIG. 1(*a*)-(*b*) is a front view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller. The refrigerator may further include a temperature sensor detecting a temperature of water or ice of the ice making cell. The refrigerator may further include a heater disposed adjacent to the tray assembly. The refrigerator may further include a driver to move the tray assembly. The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The controller may control the cooler so that cold is supplied to the ice making cell after moving the tray assembly to an ice making position. The controller may control the second tray assembly so that the second tray assembly moves to an ice separation position in a forward direction so as to take out the ice in the ice making cell when the ice is completely made in the ice making cell. The controller may control the tray assembly so that the supply of the water supply part after the second tray assembly moves to the water supply position in the reverse direction when the ice is completely separated. The controller may control the tray assembly so as to move to the ice making position after the water supply is completed.

According to an embodiment, the storage chamber may be defined as a space that is controlled to a predetermined temperature by the cooler. An outer case may be defined as a wall that divides the storage chamber and an external space of the storage chamber (i.e., an external space of the refrigerator). An insulation material may be disposed between the outer case and the storage chamber. An inner case may be disposed between the insulation material and the storage chamber.

According to an embodiment, the ice making cell may be disposed in the storage chamber and may be defined as a space in which water is phase-changed into ice. A circumference of the ice making cell refers to an outer surface of the ice making cell irrespective of the shape of the ice making cell. In another aspect, an outer circumferential surface of the ice making cell may refer to an inner surface of the wall defining the ice making cell. A center of the ice making cell refers to a center of gravity or volume of the ice making cell. The center may pass through a symmetry line of the ice making cell.

According to an embodiment, the tray may be defined as a wall partitioning the ice making cell from the inside of the storage chamber. The tray may be defined as a wall defining at least a portion of the ice making cell. The tray may be configured to surround the whole or a portion of the ice making cell. The tray may include a first portion that defines at least a portion of the ice making cell and a second portion extending from a predetermined point of the first portion. The tray may be provided in plurality. The plurality of trays may contact each other. For example, the tray disposed at the lower portion may include a plurality of trays. The tray disposed at the upper portion may include a plurality of trays. The refrigerator may include at least one tray disposed under the ice making cell. The refrigerator may further include a tray disposed above the ice making cell. The first portion and the second portion may have a structure inconsideration of a degree of heat transfer of the tray, a degree of cold transfer of the tray, a degree of deformation resistance of the tray, a recovery degree of the tray, a degree of supercooling of the tray, a degree of attachment between the tray and ice solidified in the tray, and coupling force between one tray and the other tray of the plurality of trays.

According to an embodiment, the tray case may be disposed between the tray and the storage chamber. That is, the tray case may be disposed so that at least a portion thereof surrounds the tray. The tray case may be provided in plurality. The plurality of tray cases may contact each other. The tray case may contact the tray to support at least a portion of the tray. The tray case may be configured to connect components except for the tray (e.g., a heater, a sensor, a power transmission member, etc.). The tray case may be directly coupled to the component or coupled to the component via a medium therebetween. For example, if the wall defining the ice making cell is provided as a thin film, and a structure surrounding the thin film is provided, the thin film may be defined as a tray, and the structure may be defined as a tray case. For another example, if a portion of the wall defining the ice making cell is provided as a thin film, and a structure includes a first portion defining the other portion of the wall defining the ice making cell and a second part surrounding the thin film, the thin film and the first portion of the structure are defined as trays, and the second portion of the structure is defined as a tray case.

According to an embodiment, the tray assembly may be defined to include at least the tray. According to an embodiment, the tray assembly may further include the tray case.

According to an embodiment, the refrigerator may include at least one tray assembly connected to the driver to move. The driver is configured to move the tray assembly in at least one axial direction of the X, Y, or Z axis or to rotate about the axis of at least one of the X, Y, or Z axis. The embodiment may include a refrigerator having the remaining configuration except for the driver and the power transmission member connecting the driver to the tray assembly in the contents described in the detailed description. According to an embodiment, the tray assembly may move in a first direction.

According to an embodiment, the cooler may be defined as a part configured to cool the storage chamber including at least one of an evaporator or a thermoelectric element.

According to an embodiment, the refrigerator may include at least one tray assembly in which the heater is disposed. The heater may be disposed in the vicinity of the tray assembly to heat the ice making cell defined by the tray assembly in which the heater is disposed. The heater may include a heater to be turned on in at least partial section while the cooler supplies cold so that bubbles dissolved in the water within the ice making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to an embodiment, the tray assembly may include a first region and a second region, which define an outer circumferential surface of the ice making cell. The tray assembly may include a first portion that defines at least a portion of the ice making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice making cell defined by the tray assembly. The second region may be an upper portion of an ice making cell defined by the tray assembly. The refrigerator may include an additional tray assembly. One of the first and second regions may include a region contacting the additional tray assembly. When the additional tray assembly is disposed in a lower portion of the first region, the additional tray assembly may contact the lower portion of the first region. When the additional tray assembly is disposed in an upper portion of the second region, the additional tray assembly and the upper portion of the second region may contact each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice making cell defined by the first and second tray assemblies. At least a portion of the second tray assembly may be disposed above the ice making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold to the ice making cell than the first region. To allow the cooler to supply the cold through the through-hole, an additional through-hole may be defined in another component. The second region may be a region closer to the additional through-hole than the first region. The heater may be a transparent ice heater. The heat insulation degree of the second region with respect to the cold may be less than that of the first region.

The heater may be disposed in one of the first and second tray assemblies of the refrigerator. For example, when the heater is not disposed on the other one, the controller may control the heater to be turned on in at least a section of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The embodiment may include a refrigerator having a configuration excluding the transparent ice heater in the contents described in the detailed description.

The embodiment may include a pusher including a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a penetrating type pusher, a non-penetrating type pusher, a movable pusher, or a fixed pusher according to a view point.

A through-hole through which the pusher moves may be defined in the tray assembly, and the pusher may be configured to directly press the ice in the tray assembly. The pusher may be defined as a penetrating type pusher.

The tray assembly may be provided with a pressing part to be pressed by the pusher, the pusher may be configured to apply a pressure to one surface of the tray assembly. The pusher may be defined as a non-penetrating type pusher.

The controller may control the pusher to move so that the first edge of the pusher is disposed between a first point outside the ice making cell and a second point inside the ice making cell.

The pusher may be defined as a movable pusher. The pusher may be connected to a driver, the rotation shaft of the driver, or the tray assembly that is connected to the driver and is movable. The controller may control the pusher to move at least one of the tray assemblies so that the first edge of the pusher is disposed between the first point outside the ice making cell and the second point inside the ice making cell. The controller may control at least one of the tray assemblies to move to the pusher. Alternatively, the controller may control a relative position of the pusher and the tray assembly so that the pusher further presses the pressing part after contacting the pressing part at the first point outside the ice making cell. The pusher may be coupled to a fixed end. The pusher may be defined as a fixed pusher.

According to an embodiment, the ice making cell may be cooled by the cooler cooling the storage chamber. For example, the storage chamber in which the ice making cell is disposed may be a freezing compartment which is controlled at a temperature lower than 0 degree, and the ice making cell may be cooled by the cooler cooling the freezing compartment.

The freezing compartment may be divided into a plurality of regions, and the ice making cell may be disposed in one region of the plurality of regions.

According to an embodiment, the ice making cell may be cooled by a cooler other than the cooler cooling the storage chamber. For example, the storage chamber in which the ice making cell is disposed is a refrigerating compartment which is controlled to a temperature higher than 0 degree, and the ice making cell may be cooled by a cooler other than the cooler cooling the refrigerating compartment. That is, the refrigerator may include a refrigerating compartment and a freezing compartment, the ice making cell may be disposed inside the refrigerating compartment, and the ice maker cell may be cooled by the cooler that cools the freezing compartment.

The ice making cell may be disposed in a door that opens and closes the storage chamber.

According to an embodiment, the ice making cell is not disposed inside the storage chamber and may be cooled by the cooler. For example, the entire storage chamber defined inside the outer case may be the ice making cell. According to an embodiment, a degree of heat transfer indicates a degree of heat transfer from a high-temperature object to a low-temperature object and is defined as a value determined by a shape including a thickness of the object, a material of the object, and the like. In terms of the material of the object, a high degree of the heat transfer of the object may represent that thermal conductivity of the object is high. The thermal conductivity may be a unique material property of the object. Even when the material of the object is the same, the degree of heat transfer may vary depending on the shape of the object.

The degree of heat transfer may vary depending on the shape of the object. The degree of heat transfer from a point A to a point B may be influenced by a length of a path through which heat is transferred from the point A to the point B (hereinafter, referred to as a "heat transfer path"). The more the heat transfer path from the point A to the point B increases, the more the degree of heat transfer from the point A to the point B may decrease. The more the heat transfer path from the point A to the point B, the more the degree of heat transfer from the point A to the point B may increase.

The degree of heat transfer from the point A to the point B may be influenced by a thickness of the path through which heat is transferred from the point A to the point B. The more the thickness in a path direction in which heat is transferred from the point A to the point B decreases, the more the degree of heat transfer from the point A to the point B may decrease. The greater the thickness in the path direction from which the heat from point A to point B is transferred, the more the degree of heat transfer from point A to point B.

According to an embodiment, a degree of cold transfer indicates a degree of heat transfer from a low-temperature object to a high-temperature object and is defined as a value determined by a shape including a thickness of the object, a material of the object, and the like. The degree of cold transfer is a term defined in consideration of a direction in which cold air flows and may be regarded as the same concept as the degree of heat transfer. The same concept as the degree of heat transfer will be omitted.

According to an embodiment, a degree of supercooling is a degree of supercooling of a liquid and may be defined as a value determined by a material of the liquid, a material or shape of a container containing the liquid, an external factor applied to the liquid during a solidification process of the liquid, and the like. An increase in frequency at which the liquid is supercooled may be seen as an increase in degree of the supercooling. The lowering of the temperature at which the liquid is maintained in the supercooled state may be seen as an increase in degree of the supercooling. Here, the supercooling refers to a state in which the liquid exists in the liquid phase without solidification even at a temperature below a freezing point of the liquid. The supercooled liquid has a characteristic in which the solidification rapidly occurs from a time point at which the supercooling is terminated. If it is desired to maintain a rate at which the liquid is solidified, it is advantageous to be designed so that the supercooling phenomenon is reduced.

According to an embodiment, a degree of deformation resistance represents a degree to which an object resists deformation due to external force applied to the object and is a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling.

In terms of the material of the object, a high degree of the deformation resistance of the object may represent that rigidity of the object is high. The thermal conductivity may be a unique material property of the object. Even when the material of the object is the same, the degree of deformation resistance may vary depending on the shape of the object. The degree of deformation resistance may be affected by a deformation resistance reinforcement part extending in a direction in which the external force is applied. The more the rigidity of the deformation resistant resistance reinforcement part increases, the more the degree of deformation resistance may increase. The more the height of the extending deformation resistance reinforcement part increase, the more the degree of deformation resistance may increase.

According to an embodiment, a degree of restoration indicates a degree to which an object deformed by the external force is restored to a shape of the object before the external force is applied after the external force is removed and is defined as a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling force.

In view of the material of the object, a high degree of the restoration of the object may represent that an elastic modulus of the object is high. The elastic modulus may be a material property unique to the object. Even when the material of the object is the same, the degree of restoration may vary depending on the shape of the object. The degree of restoration may be affected by an elastic resistance reinforcement part extending in a direction in which the external force is applied. The more the elastic modulus of the elastic resistance reinforcement part increases, the more the degree of restoration may increase.

According to an embodiment, the coupling force represents a degree of coupling between the plurality of tray assemblies and is defined as a value determined by a shape including a thickness of the tray assembly, a material of the tray assembly, magnitude of the force that couples the trays to each other, and the like.

According to an embodiment, a degree of attachment indicates a degree to which the ice and the container are attached to each other in a process of making ice from water contained in the container and is defined as a value determined by a shape including a thickness of the container, a material of the container, a time elapsed after the ice is made in the container, and the like.

The refrigerator according to an embodiment includes a first tray assembly defining a portion of an ice making cell that is a space in which water is phase-changed into ice by cold, a second tray assembly defining the other portion of the ice making cell, a cooler supplying cold to the ice making cell, a water supply part supplying water to the ice making cell, and a controller. The refrigerator may further include a storage chamber in addition to the ice making cell. The storage chamber may include a space for storing food. The ice making cell may be disposed in the storage chamber. The refrigerator may further include a first temperature sensor sensing a temperature in the storage chamber. The refrigerator may further include a second temperature sensor sensing a temperature of water or ice of the ice making cell. The second tray assembly may contact the first tray assembly in the ice making process and may be connected to the driver to be spaced apart from the first tray assembly in the ice making process. The refrigerator may further include a heater disposed adjacent to at least one of the first tray assembly or the second tray assembly.

The controller may control at least one of the heater or the driver. The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water supply part after the second tray assembly moves to the water supply position in the reverse direction when the ice is completely separated.

Transparent ice will be described. Bubbles are dissolved in water, and the ice solidified with the bubbles may have low transparency due to the bubbles. Therefore, in the process of water solidification, when the bubble is guided to move from a freezing portion in the ice making cell to another portion that is not yet frozen, the transparency of the ice may increase.

A through-hole defined in the tray assembly may affect the making of the transparent ice. The through-hole defined in one side of the tray assembly may affect the making of the transparent ice. In the process of making ice, if the bubbles move to the outside of the ice making cell from the frozen portion of the ice making cell, the transparency of the ice may increase. The through-hole may be defined in one side of the tray assembly to guide the bubbles so as to move out of the ice making cell. Since the bubbles have lower density than the liquid, the through-hole (hereinafter, referred to as an "air exhaust hole") for guiding the bubbles to escape to the outside of the ice making cell may be defined in the upper portion of the tray assembly.

The position of the cooler and the heater may affect the making of the transparent ice. The position of the cooler and the heater may affect an ice making direction, which is a direction in which ice is made inside the ice making cell.

In the ice making process, when bubbles move or are collected from a region in which water is first solidified in the ice making cell to another predetermined region in a liquid state, the transparency of the made ice may increase. The direction in which the bubbles move or are collected may be similar to the ice making direction. The predetermined region may be a region in which water is to be solidified lately in the ice making cell.

The predetermined region may be a region in which the cold supplied by the cooler reaches the ice making cell late. For example, in the ice making process, the through-hole through which the cooler supplies the cold to the ice making cell may be defined closer to the upper portion than the lower part of the ice making cell so as to move or collect the bubbles to the lower portion of the ice making cell. For another example, a heat absorbing part of the cooler (that is, a refrigerant pipe of the evaporator or a heat absorbing part of the thermoelectric element) may be disposed closer to the upper portion than the lower portion of the ice making cell. According to an embodiment, the upper and lower portions of the ice making cell may be defined as an upper region and a lower region based on a height of the ice making cell.

The predetermined region may be a region in which the heater is disposed. For example, in the ice making process, the heater may be disposed closer to the lower portion than the upper portion of the ice making cell so as to move or collect the bubbles in the water to the lower portion of the ice making cell.

The predetermined region may be a region closer to an outer circumferential surface of the ice making cell than to a center of the ice making cell. However, the vicinity of the center is not excluded. If the predetermined region is near the center of the ice making cell, an opaque portion due to the bubbles moved or collected near the center may be easily visible to the user, and the opaque portion may remain until most of the ice until the ice is melted. Also, it may be difficult to arrange the heater inside the ice making cell containing water. In contrast, when the predetermined region is defined in or near the outer circumferential surface of the ice making cell, water may be solidified from one side of the outer circumferential surface of the ice making cell toward the other side of the outer circumferential surface of the ice making cell, thereby solving the above limitation. The transparent ice heater may be disposed on or near the outer circumferential surface of the ice making cell. The heater may be disposed at or near the tray assembly.

The predetermined region may be a position closer to the lower portion of the ice making cell than the upper portion of the ice making cell. However, the upper portion is also not excluded. In the ice making process, since liquid water having greater density than ice drops, it may be advantageous that the predetermined region is defined in the lower portion of the ice making cell.

At least one of the degree of deformation resistance, the degree of restoration, and the coupling force between the plurality of tray assemblies may affect the making of the transparent ice. At least one of the degree of deformation resistance, the degree of restoration, and the coupling force between the plurality of tray assemblies may affect the ice making direction that is a direction in which ice is made in the ice making cell. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

To make the transparent ice, it may be advantageous for the refrigerator to be configured so that the direction in which ice is made in the ice making cell is constant. This is because the more the ice making direction is constant, the more the bubbles in the water are moved or collected in a predetermined region within the ice making cell. It may be advantageous for the deformation of the portion to be greater than the deformation of the other portion so as to induce the ice to be made in the direction of the other portion in a portion of the tray assembly. The ice tends to be grown as the ice is expanded toward a portion at which the degree of deformation resistance is low. To start the ice making again after removing the made ice, the deformed portion has to be restored again to make ice having the same shape repeatedly. Therefore, it may be advantageous that the portion having the low degree of the deformation resistance has a high degree of the restoration than the portion having a high degree of the deformation resistance.

The degree of deformation resistance of the tray with respect to the external force may be less than that of the tray case with respect to the external force, or the rigidity of the tray may be less than that of the tray case. The tray assembly allows the tray to be deformed by the external force, while the tray case surrounding the tray is configured to reduce the deformation. For example, the tray assembly may be configured so that at least a portion of the tray is surrounded by the tray case. In this case, when a pressure is applied to the tray assembly while the water inside the ice making cell is solidified and expanded, at least a portion of the tray may be allowed to be deformed, and the other part of the tray may be supported by the tray case to restrict the deformation. In addition, when the external force is removed, the degree of restoration of the tray may be greater than that of the tray case, or the elastic modulus of the tray may be greater than that of the tray case. Such a configuration may be configured so that the deformed tray is easily restored.

The degree of deformation resistance of the tray with respect to the external force may be greater than that of the gasket of the refrigerator with respect to the external force, or the rigidity of the tray may be greater than that of the gasket. When the degree of deformation resistance of the tray is low, there may be a limitation that the tray is excessively deformed as the water in the ice making cell defined by the tray is solidified and expanded. Such a deformation of the tray may make it difficult to make the desired type of ice. In addition, the degree of restoration of the tray when the external force is removed may be configured to be less than that of the refrigerator gasket with respect to the external force, or the elastic modulus of the tray is less than that of the gasket.

The deformation resistance of the tray case with respect to the external force may be less than that of the refrigerator case with respect to the external force, or the rigidity of the tray case may be less than that of the refrigerator case. In general, the case of the refrigerator may be made of a metal material including steel. In addition, when the external force is removed, the degree of restoration of the tray case may be greater than that of the refrigerator case with respect to the external force, or the elastic modulus of the tray case is greater than that of the refrigerator case.

The relationship between the transparent ice and the degree of deformation resistance is as follows.

The second region may have different degree of deformation resistance in a direction along the outer circumferential surface of the ice making cell. The degree of deformation resistance of the portion of the second region may be greater than that of the another of the second region. Such a configuration may be assisted to induce ice to be made in a direction from the ice making cell defined by the second region to the ice making cell defined by the first region.

The first and second regions defined to contact each other may have different degree of deformation resistances in the direction along the outer circumferential surface of the ice making cell. The degree of deformation resistance of one portion of the second region may be greater than that of one portion of the first region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in the other direction of the second region or in one direction of the first region. The degree of deformation resistance may be a degree that resists to deformation due to the external force. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the second region may be thicker than the other of the second region or thicker than one portion of the first region. One portion of the second region may be a portion at which the tray case is not surrounded. The other portion of the second region may be a portion surrounded by the tray case. One portion of the first region may be a portion at which the tray case is not surrounded. One portion of the second region may be a portion defining the uppermost portion of the ice making cell in the second region. The second region may include a tray and a tray case locally surrounding the tray. As described above, when at least a portion of the second region is thicker than the other part, the degree of deformation resistance of the second region may be improved with respect to an external force. A minimum value of the thickness of one portion of the second region may be greater than that of the thickness of the other portion of the second region or greater than that of one portion of the first region. A maximum value of the thickness of one portion of the second region may be greater than that of the thickness of the other portion of the second region or greater than that of one portion of the first region. When the through-hole is defined in the region, the minimum value represents the minimum value in the remaining regions except for the portion in which the through-hole is defined. An average value of the thickness of one portion of the second region may be greater than that of the thickness of the other portion of the second region or greater than that of one portion of the first region. The uniformity of the thickness of one portion of the second region may be less than that of the thickness of the other portion of the second region or less than that of one of the thickness of the first region.

For another example, one portion of the second region may include a first surface defining a portion of the ice making cell and a deformation resistance reinforcement part extending from the first surface in a vertical direction away from the ice making cell defined by the other of the second region. One portion of the second region may include a first surface defining a portion of the ice making cell and a deformation resistance reinforcement part extending from the first surface in a vertical direction away from the ice making cell defined by the first region. As described above, when at least a portion of the second region includes the deformation resistance reinforcement part, the degree of deformation resistance of the second region may be improved with respect to the external force.

For another example, one portion of the second region may further include a support surface connected to a fixed end of the refrigerator (e.g., the bracket, the storage chamber wall, etc.) disposed in a direction away from the ice making cell defined by the other of the second region from the first surface. One portion of the second region may further include a support surface connected to a fixed end of the refrigerator (e.g., the bracket, the storage chamber wall, etc.) disposed in a direction away from the ice making cell defined by the first region from the first surface. As described above, when at least a portion of the second region includes a support surface connected to the fixed end, the degree of deformation resistance of the second region may be improved with respect to the external force.

For another example, the tray assembly may include a first portion defining at least a portion of the ice making cell and a second portion extending from a predetermined point of the first portion. At least a portion of the second portion may extend in a direction away from the ice making cell defined by the first region. At least a portion of the second portion may include an additional deformation resistant resistance reinforcement part. At least a portion of the second portion may further include a support surface connected to the fixed end. As described above, when at least a portion of the second region further includes the second portion, it may be advantageous to improve the degree of deformation resistance of the second region with respect to the external force. This is because the additional deformation resistance reinforcement part is disposed at in the second portion, or the second portion is additionally supported by the fixed end.

For another example, one portion of the second region may include a first through-hole. As described above, when the first through-hole is defined, the ice solidified in the ice making cell of the second region is expanded to the outside of the ice making cell through the first through-hole, and thus, the pressure applied to the second region may be reduced. In particular, when water is excessively supplied to the ice making cell, the first through-hole may be contributed to reduce the deformation of the second region in the process of solidifying the water.

One portion of the second region may include a second through-hole providing a path through which the bubbles contained in the water in the ice making cell of the second region move or escape. When the second through-hole is defined as described above, the transparency of the solidified ice may be improved.

In one portion of the second region, a third through-hole may be defined to press the penetrating pusher. This is because it may be difficult for the non-penetrating type pusher to press the surface of the tray assembly so as to remove the ice when the degree of deformation resistance of the second region increases. The first, second, and third through-holes may overlap each other. The first, second, and third through-holes may be defined in one through-hole.

One portion of the second region may include a mounting part on which the ice separation heater is disposed. The induction of the ice in the ice making cell defined by the second region in the direction of the ice making cell defined by the first region may represent that the ice is first made in the second region. In this case, a time for which the ice is attached to the second region may be long, and the ice separation heater may be required to separate the ice from the second region. The thickness of the tray assembly in the direction of the outer circumferential surface of the ice making cell from the center of the ice making cell may be less than that of the other portion of the second region in which the ice separation heater is mounted. This is because the heat supplied by the ice separation heater increases in amount transferred to the ice making cell. The fixed end may be a portion of the wall defining the storage chamber or a bracket.

The relation between the coupling force of the transparent ice and the tray assembly is as follows.

To induce the ice to be made in the ice making cell defined by the second region in the direction of the ice making cell defined by the first region, it may be advantageous to increase in coupling force between the first and second regions arranged to contact each other. In the process of solidifying the water, when the pressure applied to the tray assembly while expanded is greater than the coupling force between the first and second regions, the ice may be made in a direction in which the first and second regions are separated from each other. In the process of solidifying the water, when the pressure applied to the tray assembly while expanded is low, the coupling force between the first and second regions is low, it also has the advantage of inducing the ice to be made so that the ice is made in a direction of the region having the smallest degree of deformation resistance in the first and second regions.

There may be various examples of a method of increasing the coupling force between the first and second regions. For example, after the water supply is completed, the controller may change a movement position of the driver in the first direction to control one of the first and second regions so as to move in the first direction, and then, the movement position of the driver may be controlled to be additionally changed into the first direction so that the coupling force between the first and second regions increases. For another example, since the coupling force between the first and second regions increase, the degree of deformation resistances or the degree of restorations of the first and second regions may be different from each other with respect to the force applied from the driver so that the driver reduces the change of the shape of the ice making cell by the expanding the ice after the ice making process is started (or after the heater is turned on). For another example, the first region may include a first surface facing the second region. The second region may include a second surface facing the first region. The first and second surfaces may be disposed to contact each other. The first and second surfaces may be disposed to face each other. The first and second surfaces may be disposed to be separated from and coupled to each other. In this case, surface areas of the first surface and the second surface may be different from each other. In this configuration, the coupling force of the first and second regions may increase while reducing breakage of the portion at which the first and second regions contact each other. In addition, there is an advantage of reducing leakage of water supplied between the first and second regions.

The relationship between transparent ice and the degree of restoration is as follows.

The tray assembly may include a first portion that defines at least a portion of the ice making cell and a second portion extending from a predetermined point of the first portion. The second portion is configured to be deformed by the expansion of the ice made and then restored after the ice is removed. The second portion may include a horizontal extension part provided so that the degree of restoration with respect to the horizontal external force of the expanded ice increases. The second portion may include a vertical extension part provided so that the degree of restoration with respect to the vertical external force of the expanded ice increases. Such a configuration may be assisted to induce ice to be made in a direction from the ice making cell defined by the second region to the ice making cell defined by the first region.

The second region may have different degree of restoration in a direction along the outer circumferential surface of the ice making cell. The first region may have different degree of deformation resistance in a direction along the outer circumferential surface of the ice making cell. The degree of restoration of one portion of the first region may be greater than that of the other portion of the first region. Also, the degree of deformation resistance of one portion may be less than that of the other portion. Such a configuration may be assisted to induce ice to be made in a direction from the ice making cell defined by the second region to the ice making cell defined by the first region.

The first and second regions defined to contact each other may have different degree of restoration in the direction along the outer circumferential surface of the ice making cell. Also, the first and second regions may have different degree of deformation resistances in the direction along the outer circumferential surface of the ice making cell. The degree of restoration of one of the first region may be greater than that of one of the second region. Also, the degree of deformation resistance of one of the first regions may be greater than that of one of the second region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in one direction of the first region in which the degree of deformation resistance decreases, or the degree of restoration increases. Here, the degree of restoration may be a degree of restoration after the external force is removed. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowermost end of the ice making cell. The first region may include a tray and a tray case locally surrounding the tray.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, a shape of one portion of the first region may be different from that of the other portion of the first region or different from that of one portion of the second region. A curvature of one portion of the first region may be different from that of the other portion of the first region or different from that of one portion of the second region. A curvature of one portion of the first region may be less than that of the other portion of the first region or less than that of one portion of the second region. One portion of the first region may include a flat surface. The other portion of the first region may include a curved surface. One portion of the second region may include a curved surface. One portion of the first region may include a shape that is recessed in a direction opposite to the direction in which the ice is expanded. One portion of the first region may include a shape recessed in a direction opposite to a direction in which the ice is made. In the ice making process, one portion of the first region may be modified in a direction in which the ice is expanded or a direction in which the ice is made. In the ice making process, in an amount of deformation from the center of the ice making cell toward the outer circumferential surface of the ice making cell, one portion of the first region is greater than the other portion of the first region. In the ice making process, in the amount of deformation from the center of the ice making cell toward the outer circumferential surface of the ice making cell, one portion of the first region is greater than one portion of the second region.

For another example, to induce ice to be made in a direction from the ice making cell defined by the second region to the ice making cell defined by the first region, one portion of the first region may include a first surface defining a portion of the ice making cell and a second surface extending from the first surface and supported by one surface of the other portion of the first region. The first region may be configured not to be directly supported by the other component except for the second surface. The other component may be a fixed end of the refrigerator.

One portion of the first region may have a pressing surface pressed by the non-penetrating type pusher. This is because when the degree of deformation resistance of the first region is low, or the degree of restoration is high, the difficulty in removing the ice by pressing the surface of the tray assembly may be reduced.

An ice making rate, at which ice is made inside the ice making cell, may affect the making of the transparent ice. The ice making rate may affect the transparency of the made ice. Factors affecting the ice making rate may be an amount of cold and/or heat, which are/is supplied to the ice making cell. The amount of cold and/or heat may affect the making of the transparent ice. The amount of cold and/or heat may affect the transparency of the ice.

In the process of making the transparent ice, the transparency of the ice may be lowered as the ice making rate is greater than a rate at which the bubbles in the ice making cell are moved or collected. On the other hand, if the ice making rate is less than the rate at which the bubbles are moved or collected, the transparency of the ice may increase. However, the more the ice making rate decreases, the more a time taken to make the transparent ice may increase. Also, the transparency of the ice may be uniform as the ice making rate is maintained in a uniform range.

To maintain the ice making rate uniformly within a predetermined range, an amount of cold and heat supplied to the ice making cell may be uniform. However, in actual use conditions of the refrigerator, a case in which the amount of cold is variable may occur, and thus, it is necessary to allow a supply amount of heat to vary. For example, when a temperature of the storage chamber reaches a satisfaction region from a dissatisfaction region, when a defrosting operation is performed with respect to the cooler of the storage chamber, the door of the storage chamber may variously vary in state such as an opened state. Also, if an amount of water per unit height of the ice making cell is different, when the same cold and heat per unit height is supplied, the transparency per unit height may vary.

To solve this limitation, the controller may control the heater so that when a heat transfer amount between the cold within the storage chamber and the water of the ice making cell increases, the heating amount of transparent ice heater increases, and when the heat transfer amount between the cold within the storage chamber and the water of the ice making cell decreases, the heating amount of transparent ice heater decreases so as to maintain an ice making rate of the water within the ice making cell within a predetermined range that is less than an ice making rate when the ice making is performed in a state in which the heater is turned off.

The controller may control one or more of a cold supply amount of cooler and a heat supply amount of heater to vary according to a mass per unit height of water in the ice making cell. In this case, the transparent ice may be provided to correspond to a change in shape of the ice making cell.

The refrigerator may further include a sensor measuring information on the mass of water per unit height of the ice making cell, and the controller may control one of the cold supply amount of cooler and the heat supply amount of heater based on the information inputted from the sensor.

The refrigerator may include a storage part in which predetermined driving information of the cooler is recorded based on information on mass per unit height of the ice making cell, and the controller may control the cold supply amount of cooler to be changed based on the information.

The refrigerator may include a storage part in which predetermined driving information of the heater is recorded based on information on mass per unit height of the ice making cell, and the controller may control the heat supply amount of heater to be changed based on the information. For example, the controller may control at least one of the cold supply amount of cooler or the heat supply amount of heater to vary according to a predetermined time based on the information on the mass per unit height of the ice making cell. The time may be a time when the cooler is driven or a time when the heater is driven to make ice. For another example, the controller may control at least one of the cold supply amount of cooler or the heat supply amount of heater to vary according to a predetermined temperature based on the information on the mass per unit height of the ice making cell. The temperature may be a temperature of the ice making cell or a temperature of the tray assembly defining the ice making cell.

When the sensor measuring the mass of water per unit height of the ice making cell is malfunctioned, or when the water supplied to the ice making cell is insufficient or excessive, the shape of the ice making water is changed, and thus the transparency of the made ice may decrease. To solve this limitation, a water supply method in which an amount of water supplied to the ice making cell is precisely controlled is required. Also, the tray assembly may include a structure in which leakage of the tray assembly is reduced to reduce the leakage of water in the ice making cell at the water supply position or the ice making position. Also, it is necessary to increase the coupling force between the first and second tray assemblies defining the ice making cell so as to reduce the change in shape of the ice making cell due to the expansion force of the ice during the ice making. Also, it is necessary to decrease in leakage in the precision water supply method and the tray assembly and increase in coupling force between the first and second tray assemblies so as to make ice having a shape that is close to the tray shape.

The degree of supercooling of the water inside the ice making cell may affect the making of the transparent ice. The degree of supercooling of the water may affect the transparency of the made ice.

To make the transparent ice, it may be desirable to design the degree of supercooling or lower the temperature inside the ice making cell and thereby to maintain a predetermined range. This is because the supercooled liquid has a characteristic in which the solidification rapidly occurs from a time point at which the supercooling is terminated. In this case, the transparency of the ice may decrease.

In the process of solidifying the liquid, the controller of the refrigerator may control the supercooling release part to operate so as to reduce a degree of supercooling of the liquid if the time required for reaching the specific temperature below the freezing point after the temperature of the liquid reaches the freezing point is less than a reference value. After reaching the freezing point, it is seen that the temperature of the liquid is cooled below the freezing point as the supercooling occurs, and no solidification occurs.

An example of the supercooling release part may include an electrical spark generating part. When the spark is supplied to the liquid, the degree of supercooling of the liquid may be reduced. Another example of the supercooling release part may include a driver applying external force so that the liquid moves. The driver may allow the container to move in at least one direction among X, Y, or Z axes or to rotate about at least one axis among X, Y, or Z axes. When kinetic energy is supplied to the liquid, the degree of supercooling of the liquid may be reduced. Further another example of the supercooling release part may include a part supplying the liquid to the container. After supplying the liquid having a first volume less than that of the container, when a predetermined time has elapsed or the temperature of the liquid reaches a certain temperature below the freezing point, the controller of the refrigerator may control an amount of liquid to additionally supply the liquid having a second volume greater than the first volume. When the liquid is divided and supplied to the container as described above, the liquid supplied first may be solidified to act as freezing nucleus, and thus, the degree of supercooling of the liquid to be supplied may be further reduced.

The more the degree of heat transfer of the container containing the liquid increase, the more the degree of supercooling of the liquid may increase. The more the degree of heat transfer of the container containing the liquid decrease, the more the degree of supercooling of the liquid may decrease.

The structure and method of heating the ice making cell in addition to the heat transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

The cold supplied to the ice making cell and the heat supplied to the ice making cell have opposite properties. To increase the ice making rate and/or improve the transparency of the ice, the design of the structure and control of the cooler and the heater, the relationship between the cooler and the tray assembly, and the relationship between the heater and the tray assembly may be very important.

For a constant amount of cold supplied by the cooler and a constant amount of heat supplied by the heater, it may be advantageous for the heater to be arranged to locally heat the ice making cell so as to increase the ice making rate of the refrigerator and/or to increase the transparency of the ice. As the heat transmitted from the heater to the ice making cell is transferred to an area other than the area on which the heater is disposed, the ice making rate may be improved. As the heater heats only a portion of the ice making cell, the heater may move or collect the bubbles to an area adjacent to the heater in the ice making cell, thereby increasing the transparency of the ice.

When the amount of heat supplied by the heater to the ice making cell is large, the bubbles in the water may be moved or collected in the portion to which the heat is supplied, and thus, the made ice may increase in transparency. However, if the heat is uniformly supplied to the outer circumferential surface of the ice making cell, the ice making rate of the ice may decrease. Therefore, as the heater locally heats a portion of the ice making cell, it is possible to increase the transparency of the made ice and minimize the decrease of the ice making rate.

The heater may be disposed to contact one side of the tray assembly. The heater may be disposed between the tray and the tray case. The heat transfer through the conduction may be advantageous for locally heating the ice making cell.

At least a portion of the other side at which the heater does not contact the tray may be sealed with a heat insulation material. Such a configuration may reduce that the heat supplied from the heater is transferred toward the storage chamber.

The tray assembly may be configured so that the heat transfer from the heater toward the center of the ice making cell is greater than that transfer from the heater in the circumference direction of the ice making cell.

The heat transfer of the tray toward the center of the ice making cell in the tray may be greater than the that transfer from the tray case to the storage chamber, or the thermal conductivity of the tray may be greater than that of the tray case. Such a configuration may induce the increase in heat transmitted from the heater to the ice making cell via the tray. In addition, it is possible to reduce the heat of the heater is transferred to the storage chamber via the tray case.

The heat transfer of the tray toward the center of the ice making cell in the tray may be less than that of the refrigerator case toward the storage chamber from the outside of the refrigerator case (for example, an inner case or an outer case), or the thermal conductivity of the tray may be less than that of the refrigerator case. This is because the more the heat or thermal conductivity of the tray increases, the more the supercooling of the water accommodated in the tray may increase. The more the degree of supercooling of the water increase, the more the water may be rapidly solidified at the time point at which the supercooling is released. In this case, a limitation may occur in which the transparency of the ice is not uniform or the transparency decreases. In general, the case of the refrigerator may be made of a metal material including steel.

The heat transfer of the tray case in the direction from the storage chamber to the tray case may be greater than the that of the heat insulation wall in the direction from the outer space of the refrigerator to the storage chamber, or the thermal conductivity of the tray case may be greater than that of the heat insulation wall (for example, the insulation material disposed between the inner and outer cases of the refrigerator). Here, the heat insulation wall may represent a heat insulation wall that partitions the external space from the storage chamber. If the degree of heat transfer of the tray case is equal to or greater than that of the heat insulation wall, the rate at which the ice making cell is cooled may be excessively reduced.

The first region may be configured to have a different degree of heat transfer in a direction along the outer circumferential surface. The degree of heat transfer of one portion of the first region may be less than that of the other portion of the first region. Such a configuration may be assisted to reduce the heat transfer transferred through the tray assembly from the first region to the second region in the direction along the outer circumferential surface.

The first and second regions defined to contact each other may be configured to have a different degree of heat transfer in the direction along the outer circumferential surface. The degree of heat transfer of one portion of the first region may be configured to be less than the degree of heat transfer of one portion of the second region. Such a configuration may be assisted to reduce the heat transfer transferred through the tray assembly from the first region to the second region in the direction along the outer circumferential surface. In another aspect, it may be advantageous to reduce the heat transferred from the heater to one portion of the first region to be transferred to the ice making cell defined by the second region. As the heat transmitted to the second region is reduced, the heater may locally heat one portion of the first region. Thus, it may be possible to reduce the decrease in ice making rate by the heating of the heater. In another aspect, the bubbles may be moved or collected in the region in which the heater is locally heated, thereby improving the transparency of the ice. The heater may be a transparent ice heater.

For example, a length of the heat transfer path from the first region to the second region may be greater than that of the heat transfer path in the direction from the first region to the outer circumferential surface from the first region. For another example, in a thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

As described above, when the thickness of the first region is thin, the heat transfer in the direction of the center of the ice making cell may increase while reducing the heat transfer in the direction of the outer circumferential surface of the ice making cell. For this reason, the ice making cell defined by the first region may be locally heated.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For example, the tray assembly may include a first portion defining at least a portion of the ice making cell and a second portion extending from a predetermined point of the first portion. The first region may be defined in the first portion. The second region may be defined in an additional tray assembly that may contact the first portion. At least a portion of the second portion may extend in a direction away from the ice making cell defined by the second region. In this case, the heat transmitted from the heater to the first region may be reduced from being transferred to the second region.

The structure and method of cooling the ice making cell in addition to the degree of cold transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

For a constant amount of cold supplied by the cooler and a constant amount of heat supplied by the heater, it may be advantageous to configure the cooler so that a portion of the ice making cell is more intensively cooled to increase the ice making rate of the refrigerator and/or increase the transparency of the ice. The more the cold supplied to the ice making cell by the cooler increases, the more the ice making rate may increase. However, as the cold is uniformly supplied to the outer circumferential surface of the ice making cell, the transparency of the made ice may decrease. Therefore, as the cooler more intensively cools a portion of the ice making cell, the bubbles may be moved or collected to other regions of the ice making cell, thereby increasing the transparency of the made ice and minimizing the decrease in ice making rate.

The cooler may be configured so that the amount of cold supplied to the second region differs from that of cold supplied to the first region so as to allow the cooler to more intensively cool a portion of the ice making cell. The amount of cold supplied to the second region by the cooler may be greater than that of cold supplied to the first region.

For example, the second region may be made of a metal material having a high cold transfer rate, and the first region may be made of a material having a cold rate less than that of the metal.

For another example, to increase the degree of cold transfer transmitted from the storage chamber to the center of the ice making cell through the tray assembly, the second region may vary in degree of cold transfer toward the central direction. The degree of cold transfer of one portion of the second region may be greater than that of the other portion of the second region. A through-hole may be defined in one portion of the second region. At least a portion of the heat absorbing surface of the cooler may be disposed in the through-hole. A passage through which the cold air supplied from the cooler passes may be disposed in the through-hole. The one portion may be a portion that is not surrounded by the tray case. The other portion may be a portion surrounded by the tray case. One portion of the second region may be a portion defining the uppermost portion of the ice making cell in the second region. The second region may include a tray and a tray case locally surrounding the tray. As described above, when a portion of the tray assembly has a high cold transfer rate, the supercooling may occur in the tray assembly having a high cold transfer rate. As described above, designs may be needed to reduce the degree of the supercooling.

Figure 2:
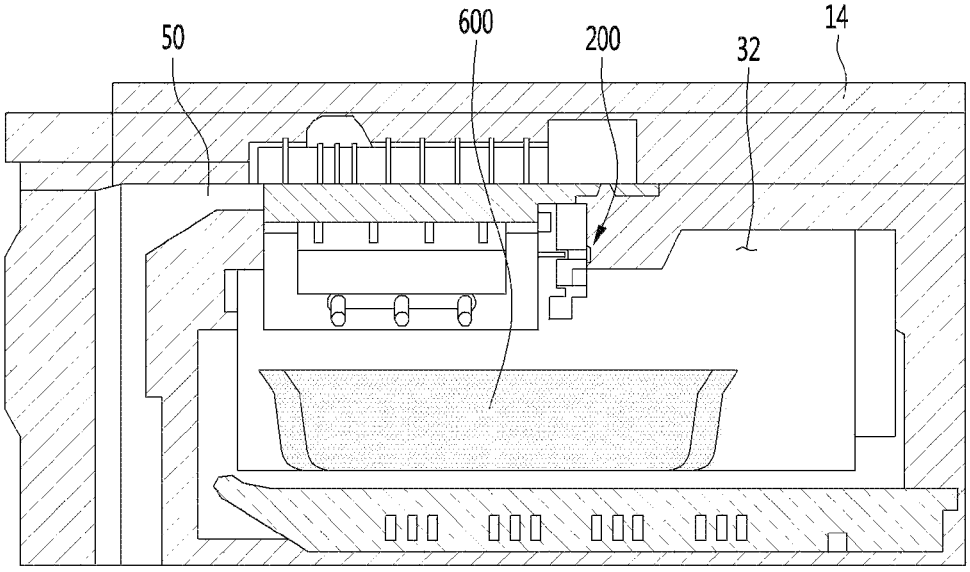
FIG. 2 is a side cross-sectional view illustrating a refrigerator in which an ice maker is installed.

FIG. 2 is a side cross-sectional view illustrating a refrigerator in which an ice maker is installed.

As illustrated in FIG. 1(*a*), a refrigerator according to an embodiment of the present disclosure may include a plurality of doors 10, 20, and 30 for opening and closing a storage chamber for food. The doors 10, 20, and 30 may include doors 10 and 20 for opening and closing the storage chamber in a rotating manner and a door 30 for opening and closing the storage chamber in a sliding manner.

FIG. 1(*b*) is a cross-sectional view as viewed from the rear of the refrigerator. The refrigerator cabinet 14 may include a refrigerating compartment 18 and a freezing compartment 32. The refrigerating compartment 18 is disposed on the upper side, and the freezing compartment 32 is disposed on the lower side, so that each storage chamber can be opened and closed individually by each door. Unlike the present embodiment, this embodiment is also applicable to a refrigerator in which a freezing compartment is disposed on the upper side and a refrigerating compartment is disposed on the lower side.

The freezing compartment 32 may be divided into an upper space and a lower space, and a drawer 40 capable of being withdrawn from and inserted into the lower space may be provided in the lower space. Although the freezing compartment 32 can be opened and closed by one door 30, the freezing compartment 32 may be provided to be separated into two spaces.

An ice maker 200 capable of manufacturing ice may be provided in the upper space of the freezing compartment 32.

An ice bin 600 in which ice produced by the ice maker 200 is fallen and stored may be provided under the ice maker 200. The user can take out the ice bin 600 and use the ice stored in the ice bin 600. The ice bin 600 may be mounted on an upper side of a horizontal wall separating the upper space and the lower space of the freezing compartment 32.

Referring to FIG. 2, the cabinet 14 is provided with a duct 50 for supplying cold air, which is an example of cold, to the ice maker 200. The duct 50 cools the ice maker 200 by discharging cold air supplied from an evaporator through which the refrigerant compressed by the compressor is evaporated. Ice may be generated in the ice maker 200 by the cold air supplied to the ice maker 200.

In FIG. 2, it is possible that the right side is the rear of the refrigerator and the left side is the front side of the refrigerator, that is, a part where a door is installed. At this time, the duct 50 may be disposed at the rear of the cabinet 14 to discharge cold air toward the front of the cabinet 14. The ice maker 200 is disposed in front of the duct 50.

The discharge port of the duct 50 is positioned on the ceiling of the freezing compartment 32, and it is possible to discharge cold air to the upper side of the ice maker 200.

Figure 3:
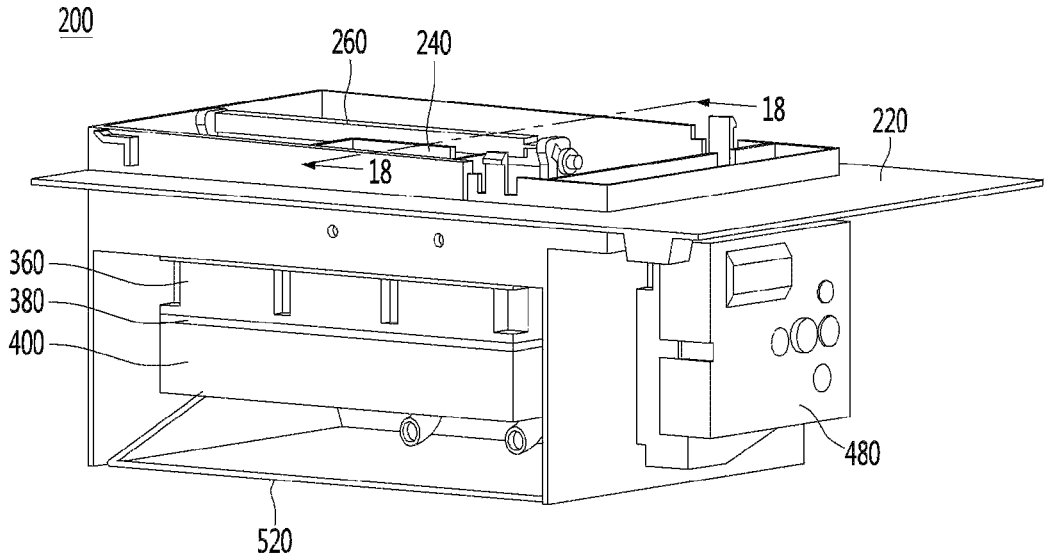
FIG. 3(*a*)-(*b*) is a perspective view of an ice maker according to an embodiment.
Figure 3:
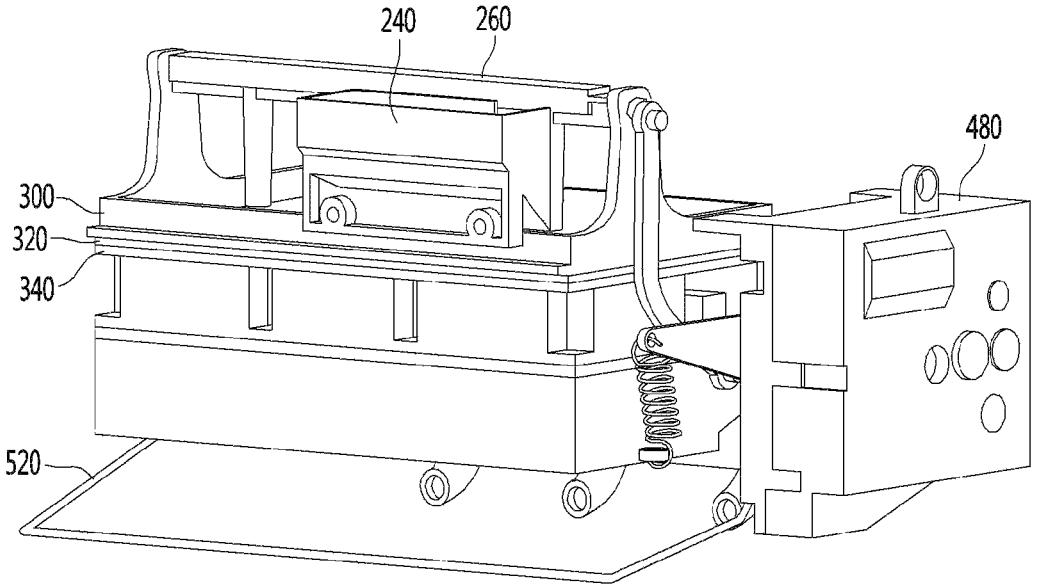
Figure 4:
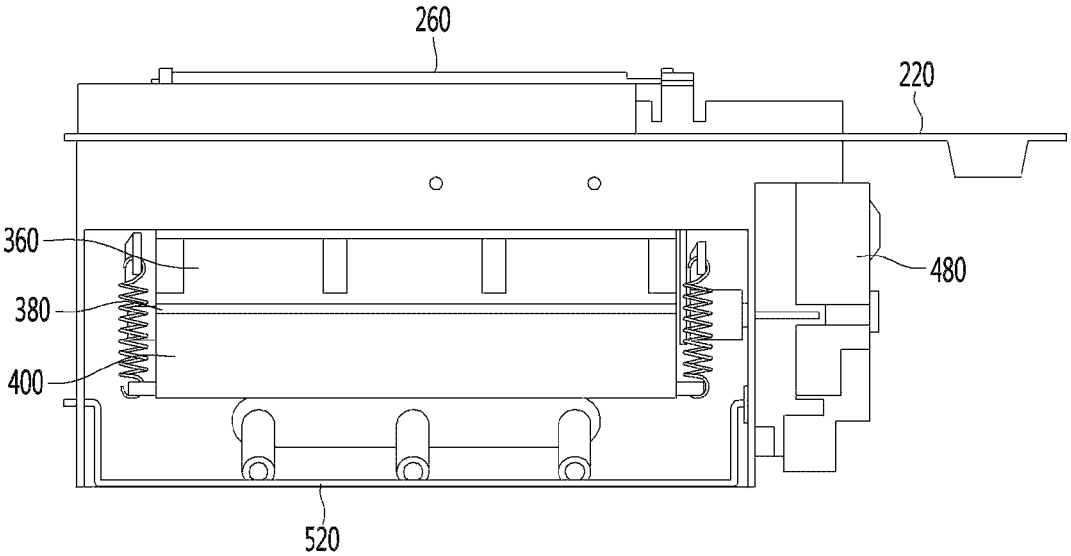
FIG. 4(*a*)-(*b*) is a front view illustrating an ice maker.
Figure 4:
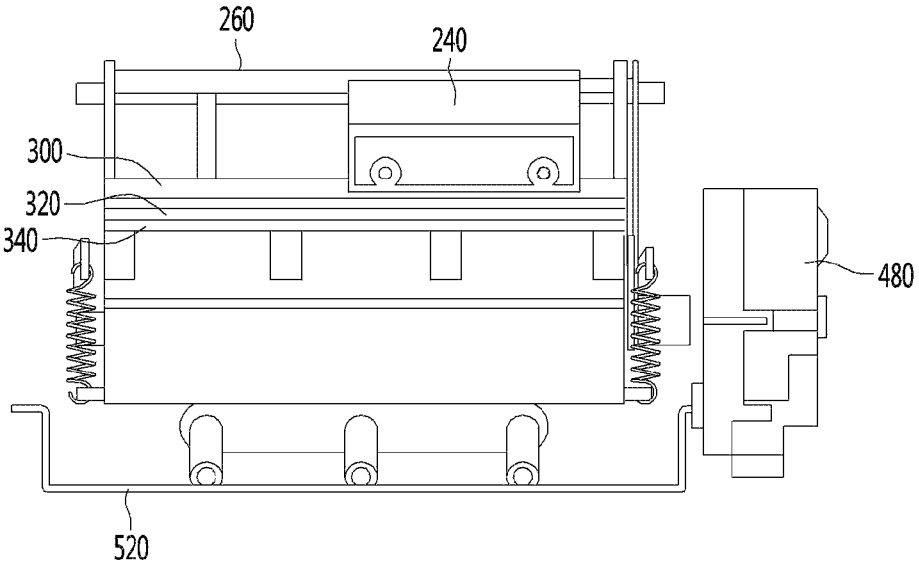
Figure 5:
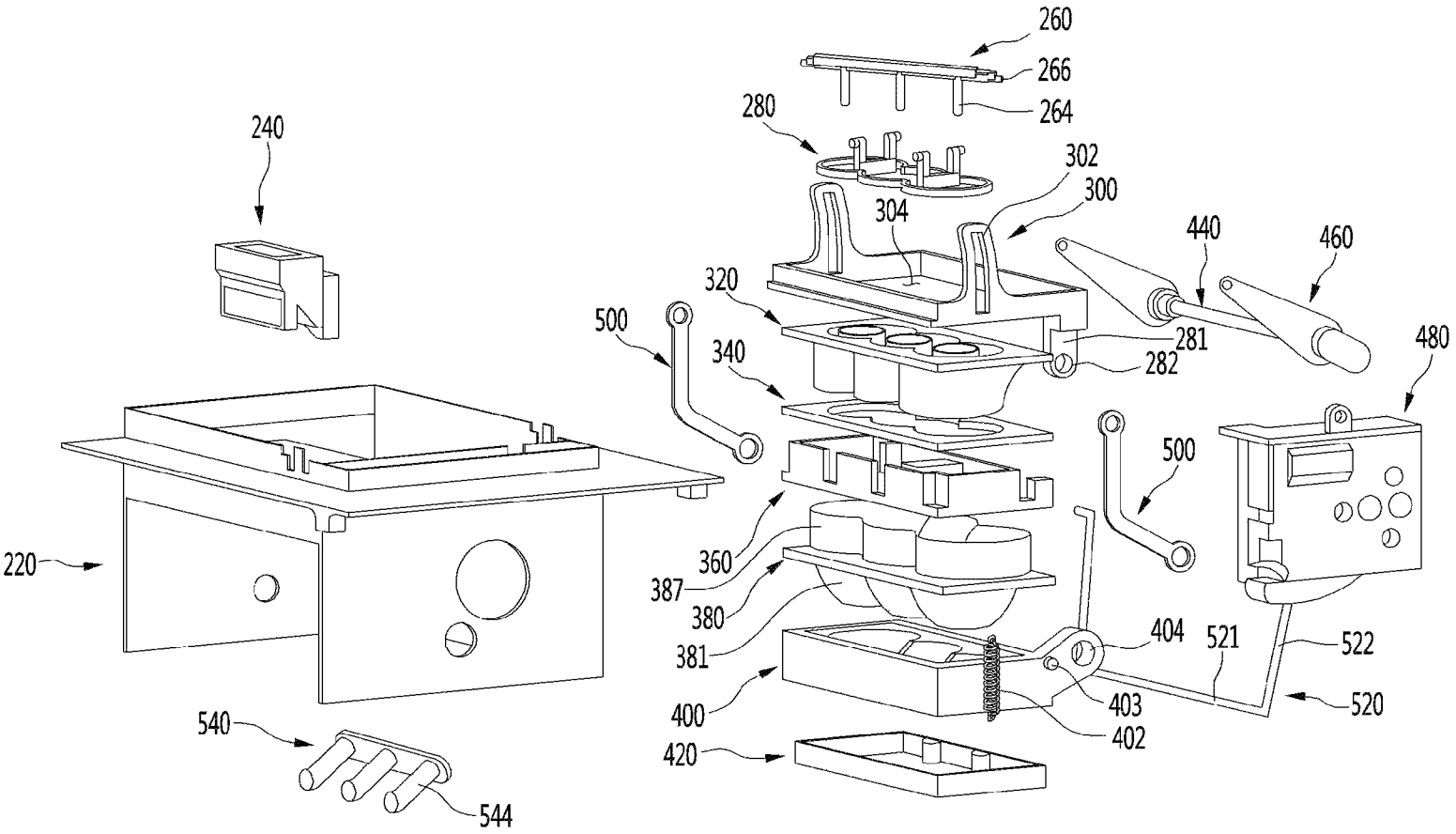
FIG. 5 is an exploded perspective view of an ice maker.

FIG. 3(*a*)-(*b*) is a perspective view of an ice maker according to an embodiment, FIG. 4(*a*)-(*b*) is a front view illustrating an ice maker, and FIG. 5 is an exploded perspective view of an ice maker.

FIGS. 3*a* and 4*a* are views including a bracket 220 for fixing the ice maker 200 to the freezing compartment 32, and FIGS. 3*b* and 4*b* are views illustrating a state in which the bracket 220 is removed. Each component of the ice maker 200 may be provided inside or outside the bracket 220, and thus, the ice maker 200 may constitute one assembly. Accordingly, the ice maker 200 may be installed on the ceiling of the freezing compartment 32.

A water supply part 240 is installed above the inner surface of the bracket 200. The water supply part 240 is provided with openings at the upper and lower sides, respectively, so that water supplied to the upper side of the water supply part 240 may be guided to the lower side of the water supply part 240. The upper opening of the water supply part 240 is larger than the lower opening thereof, and thus, a discharge range of water guided downward through the water supply part 240 may be limited.

A water supply pipe through which water is supplied is installed above the water supply part 240, so that water is supplied to the water supply part 240, and the supplied water may be moved downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

Figure 18:
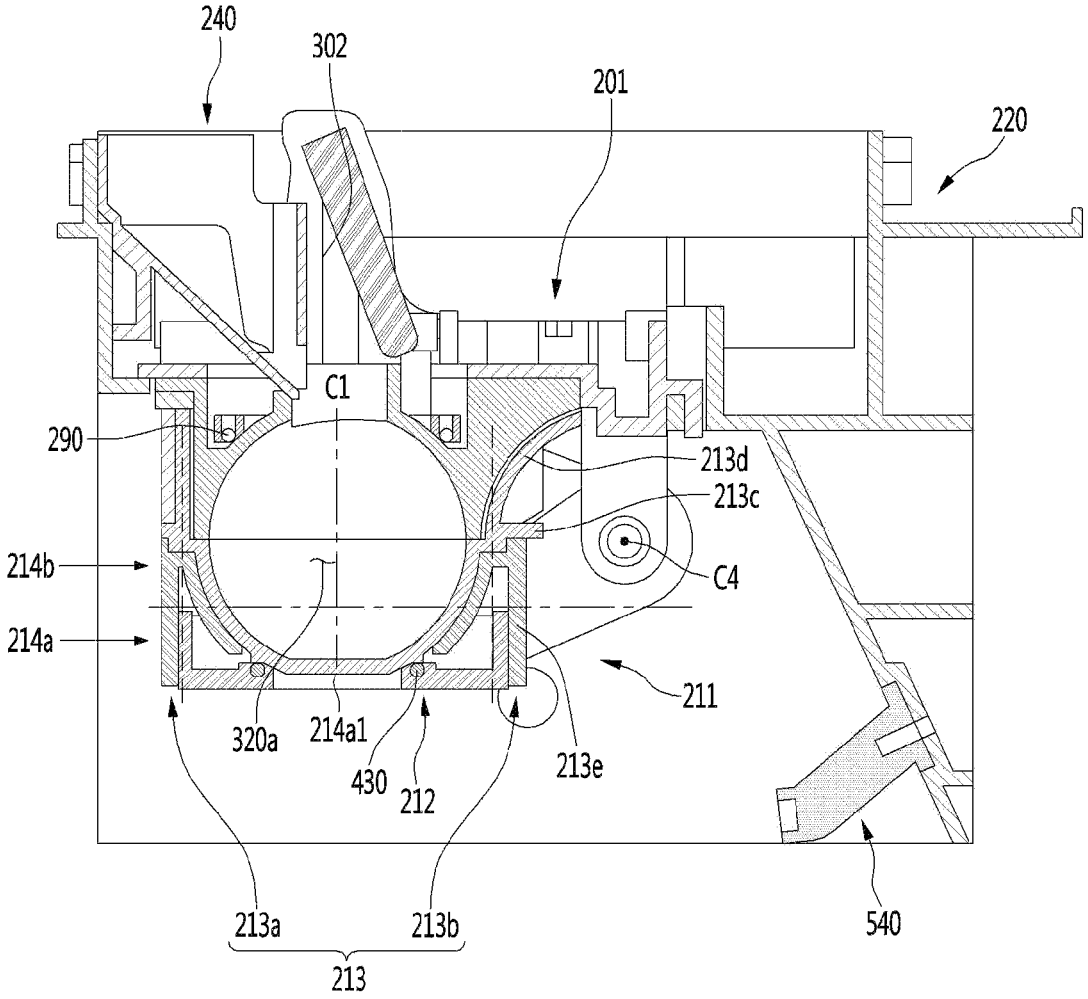
FIG. 18 is a cross-sectional view taken along line 18-18 of FIG. 3(*a*).

The ice maker 200 may include a tray forming an ice making cell 320*a* (see FIG. 18). The tray may include, for example, a first tray 320 defining a portion of the ice making cell 320*a* and a second tray 380 defining another portion of the ice making cell 320*a*.

The first tray 320 and the second tray 380 may define a plurality of ice making cells 320*a* in which a plurality of ice can be generated. A first cell provided in the first tray 320 and a second cell provided in the second tray 380 may define a complete ice making cell 320*a*.

The first tray 320 may have openings at upper and lower sides, respectively, so that water dropping from the upper side of the first tray 320 can be moved downward.

A first tray supporter 340 may be disposed under the first tray 320. The first tray supporter 340 has an opening formed to correspond to each cell shape of the first tray 320 and thus may be coupled to the lower surface of the first tray 320.

A first tray cover 300 may be coupled to an upper side of the first tray 320. The outer appearance of the upper side of the first tray 320 may be maintained. A first heater case 280 may be coupled to the first tray cover 300. Alternatively, the first heater case 380 may be integrally formed with the first tray cover 300.

The first heater case 280 is provided with a first heater (an ice separation heater) to supply heat to the upper portion of the ice maker 200. The first heater may be embedded in the heater case 280 or installed on one surface thereof.

The first tray cover 300 may be provided with a guide slot 302 inclined at an upper side and vertically extending at a lower side. The guide slot 302 may be provided inside a member extending upward of the tray case 300.

The guide protrusion 262 of the first pusher 260 is inserted into the guide slot 302, so that the guide protrusion 262 may be guided along the guide slot 302. The first pusher 260 is provided with an extension part 264 extending equal to the number of cells of each of the first tray 320, so that ice positioned in each cell may be pushed out.

The guide protrusion 262 of the first pusher 260 is coupled to the pusher link 500. At this time, the guide protrusion 262 is rotatably coupled to the pusher link 500 so that when the pusher link 500 moves, the first pusher 260 may also move along the guide slot 302.

A second tray cover 360 is provided on the upper side of the second tray 380 so that the outer appearance of the second tray 380 can be maintained. The second tray 380 has a shape protruding upward so that a plurality of cells constituting a space in which individual ice can be generated are separated, and the second tray cover 360 can surround a cell protruding upward.

A second tray supporter 400 is provided below the second tray 380 to maintain a cell shape protruding downward from the second tray 380. A spring 402 is provided on one side of the second tray supporter 400.

A second heater case 420 is provided under the second tray supporter 400. A second heater (transparent ice heater) is provided in the second heater case 420 to supply heat to the lower portion of the ice maker 200.

The ice maker 200 is provided with a driver 480 that provides rotational force.

A through-hole 282 is formed in an extension part extending downward on one side of the first tray cover 300. A through-hole 404 is formed in an extension part extending to one side of the second tray supporter 400. A shaft 440 penetrating the through-hole 282 and the through-hole 404 together is provided, and rotation arms 460 are provided at both ends of the shaft 440, respectively. The shaft 440 may be rotated by receiving a rotational force from the driver 480.

One end of the rotation arm 460 may be connected to one end of the spring 402, and thus, a position of the rotation arm 460 may move to an initial value by restoring force when the spring 402 is tensioned.

A motor and a plurality of gears may be coupled to each other in the driver 480.

A full ice detection lever 520 may be connected to the driver 480. The full ice detection lever 520 may also rotate by the rotational force provided by the driver 480.

The full ice detection lever 520 may have a '.' shape as a whole, and may include a portion extending vertically at both ends and a portion disposed horizontally connecting two portions extending vertically to each other. One of the two vertically extending portions is coupled to the driver 480 and the other is coupled to the bracket 220, so that the full ice detection lever 520 can detect the ice stored in the ice bin 600 while being rotated.

A second pusher 540 is provided on an inner lower surface of the bracket 220. The second pusher 540 is provided with a coupling piece 542 coupled to the bracket 220 and a plurality of extension parts 544 installed on the coupling piece 542. The plurality of extension parts 544 are provided to be equal to the number of the plurality of cells provided in the second tray 380, so that the extension part performs the function of pushing so that the ice generated in the cells of the second tray 380 can be separated from the second tray 380.

The first tray cover 300 and the second tray supporter 400 may be rotatably coupled to each other with respect to the shaft 440 and may be disposed so that an angle thereof is changed around the shaft 440.

Each of the first tray 320 and the second tray 380 is made of a material that is easily deformable, such as silicone, so that when pressed by each pusher, it is instantly deformed so that the generated ice can be easily separated from the tray.

FIGS. 6 to 11 are views illustrating a state in which some components of the ice maker are combined.

Figure 6:
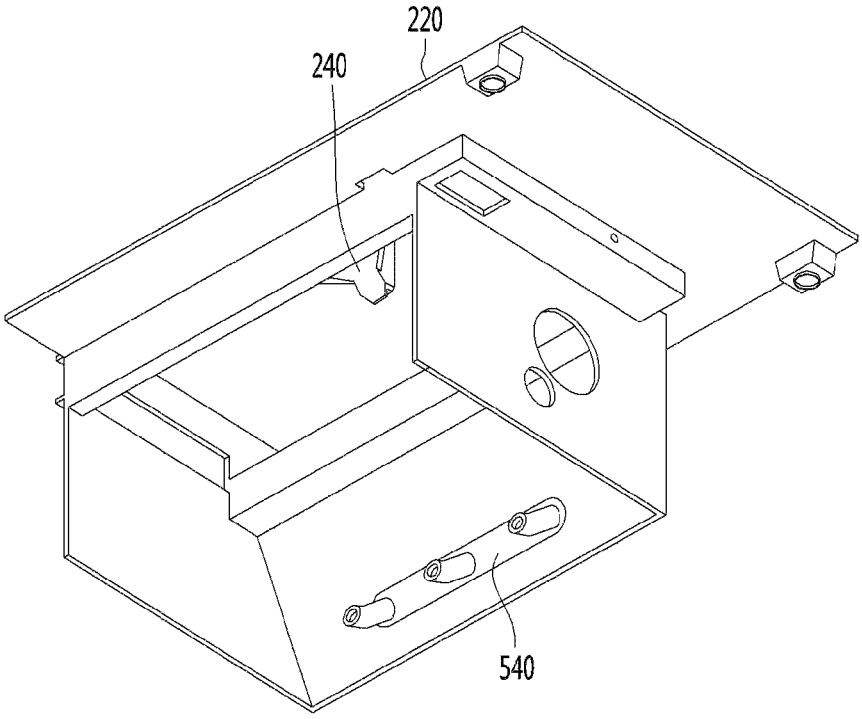
FIGS. 6 to 11 are views illustrating a state in which some components of the ice maker are combined.

FIG. 6 is a view for explaining a state in which the bracket 220, the water supply part 240, and the second pusher 540 are coupled. The second pusher 540 is installed on the inner surface of the bracket 220, and the extension part of the second pusher 540 is disposed so that the direction extending from the coupling piece 542 is not vertical but inclined downward.

Figure 7:
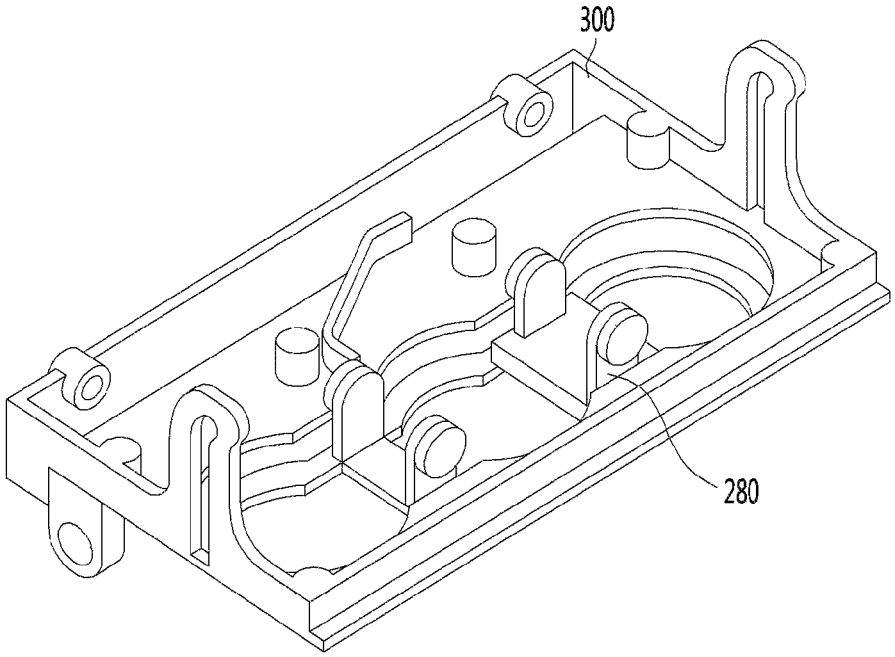

FIG. 7 is a view illustrating a state in which the first heater case 280 and the first tray cover 300 are coupled.

The first heater case 280 may be disposed such that a horizontal surface is spaced downward from the lower surface of the first tray cover 300. The first heater case 280 and the first tray cover 300 have an opening corresponding to each cell of the first tray 320 so that water can pass therethrough, and the shape of each opening can form a shape corresponding to each cell.

Figure 8:
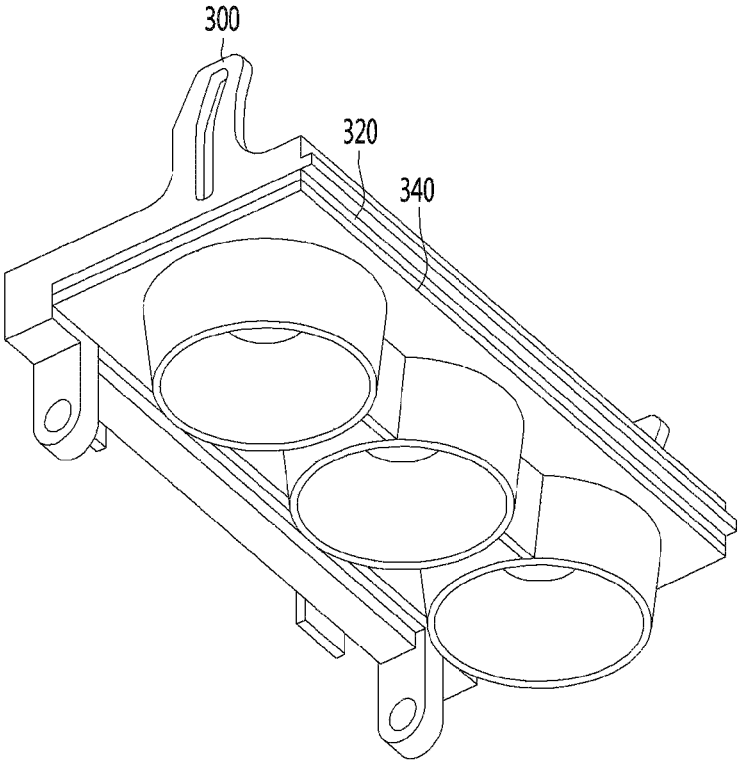

FIG. 8 is a view illustrating a state in which the first tray cover 300, the first tray 320, and the first tray supporter 340 are coupled.

The tray cover 340 is disposed between the first tray 320 and the first tray cover 300.

The first tray cover 300, the first tray 320, and the tray cover 340 are combined as a single module, so that the first tray cover 300, the first tray 320, and the tray cover 340 may be disposed on the shaft 440 so as to be rotatable together with one member.

Figure 9:
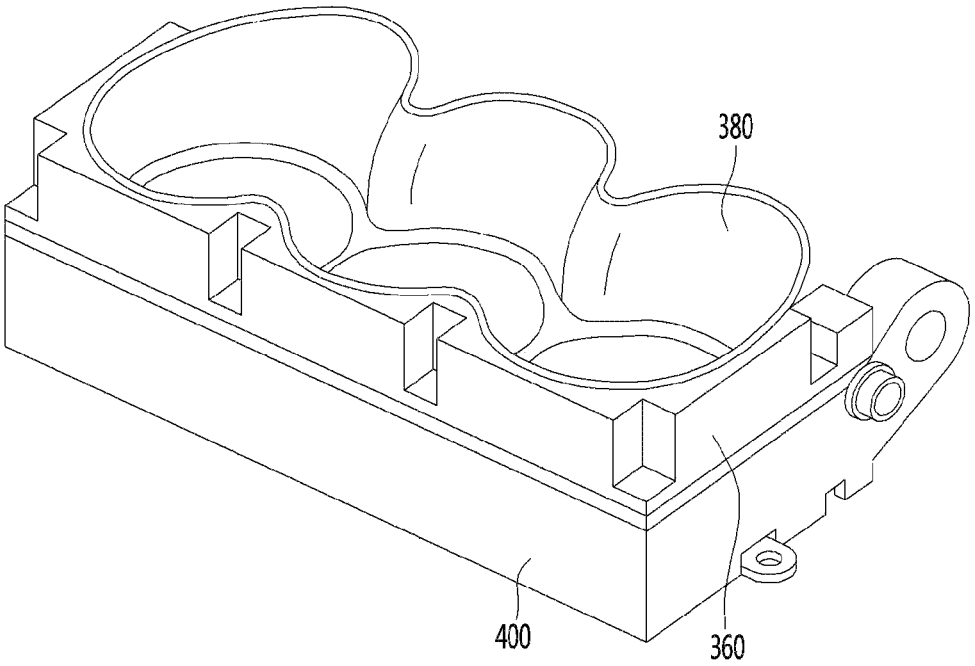

FIG. 9 is a view illustrating a state in which the second tray 380, the second tray cover 360, and the second tray supporter 400 are coupled.

With the second tray 380 interposed therebetween, the second tray cover 360 is disposed on the upper side of the second tray, and the second tray supporter 400 is disposed on the lower side of the second tray.

Each cell of the second tray 380 has a hemispherical shape to form a lower portion of the spherical ice.

Figure 10:
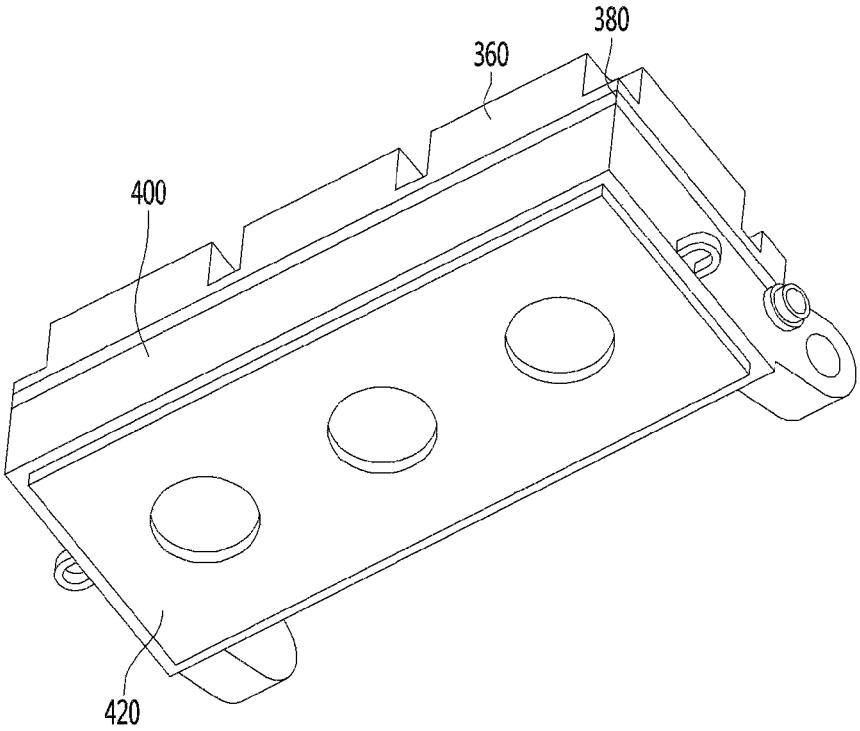

FIG. 10 is a view illustrating a state in which the second tray cover 360, the second tray 380, the second tray supporter 400, and the second heater case 420 are coupled.

The second heater case 420 may be disposed on a lower surface of the second tray case to fix a heater that supplies heat to the second tray 380.

Figure 11:
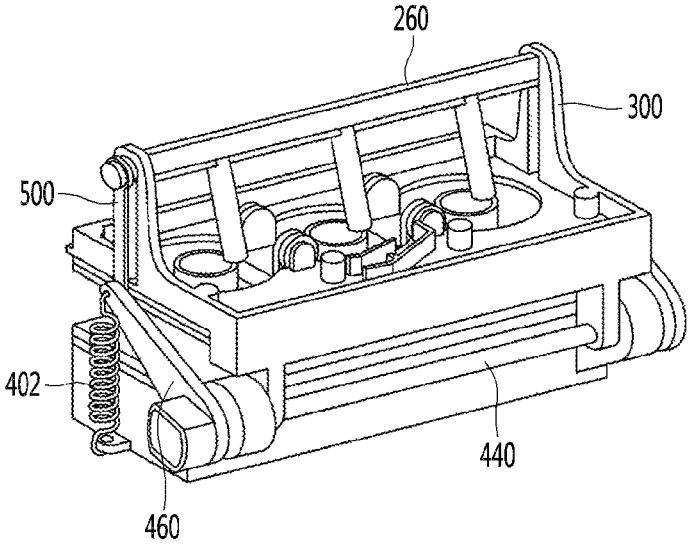

FIG. 11 is a view illustrating a state in which FIGS. 8 and 10 are combined, and the rotary arm 460, the shaft 440, and the pusher link 500 are combined.

One end of the rotation arm 460 is coupled to the shaft 440 and the other end thereof is coupled to the spring 402. One end of the pusher link 500 is coupled to the first pusher 260 and the other end thereof is disposed to be rotated with respect to the shaft 440.

Figure 12:
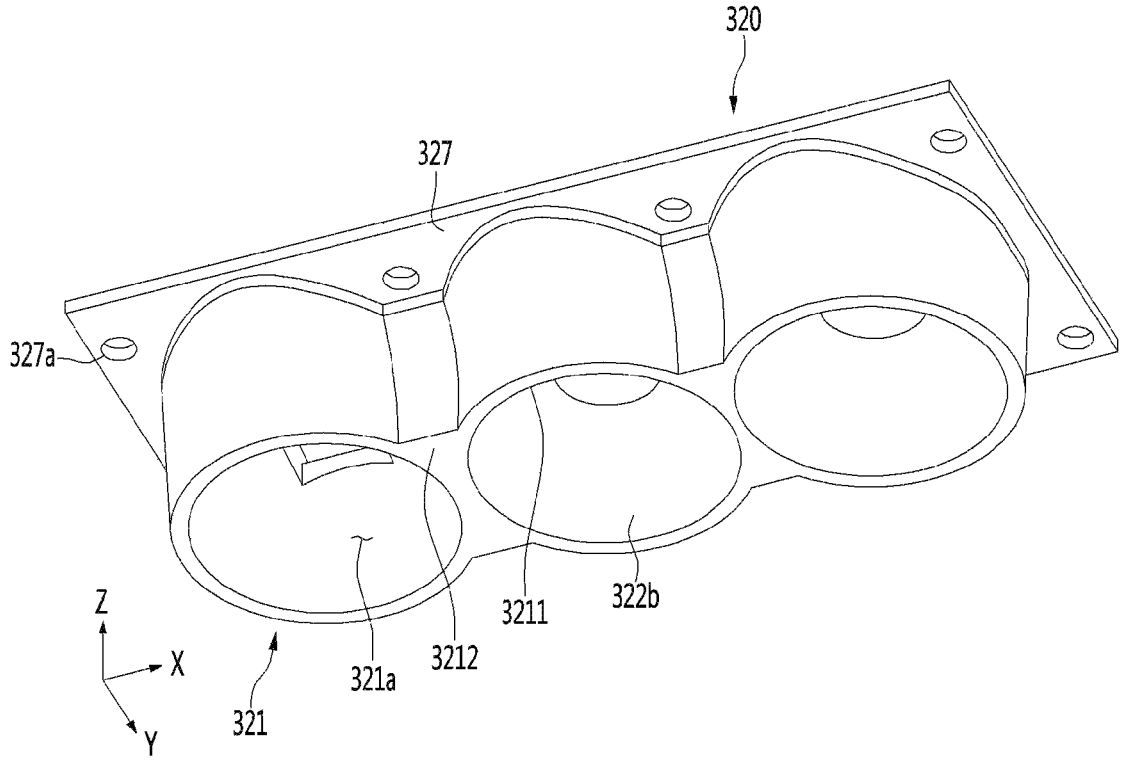
FIG. 12 is a perspective view of a first tray viewed from below according to an embodiment of the present disclosure.
Figure 13:
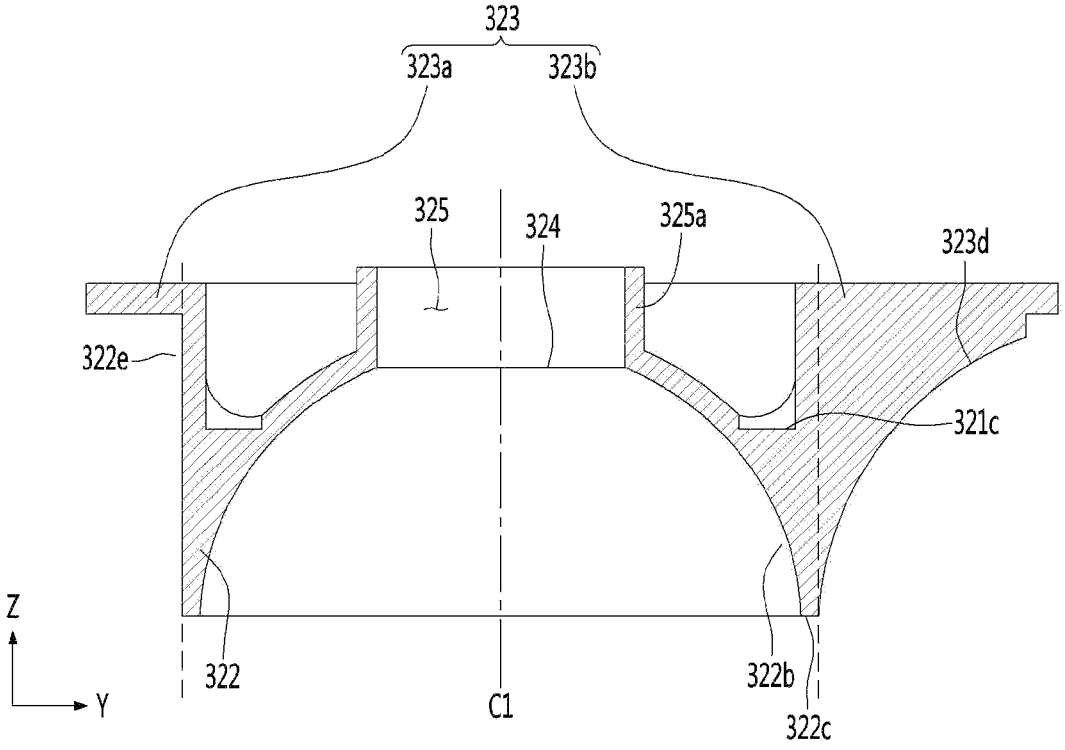
FIG. 13 is a cross-sectional view of a first tray according to an embodiment of the present disclosure.

FIG. 12 is a perspective view of a first tray viewed from below according to an embodiment of the present disclosure, and FIG. 13 is a cross-sectional view of a first tray according to an embodiment of the present disclosure.

Referring to FIGS. 12 and 13, the first tray 320 may define a first cell 321*a* that is a portion of the ice making cell 320*a*.

The first tray 320 may include a first tray wall 321 defining a portion of the ice making cell 320*a*.

For example, the first tray 320 may define a plurality of first cells 321*a*. For example, the plurality of first cells 321*a* may be arranged in a line. The plurality of first cells 321*a* may be arranged in an X-axis direction based on FIG. 12. For example, the first tray wall 321 may define the plurality of first cells 321*a*.

The first tray wall 321 may include a plurality of first cell walls 3211 that respectively define the plurality of first cells 321*a*, and a connection wall 3212 connecting the plurality of first cell walls 3211 to each other. The first tray wall 321 may be a wall extending in the vertical direction.

The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 324 may provide a passage through which a portion of the first pusher 260 passes. For example, in the ice separation process, a portion of the first pusher 260 may be inserted into the ice making cell 320*a* through the opening 234.

The first tray 320 may include a plurality of openings 324 corresponding to the plurality of first cells 321*a*. One of the plurality of openings 324 324*a* may provide a passage of the cold air, a passage of the water, and a passage of the first pusher 260. In the ice making process, the bubbles may escape through the opening 324.

The first tray 320 may further include an auxiliary storage chamber 325 communicating with the ice making cell 320*a*. For example, the auxiliary storage chamber 325 may store water overflowed from the ice making cell 320*a*. The ice expanded in a process of phase-changing the supplied water may be disposed in the auxiliary storage chamber 325. That is, the expanded ice may pass through the opening 304 and be disposed in the auxiliary storage chamber 325. The auxiliary storage chamber 325 may be defined by a storage chamber wall 325*a*. The storage chamber wall 325*a* may extend upwardly around the opening 324. The storage chamber wall 325*a* may have a cylindrical shape or a polygonal shape. Substantially, the first pusher 260 may pass through the opening 324 after passing through the storage chamber wall 325*a*. The storage chamber wall 325*a* may define the auxiliary storage chamber 325 and also reduce deformation of the periphery of the opening 324 in the process in which the first pusher 260 passes through the opening 324 during the ice separation process.

The first tray 320 may include a first contact surface 322*c* contacting the second tray 380.

The first tray 320 may further include a first extension wall 327 extending in the horizontal direction from the first tray wall 321. For example, the first extension wall 327 may extend in the horizontal direction around an upper end of the first extension wall 327. One or more first coupling holes 327*a* may be provided in the first extension wall 327. Although not limited, the plurality of first coupling holes 327*a* may be arranged in one or more axes of the X axis and the Y axis.

In this specification, the "central line" is a line passing through a volume center of the ice making cell 320*a* or a center of gravity of water or ice in the ice making cell 320*a* regardless of the axial direction.

Meanwhile, referring to FIG. 13, the first tray 320 may include a first portion 322 that defines a portion of the ice making cell 320*a*. For example, the first portion 322 may be a portion of the first tray wall 321.

The first portion 322 may include a first cell surface 322*b* (or an outer circumferential surface) defining the first cell 321*a*. The first portion 322 may include the opening 324. In addition, the first portion 322 may include a heater accommodation part 321*c*. An ice separation heater may be accommodated in the heater accommodation part 321*c*. The first portion 322 may be divided into a first region positioned close to the second heater 430 in a Z-axis direction and a second region positioned away from the second heater 430. The first region may include the first contact surface 322*c*, and the second region may include the opening 324. The first portion 322 may be defined as an area between two dotted lines in FIG. 13.

In a degree of deformation resistance from the center of the ice making cell 320*a* in the circumferential direction, at least a portion of the upper portion of the first portion 322 is greater than at least a portion of the lower portion. The degree of deformation resistance of at least a portion of the upper portion of the first portion 322 is greater than that of the lowermost end of the first portion 322.

The upper and lower portions of the first portion 322 may be divided based on the extension direction of the central line C1 (or a vertical center line) in the Z axis direction in the ice making cell 320*a*. The lowermost end of the first portion 322 is the first contact surface 322*c* contacting the second tray 380.

The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*. A portion of the second portion 323 may be defined by the first tray wall 321, and the other portion of the second portion 323 may be defined by the first extension wall 327. At least a portion of the second portion 323 may extend in a direction away from the transparent ice heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice making cell 320*a*. The uppermost end of the ice making cell 320*a* is a portion at which the opening 324 is defined.

The second portion 323 may include a first extension part 323*a* and a second extension part 323*b*, which extend in different directions with respect to the central line C1. The first tray wall 321 may include one portion of the second extension part 323*b* of each of the first portion 322 and the second portion 323. The first extension wall 327 may include the other portion of each of the first extension part 323*a* and the second extension part 323*b*.

Referring to FIG. 13, the first extension part 323*a* may be disposed at the left side with respect to the central line C1, and the second extension part 323*b* may be disposed at the right side with respect to the central line C1.

The first extension part 323*a* and the second extension part 323*b* may have different shapes based on the central line C1. The first extension part 323*a* and the second extension part 323*b* may be provided in an asymmetrical shape with respect to the central line C1.

A length of the second extension part 323*b* in the Y-axis direction may be greater than that of the first extension part 323*a*. Therefore, while the ice is made and grown from the upper side in the ice making process, the degree of deformation resistance of the second extension part 323*b* may increase.

The second extension part 323*b* may be disposed closer to the shaft 440 that provides a center of rotation of the second tray assembly than the first extension part 323*a*. In this embodiment, since the length of the second extension part 323*b* in the Y-axis direction is greater than that of the first extension part 323*a*, the second tray 380 contacting the first tray 320 may increase in radius of rotation. When the rotation radius of the second tray assembly increases, centrifugal force of the second tray may increase. Thus, in the ice separation process, separating force for separating the ice from the second tray may increase to improve ice separation performance.

The thickness of the first tray wall 321 is minimized at a side of the first contact surface 322*c*. At least a portion of the first tray wall 321 may increase in thickness from the first contact surface 322*c* toward the upper side. Since the thickness of the first tray wall 321 increases upward, a portion of the first portion 322 formed by the first tray wall 321 serves as a deformation resistance reinforcement part (or a first deformation resistance reinforcement part). In addition, the second portion 323 extending outward from the first portion 322 also serves as a deformation resistance reinforcement part (or a second deformation resistance reinforcement part).

The deformation resistance reinforcement parts may be directly or indirectly supported by the bracket 220. The deformation resistance reinforcement part may be connected to the first tray case and supported by the bracket 220 as an example. In this case, a portion of the first tray case in contact with the inner deformation reinforcement portion of the first tray 320 may also serve as an inner deformation reinforcement portion. Such a deformation resistance reinforcement part may cause ice to be generated from the first cell 321*a* formed by the first tray 320 in a direction of the second cell 381*a* formed by the second tray 380 during the ice making process.

Figure 14:
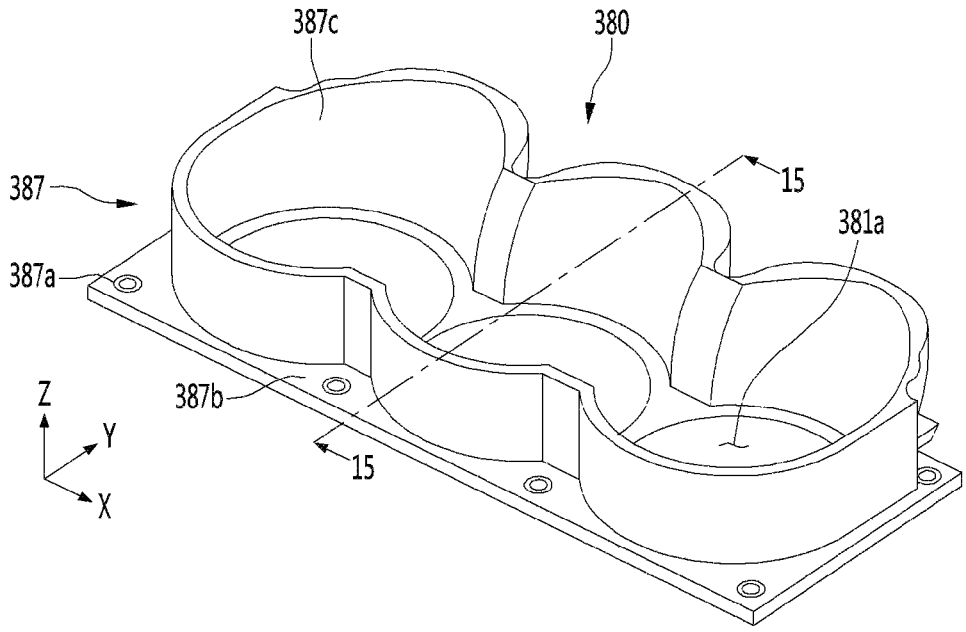
FIG. 14 is a perspective view of a second tray viewed from above according to an embodiment of the present disclosure.
Figure 15:
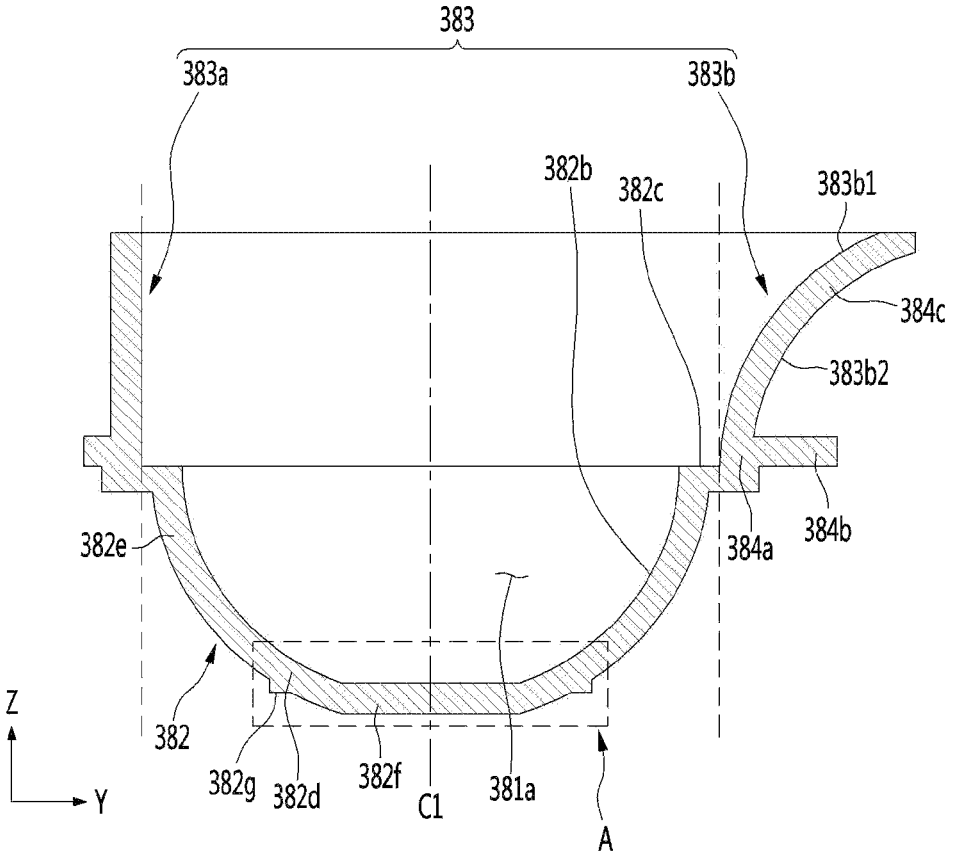
FIG. 15 is a cross-sectional view taken along line 15-15 of FIG. 14.

FIG. 14 is a perspective view of a second tray viewed from above according to an embodiment of the present disclosure, and FIG. 15 is a cross-sectional view taken along line 15-15 of FIG. 14.

Referring to FIGS. 14 and 1, the second tray 380 may define a second cell 381*a* which is another portion of the ice making cell 320*a*.

The second tray 380 may include a second tray wall 381 defining a portion of the ice making cell 320*a*.

For example, the second tray 380 may define a plurality of second cells 381*a*. For example, the plurality of second cells 381*a* may be arranged in a line. Referring to FIG. 14, the plurality of second cells 381*a* may be arranged in the X-axis direction. For example, the second tray wall 381 may define the plurality of second cells 381*a*.

The second tray 380 may include a circumferential wall 387 extending along a circumference of an upper end of the second tray wall 381. The circumferential wall 387 may be formed integrally with the second tray wall 381 and may extend from an upper end of the second tray wall 381. For another example, the circumferential wall 387 may be provided separately from the second tray wall 381 and disposed around the upper end of the second tray wall 381. In this case, the circumferential wall 387 may contact the second tray wall 381 or be spaced apart from the third tray wall 381. In any case, the circumferential wall 387 may surround at least a portion of the first tray 320. If the second tray 380 includes the circumferential wall 387, the second tray 380 may surround the first tray 320. When the second tray 380 and the circumferential wall 387 are provided separately from each other, the circumferential wall 387 may be integrally formed with the second tray case or may be coupled to the second tray case. For example, one second tray wall may define a plurality of second cells 381*a*, and one continuous circumferential wall 387 may surround the first tray 250.

The circumferential wall 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis.

The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice making cell 320*a* has a spherical shape, each of the first contact surface 322*c* and the second contact surface 382*c* may have a circular ring shape.

The second tray 380 may include a first portion 382 that defines at least a portion of the ice making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice making cell 320*a*. The first portion 382 may be defined as an area between two dotted lines in FIG. 8. The uppermost end of the first portion 382 is the second contact surface 382*c* contacting the first tray 320.

The second tray 380 may further include a second portion 383. The second portion 383 may reduce transfer of heat, which is transferred from the second heater 430 to the second tray 380, to the ice making cell 320*a* defined by the first tray 320. That is, the second portion 383 serves to allow the heat conduction path to move in a direction away from the first cell 321*a*. The second portion 383 may be a portion or the whole of the circumferential wall 387. The second portion 383 may extend from a predetermined point of the first portion 382. In the following description, for example, the second portion 383 is connected to the first portion 382.

The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driver 480 to rotate.

The second portion 383 may include a first part 384*a* extending from one point of the first portion 382. The second portion 383 may further include a second part 384*b* extending in the same direction as the extending direction with the first part 384*a*. Alternatively, the second portion 383 may further include a third part 384*b* extending in a direction different from the extending direction of the first part 384*a*. Alternatively, the second portion 383 may further include a second part 384*b* and a third part 384*c* branched from the first part 384*a*.

For example, the first part 384*a* may extend in the horizontal direction from the first part 382. A portion of the first part 384*a* may be disposed at a position higher than that of the second contact surface 382*c*. That is, the first part 384*a* may include a horizontally extension part and a vertically extension part. The first part 384*a* may further include a portion extending in the vertical direction from the predetermined point. For example, a length of the third part 384*c* may be greater than that of the second part 384*b*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*a* may have a constant curvature based on the Y-Z cutting surface. That is, the same curvature radius of the third part 384*a* may be constant in the longitudinal direction. The curvature of the second part 384*b* may be zero. When the second part 384*b* is not a straight line, the curvature of the second part 384*b* may be less than that of the third part 384*a*. The curvature radius of the second part 384*b* may be greater than that of the third part 384*a*.

At least a portion of the second portion 383 may be disposed at a position higher than or equal to that of the uppermost end of the ice making cell 320*a*. In this case, since the heat conduction path defined by the second portion 383 is long, the heat transfer to the ice making cell 320*a* may be reduced. A length of the second portion 383 may be greater than the radius of the ice making cell 320*a*. The second portion 383 may extend up to a point higher than the center of rotation of the shaft 440. For example, the second portion 383 may extend up to a point higher than the uppermost end of the shaft 440.

The second portion 383 may include a first extension part 383*a* extending from a first point of the first portion 382 and a second extension part 383*b* extending from a second point of the first portion 382 so that transfer of the heat of the second heater 430 to the ice making cell 320*a* defined by the first tray 320 is reduced. For example, the first extension part 383*a* and the second extension part 383*b* may extend in different directions with respect to the central line C1.

Referring to FIG. 15, the first extension part 383*a* may be disposed at the left side with respect to the central line C1, and the second extension part 383*b* may be disposed at the right side with respect to the central line C1. The first extension part 383*a* and the second extension part 383*b* may have different shapes based on the central line C1. The first extension part 383*a* and the second extension part 383*b* may be provided in an asymmetrical shape with respect to the central line C1. A length (horizontal length) of the second extension part 383*b* in the Y-axis direction may be longer than the length (horizontal length) of the first extension part 383*a*. The second extension part 383*b* may be disposed closer to the shaft 440 that provides a center of rotation of the second tray assembly than the first extension part 383*a*.

In this embodiment, a length of the second extension part 383*b* in the Y-axis direction may be greater than that of the first extension part 383*a*. In this case, the heat conduction path may increase while reducing the width of the bracket 220 relative to the space in which the ice maker 200 is installed.

Since the length of the second extension part 383*b* in the Y-axis direction is greater than that of the first extension part 383*a*, the second tray assembly including the second tray 380 contacting the first tray 320 may increase in radius of rotation. When the rotation radius of the second tray assembly increases centrifugal force of the second tray assembly may increase. Thus, in the ice separation process, separating force for separating the ice from the second tray assembly may increase to improve ice separation performance. The center of curvature of at least a portion of the second extension part 383*b* may be a center of curvature of the shaft 440 which is connected to the driver 480 to rotate.

A distance between an upper portion of the first extension part 383*a* and an upper portion of the second extension part 383*b* may be greater than that between a lower portion of the first extension part 383*a* and a lower portion of the second extension part 383*b* with respect to the Y-Z cutting surface passing through the central line C1. For example, a distance between the first extension part 383*a* and the second extension part 383*b* may increase upward. Each of the first extension part 383*a* and the third extension part 383*b* may include first to third parts 384*a*, 384*b*, and 384*c*. In another aspect, the third part 384*c* may also be described as including the first extension part 383*a* and the second extension part 383*b* extending in different directions with respect to the central line C1.

The first portion 382 may include a first region 382*d* (see region A in FIG. 15) and a second region 382*e* (remaining areas excluding region A). The curvature of at least a portion of the first region 382*d* may be different from that of at least a portion of the second region 382*e*. The first region 382*d* may include the lowermost end of the ice making cell 320*a*. The second region 382*e* may have a diameter greater than that of the first region 382*d*. The first region 382*d* and the second region 382*e* may be divided vertically. The second heater 430 may contact the first region 382*d*. The first region 382*d* may include a heater contact surface 382*g* contacting the second heater 430. The heater contact surface 382*g* may be, for example, a horizontal plane. The heater contact surface 382*g* may be disposed at a position higher than that of the lowermost end of the first portion 382. The second region 382*e* may include the second contact surface 382*c*. The first region 382*d* may have a shape recessed in a direction opposite to a direction in which ice is expanded in the ice making cell 320*a*.

A distance from the center of the ice making cell 320*a* to the second region 382*e* may be less than that from the center of the ice making cell 320*a* to the portion at which the shape recessed in the first area 382*d* is disposed.

For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*. The heater contact surface 382*g* may be disposed to surround the pressing unit 382*f*. The heater contact surface 382*g* may be disposed at a position higher than that of the lowermost end of the pressing part 382*f*.

At least a portion of the heater contact surface 382*g* may be disposed to surround the central line C1. Accordingly, at least a portion of the transparent ice heater 430 contacting the heater contact surface 382*g* may be disposed to surround the central line C1. Therefore, the transparent ice heater 430 may be prevented from interfering with the second pusher 540 while the second pusher 540 presses the pressing unit 382*f*. A distance from the center of the ice making cell 320*a* to the pressing part 382*f* may be different from that from the center of the ice making cell 320*a* to the second region 382*e*.

Figure 16:
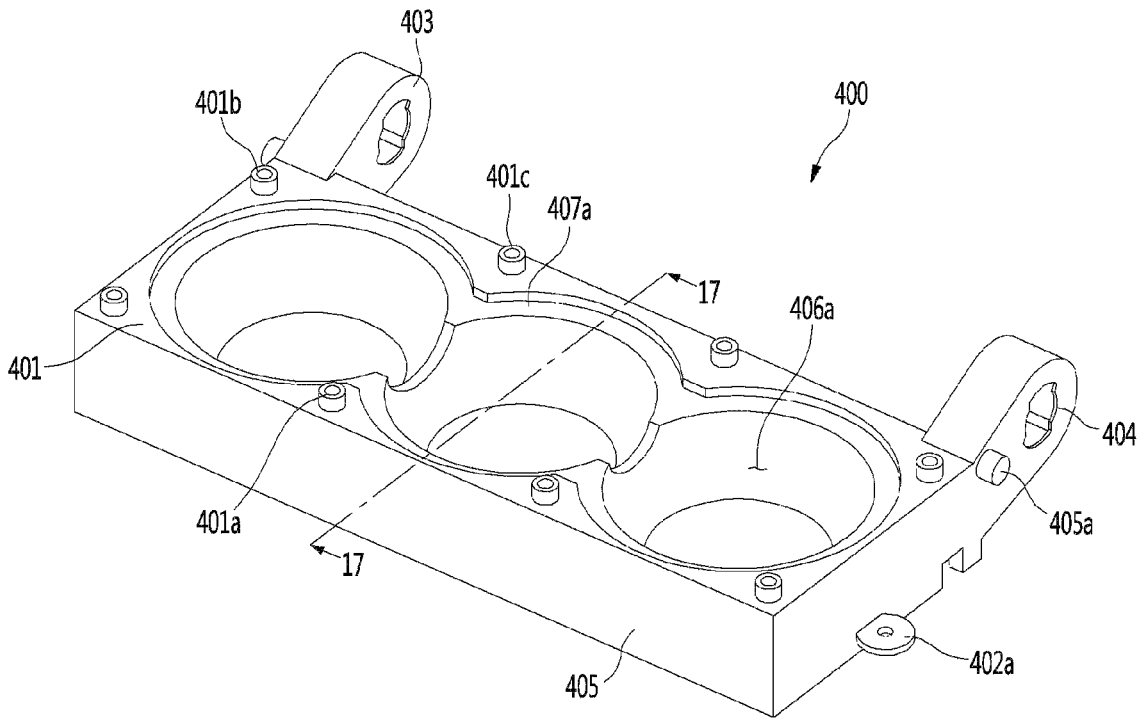
FIG. 16 is a top perspective view of a second tray supporter.
Figure 17:
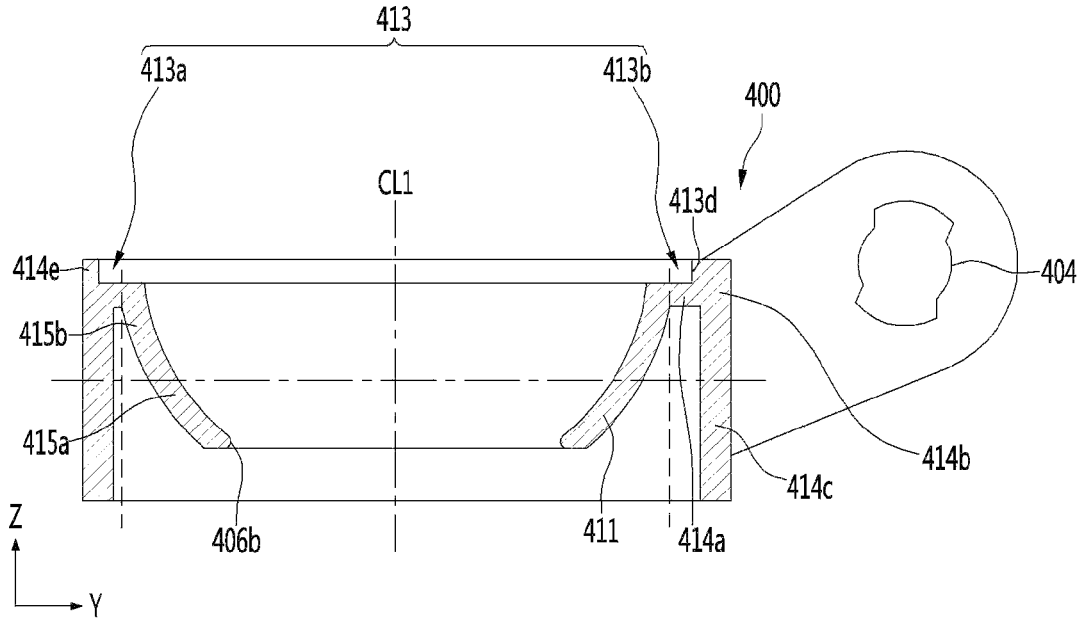
FIG. 17 is a cross-sectional view taken along line 17-17 of FIG. 16.

FIG. 16 is a top perspective view of a second tray supporter, and FIG. 17 is a cross-sectional view taken along line 17-17 of FIG. 16.

Referring to FIGS. 16 and 17, the second tray supporter 400 may include a support body 407 on which a lower portion of the second tray 380 is seated. The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*. A portion of the lower portion of the second tray 380 may be exposed by the lower opening 406*b*. At least a portion of the second tray 380 may be disposed in the lower opening 406*b*. A top surface 407*a* of the support body 407 may extend in the horizontal direction.

The second tray supporter 400 may include a lower plate 401 that is stepped with the top surface 407*a* of the support body 407. The lower plate 401 may be disposed at a position higher than that of the top surface 407*a* of the support body 407. The lower plate 401 may include a plurality of coupling parts 401*a*, 401*b*, and 401*c* to be coupled to the second tray cover 360. The second tray 380 may be inserted and coupled between the second tray cover 360 and the second tray supporter 400.

For example, the second tray 380 may be disposed below the second tray cover 360, and the second tray 380 may be accommodated above the second tray supporter 400.

The first extension wall 387*b* of the second tray 380 may be coupled to the coupling parts 361*a*, 361*b*, and 361*c* of the second tray cover 360 and the coupling parts 400*a*, 401*b*, and 401*c* of the second tray supporter 400.

The second tray supporter 400 may further include a vertical extension wall 405 extending vertically downward from an edge of the lower plate 401. One surface of the vertical extension wall 405 may be provided with a pair of extension parts 403 coupled to the shaft 440 to allow the second tray 380 to rotate. The pair of extension parts 403 may be spaced apart from each other in the X-axis direction. Also, each of the extension parts 403 may further include a through-hole 404. The shaft 440 may pass through the through-hole 404, and the extension part 281 of the first tray cover 300 may be disposed inside the pair of extension parts 403.

The second tray supporter 400 may further include a spring coupling part 402*a* to which a spring 402 is coupled. The spring coupling part 402*a* may provide a ring to be hooked with a lower end of the spring 402.

The second tray supporter 400 may further include a link connection part 405*a* to which the pusher link 500 is coupled. For example, the link connection part 405*a* may protrude from the vertical extension wall 405 in the X-axis direction.

Referring to FIG. 17, the second tray supporter 400 may include a first portion 411 supporting the second tray 380 defining at least a portion of the ice making cell 320*a*. In FIG. 17, the first portion 411 may be an area between two dotted lines. For example, the support body 407 may define the first portion 411.

The second tray supporter 400 may further include a second portion 413 extending from a predetermined point of the first portion 411. The second portion 413 may reduce transfer of heat, which is transfer from the second heater 430 to the second tray supporter 400, to the ice making cell 320*a* defined by the first tray 320. At least a portion of the second portion 413 may extend in a direction away from the first cell 321*a* defined by the first tray 320. The direction away from the first cell 321 may be a horizontal direction passing through the center of the ice making cell 320*a*. The direction away from the first cell 321 may be a downward direction with respect to a horizontal line passing through the center of the ice making cell 320*a*.

The second portion 413 may include a first part 414*a* extending in the horizontal direction from the predetermined point and a second part 414*b* extending in the same direction as the first part 414*a*.

The second portion 413 may include a first part 414*a* extending in the horizontal direction from the predetermined point, and a third part 414*c* extending in a direction different from that of the first part 414*a*.

The second portion 413 may include a first part 414*a* extending in the horizontal direction from the predetermined point, and a second part 414*b* and a third part 414*c*, which are branched from the first part 414*a*.

A top surface 407*a* of the support body 407 may provide, for example, the first part 414*a*. The first part 414*a* may further include a fourth part 414*d* extending in the vertical line direction. The lower plate 401 may provide, for example, the fourth part 414*d*. The vertical extension wall 405 may provide, for example, the third part 414*c*.

A length of the third part 414*c* may be greater than that of the second part 414*b*. The second part 414*b* may extend in the same direction as the first part 414*a*. The third part 414*c* may extend in a direction different from that of the first part 414*a*. The second portion 413 may be disposed at the same height as the lowermost end of the first cell 321*a* or extend up to a lower point. The second portion 413 may include a first extension part 413*a* and a second extension part 413*b* which are disposed opposite to each other with respect to the center line CL1 corresponding to the center line C1 of the ice making cell 320*a*.

Referring to FIG. 17, the first extension part 413*a* may be disposed at a left side with respect to the center line CL1, and the second extension part 413*b* may be disposed at a right side with respect to the center line CL1.

The first extension part 413*a* and the second extension part 413*b* may have different shapes with respect to the center line CL1. The first extension part 413*a* and the second extension part 413*b* may have shapes that are asymmetrical to each other with respect to the center line CL1.

A length of the second extension part 413*b* may be greater than that of the first extension part 413*a* in the horizontal direction. That is, a length of the thermal conductivity of the second extension 413*b* is greater than that of the first extension part 413*a*. The second extension part 413*b* may be disposed closer to the shaft 440 that provides a center of rotation of the second tray assembly than the first extension part 413*a*.

In this embodiment, since the length of the second extension part 413*b* in the Y-axis direction is greater than that of the first extension part 413*a*, the second tray assembly including the second tray 380 contacting the first tray 320 may increase in radius of rotation.

A center of curvature of at least a portion of the second extension part 413*a* may coincide with a center of rotation of the shaft 440 which is connected to the driver 480 to rotate.

The first extension part 413*a* may include a portion 414*e* extending upwardly with respect to the horizontal line. The portion 414*e* may surround, for example, a portion of the second tray 380.

In another aspect, the second tray supporter 400 may include a first region 415*a* including the lower opening 406*b* and a second region 415*b* having a shape corresponding to the ice making cell 320*a* to support the second tray 380. For example, the first region 415*a* and the second region 415*b* may be divided vertically. In FIG. 11, for example, the first region 415*a* and the second region 415*b* are divided by a dashed-dotted line. The first region 415*a* may support the second tray 380. The controller controls the ice maker to allow the second pusher 540 to move from a first point outside the ice making cell 320*a* to a second point inside the second tray supporter 400 via the lower opening 406*b*. A degree of deformation resistance of the second tray supporter 400 may be greater than that of the second tray 380. A degree of restoration of the second tray supporter 400 may be less than that of the second tray 380.

In another aspect, the second tray supporter 400 includes a first region 415*a* including a lower opening 406*b* and a second region 415*b* disposed farther from the second heater 430 than the first region 415*a*.

Figure 19:
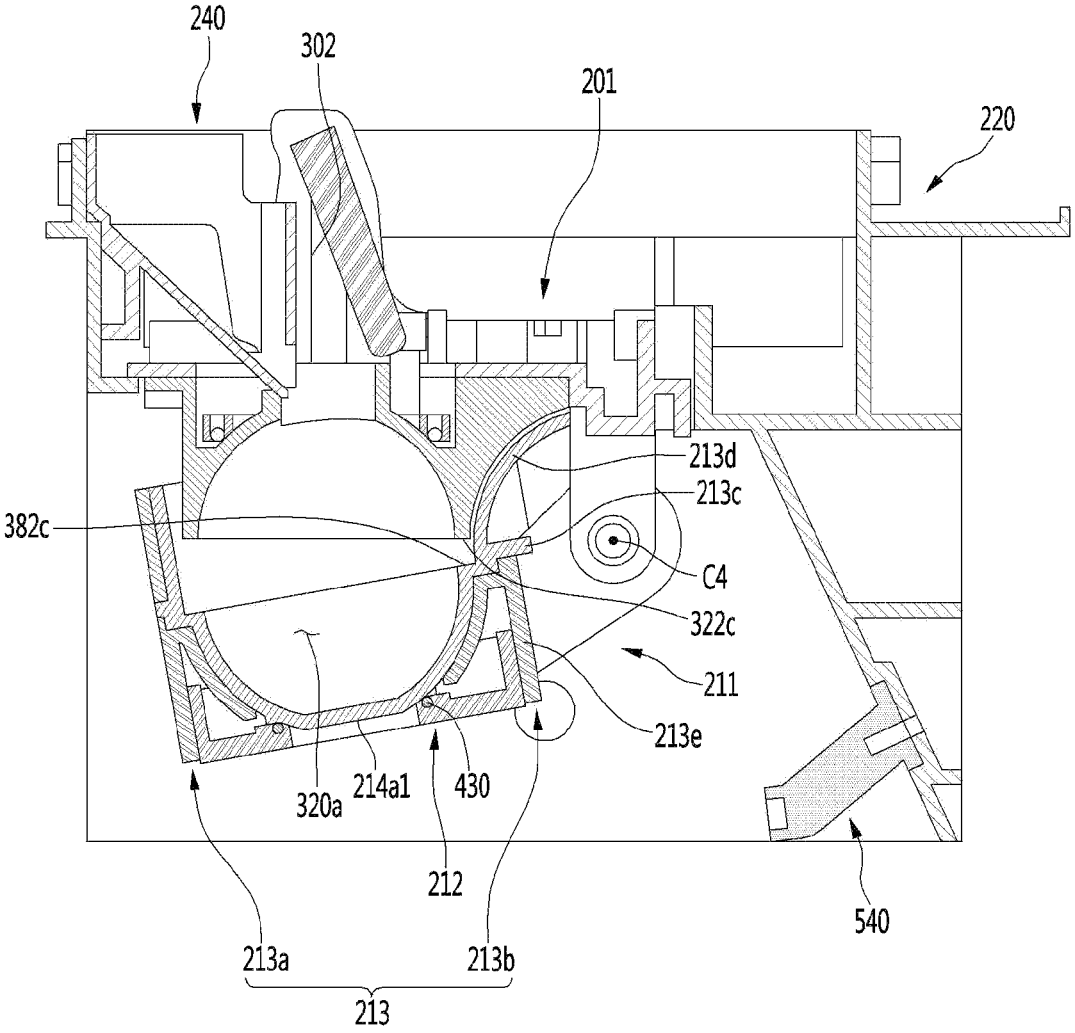
FIG. 19 is a view illustrating a state in which the second tray is moved to the water supply position in FIG. 18.

FIG. 18 is a cross-sectional view taken along line 18-18 of FIG. 3(*a*), and FIG. 19 is a view illustrating a state in which the second tray is moved to the water supply position in FIG. 18.

Referring to FIGS. 18 and 19, the ice maker 200 may include a first tray assembly 201 and a second tray assembly 211, which are connected to each other.

The first tray assembly 201 may include a first portion forming at least a portion of the ice making cell 320*a* and a second portion connected from the first portion to a predetermined point.

The first portion of the first tray assembly 201 may include a first portion 322 of the first tray 320, and the second portion of the first tray assembly 201 may include a second portion 322 of the first tray 320. Accordingly, the first tray assembly 201 includes the deformation resistance reinforcement parts of the first tray 320.

The first tray assembly 201 may include a first region and a second region positioned further from the second heater 430 than the first region. The first region of the first tray assembly 201 may include a first region of the first tray 320, and the second region of the first tray assembly 201 may include a second region of the first tray 320.

The second tray assembly 211 may include a first portion 212 defining at least a portion of the ice making cell 320*a* and a second portion 213 extending from a predetermined point of the first portion 212. The second portion 213 may reduce transfer of heat from the second heater 430 to the ice making cell 320*a* defined by the first tray assembly 201. The first portion 212 may be an area disposed between two dotted lines in FIG. 12.

The predetermined point of the first portion 212 may be an end of the first portion 212 or a point at which the first tray assembly 201 and the second tray assembly 211 meet each other. At least a portion of the first portion 212 may extend in a direction away from the ice making cell 320*a* defined by the first tray assembly 201. At least two portions of the second portion 213 may be branched to reduce heat transfer in the direction extending to the second portion 213. A portion of the second portion 213 may extend in the horizontal direction passing through the center of the ice making cell 320*a*. A portion of the second portion 213 may extend in an upward direction with respect to a horizontal line passing through the center of the ice making chamber 320*a*.

The second portion 213 includes a first part 213*c* extending in the horizontal direction passing through the center of the ice making cell 320*a*, a second part 213*d* extending upward with respect to the horizontal line passing through the center of the ice making cell 320*a*, a third part 213*e* extending downward.

The first portion 212 may have different degree of heat transfer in a direction along the outer circumferential surface of the ice making cell 320*a* to reduce transfer of heat, which is transferred from the second heater 430 to the second tray assembly 211, to the ice making cell 320*a* defined by the first tray assembly 201. The second heater 430 may be disposed to heat both sides of the first portion 212 with respect to the lowermost end of the first portion 212.

The first portion 212 may include a first region 214*a* and a second region 214*b*. In FIG. 18, the first region 214*a* and the second region 214*b* are divided by a dashed-dotted line. The second region 214*b* may be a region defined above the first region 214*a*. The degree of heat transfer of the second region 214*b* may be greater than that of the first region 214*a*.

The first region 214*a* may include a portion at which the second heater 430 is disposed. That is, the first region 214*a* may include the second heater 430.

The lowermost end 214*a*1 of the ice making cell 320*a* in the first region 214*a* may have a heat transfer rate less than that of the other portion of the first region 214*a*. The distance from the center of the ice making cell 320*a* to the outer circumferential surface is greater in the second region 214*b* than in the first region 214*a*.

The second region 214*b* may include a portion in which the first tray assembly 201 and the second tray assembly 211 contact each other. The first region 214*a* may provide a portion of the ice making cell 320*a*. The second region 214*b* may provide the other portion of the ice making cell 320*a*. The second region 214*b* may be disposed farther from the second heater 430 than the first region 214*a*.

Part of the first region 214*a* may have the degree of heat transfer less than that of the other part of the first region 214*a* to reduce transfer of heat, which is transferred from the second heater 430 to the first region 314*a*, to the ice making cell 320*a* defined by the second region 214*b*.

To make ice in the direction from the ice making cell 320*a* defined by the first region 214*a* to the ice making cell 320*a* defined by the second region 214*b*, a portion of the first region 214*a* may have a degree of deformation resistance less than that of the other portion of the first region 214*a* and a degree of restoration greater than that of the other portion of the first region 214*a*.

A portion of the first region 214*a* may be thinner than the other portion of the first region 214*a* in the thickness direction from the center of the ice making cell 320*a* to the outer circumferential surface direction of the ice making cell 320*a*.

For example, the first region 214*a* may include a second tray case surrounding at least a portion of the second tray 380 and at least a portion of the second tray 380. For example, the first region 214*a* may include the pressing part 382*f* of the second tray 380. The rotation center C4 may be disposed closer to the second pusher 540 than to the ice making cell 320*a*. The second portion 213 may include a first extension part 213*a* and a second extension part 323*b*, which are disposed at sides opposite to each other with respect to the central line C1.

Figure 41:
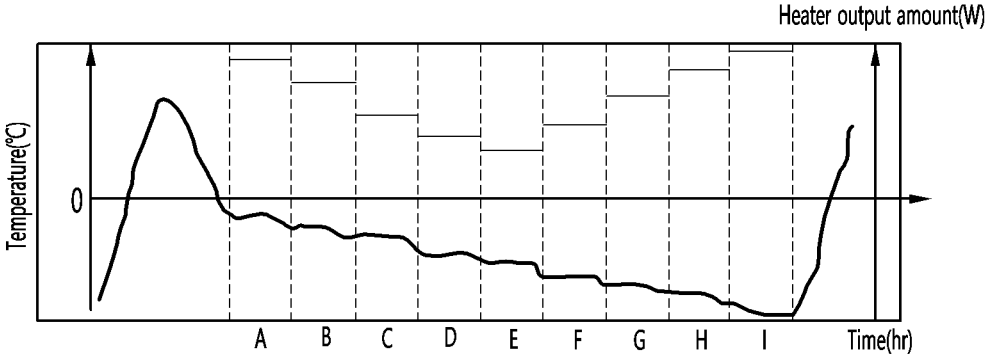
FIG. 41 is a graph illustrating a temperature sensed by a temperature sensor and an output amount of a second heater during a water supply and ice making process.

The first extension part 213*a* may be disposed at a left side of the center line C1 in FIG. 18, and the second extension part 213*b* may be disposed at a right side of the center line C1 in FIG. 41. The water supply part 240 may be disposed close to the first extension part 213*a*. The first tray assembly 301 may include a pair of guide slots 302, and the water supply part 240 may be disposed in a region between the pair of guide slots 302.

The ice maker 200 according to this embodiment may be designed such that the position of the second tray 380 is different from a water supply position and an ice making position. In FIG. 19, as an example, a water supply position of the second tray 380 is illustrated. For example, in the water supply position as illustrated in FIG. 19, at least a portion of the first contact surface 322*c* of the first tray 320 and the second contact surface 382*c* of the second tray 380 may be spaced apart. In FIG. 19, for example, it is illustrated that all of the first contact surfaces 322*c* are spaced apart from all of the second contact surfaces 382*c*. Accordingly, in the water supply position, the first contact surface 322*c* may be inclined to form a predetermined angle with the second contact surface 382*c*.

Although not limited, in the water supply position, the first contact surface 322*c* may be substantially horizontal, and the second contact surface 382*c* may be disposed to be inclined below the first tray 320 with respect to the first contact surface 322*c*.

Meanwhile, in the ice making position (see FIG. 18), the second contact surface 382*c* may contact at least a portion of the first contact surface 322*c*. The angle formed between the second contact surface 382*c* of the second tray 380 and the first contact surface 322*c* of the first tray 320 at the ice making position is smaller than the angle formed between the second contact surface 382*c* of the second tray 380 and the first contact surface 322*c* of the first tray 320 at the water supply position.

In the ice making position, all of the first contact surface 322*c* may contact the second contact surface 382*c*. In the ice making position, the second contact surface 382*c* and the first contact surface 322*c* may be disposed to be substantially horizontal.

In this embodiment, the reason why the water supply position and the ice making position of the second tray 380 are different is that in a case in which the ice maker 200 includes a plurality of ice making cells 320*a*, water is to be uniformly distributed to the plurality of ice making cells 320*a* without forming water passage for communication between respective ice making cells 320*a* in the first tray 320 and/or the second tray 380.

If the ice maker 200 includes the plurality of ice making cells 320*a*, when a water passage is formed in the first tray 320 and/or the second tray 380, the water supplied to the ice maker 200 is distributed to the plurality of ice making cells 320*a* along the water passage. However, in a state in which the water is distributed to the plurality of ice making cells 320*a*, water exists in the water passage, and when ice is generated in this state, ice generated in the ice making cell 320*a* is connected by ice generated in the water passage portion. In this case, there is a possibility that the ice will be attached to each other even after the ice separation is completed, and even if the ice is separated from each other, some of the plurality of ice contain ice generated in the water passage portion, so there is a problem that the shape of the ice is different from the shape of the ice making cell.

However, as in the present embodiment, in a case in which the second tray 380 is spaced apart from the first tray 320 at the water supply position, the water dropped to the second tray 380 may be uniformly distributed to the plurality of second cells 381*a* of the second tray 380.

The water supply part 240 may supply water to one of the plurality of openings 324. In this case, the water supplied through the one opening 324 drops into the second tray 380 after passing through the first tray 320. During the water supply process, water may drop into any one second cell 381*a* of the plurality of second cells 381*a* of the second tray 380. Water supplied to one second cell 381*a* overflows from one second cell 381*a*.

In the present embodiment, since the second contact surface 382*c* of the second tray 380 is spaced apart from the first contact surface 322*c* of the first tray 320, the water overflowing from the second cell 381*a* moves to another adjacent second cell 381*a* along the second contact surface 382*c* of the second tray 380. Accordingly, the plurality of second cells 381*a* of the second tray 380 may be filled with water.

In addition, in a state in which the water supply is completed, a portion of the water supplied is filled in the second cell 381*a*, and another part of the water supplied may be filled in the space between the first tray 320 and the second tray 380. When the second tray 380 moves from the water supply position to the ice making position, water in the space between the first tray 320 and the second tray 380 may be uniformly distributed to the plurality of first cells 321*a*.

Meanwhile, when a water passage is formed in the first tray 320 and/or the second tray 380, ice generated in the ice making cell 320*a* is also generated in the water pas sage portion.

In this case, in order to generate transparent ice, if the controller of the refrigerator controls one or more of the cooling power of the cooler and the heating amount of the second heater 430 to be varied according to the mass per unit height of water in the ice making cell 320*a*, in the portion in which the water passage is formed, one or more of the cooling power of the cooler and the heating amount of the second heater 430 is controlled to rapidly vary several times or more.

This is because the mass per unit height of water is rapidly increased several times or more in the portion where the water passage is formed. In this case, reliability problems of parts may occur, and expensive parts with large widths of the maximum and minimum outputs can be used, which may be disadvantageous in terms of power consumption and cost of the parts. As a result, the present disclosure may require a technique related to the above-described ice making position to generate transparent ice.

Figure 20:
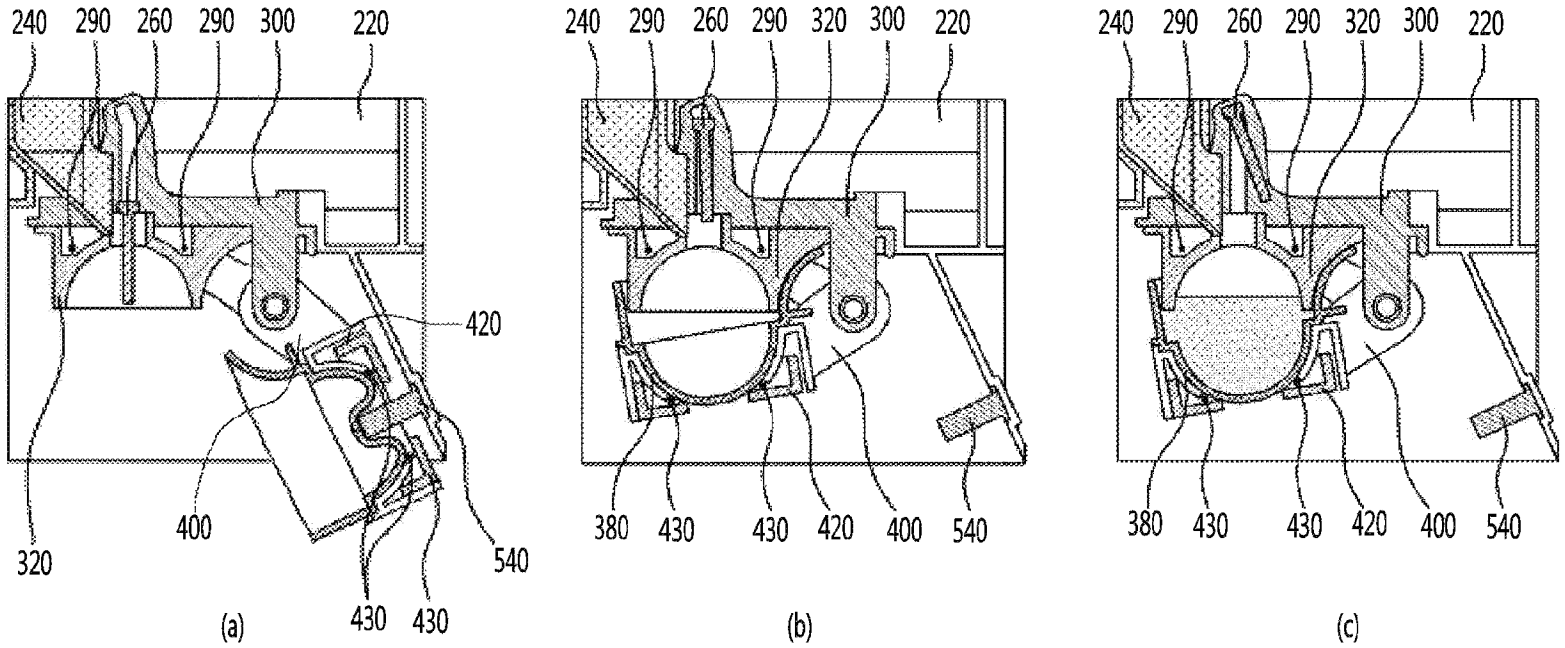
FIGS. 20(*a*)-c) and 21(*a*)-(*b*) are views for explaining a process of supplying water to the ice maker.

FIGS. 20(*a*)-(*d*) and 21(*a*)-(*b*) are views for explaining a process of supplying water to the ice maker.

Figure 21:
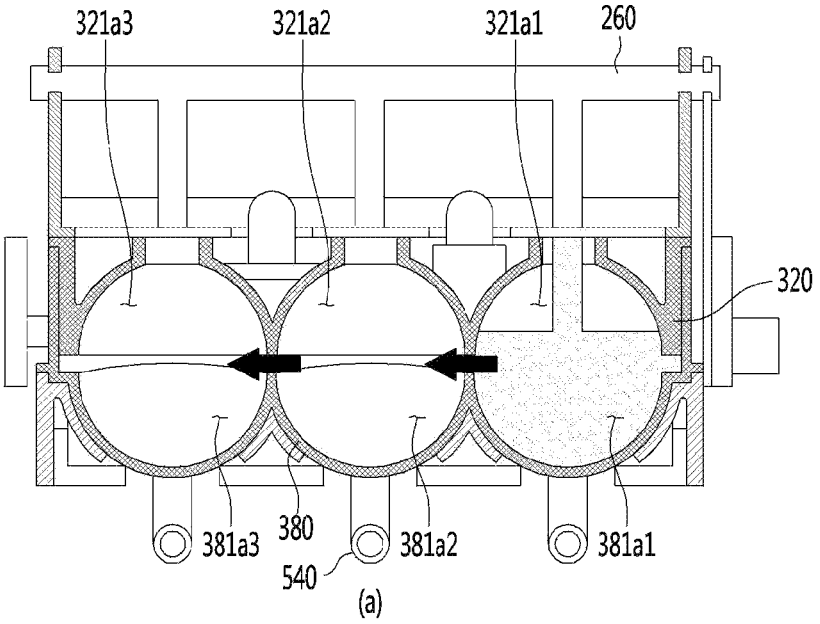
Figure 21:
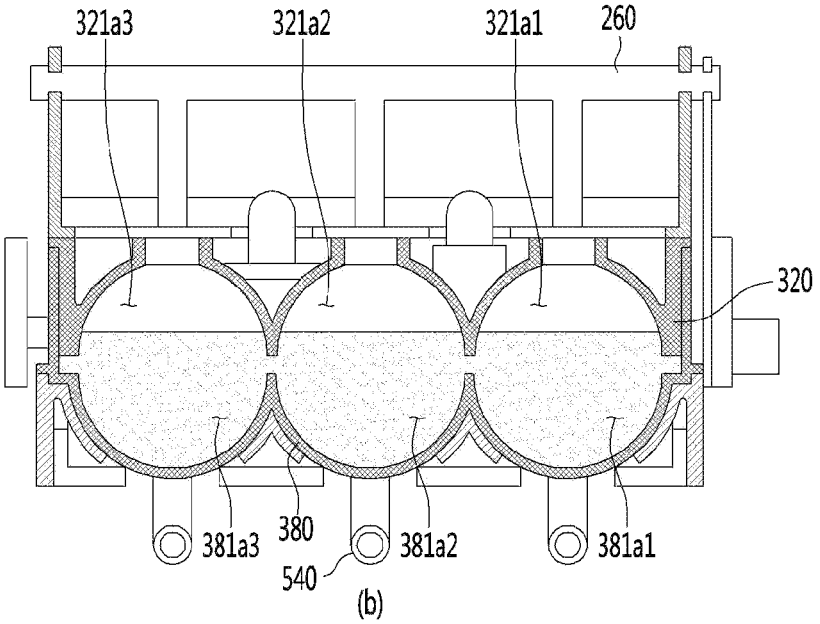

FIG. 20(*a*)-(*d*) is a view illustrating a process of supplying water while viewing the ice maker from the side, and FIG. 21(*a*)-(*b*) is a view illustrating a process of supplying water while viewing the ice maker from the front.

As illustrated in FIG. 20(*a*), the first tray 320 and the second tray 380 are disposed in a state of being separated from each other, and then, as illustrated in FIG. 20(*b*), the second tray 380 is rotated in the reverse direction toward the tray 320. At this time, although a part of the first tray 320 and the second tray 380 overlap, the first tray 320 and the second tray 380 are completely engaged so that the inner space thereof does not form a spherical shape.

As illustrated in FIG. 20(*c*), water is supplied into the tray through the water supply part 240. Since the first tray 320 and the second tray 380 are not fully engaged, some of the water passes out of the first tray 320. However, since the second tray 380 includes a peripheral wall formed to surround the upper side of the first tray 320 to be spaced apart, water does not overflow from the second tray 380.

FIG. 21 is a view for specifically explaining FIG. 20(*c*), wherein the state changes in the order of FIG. 21(*a*) and FIG. 21(*b*).

As illustrated in FIG. 20(*c*), when water is supplied to the first tray 320 and the second tray 380 through the water supply part 240, the water supply part 240 is disposed to be biased toward one side of the tray.

That is, the first tray 320 is provided with a plurality of cells 321*a*1, 321*a*2, 321*a*3 for generating a plurality of independent ices. The second tray 380 is also provided with a plurality of cells 381*a*1, 381*a*2, 381*a*3 for generating a plurality of independent ices. As the cells disposed in the first tray 320 and the cells disposed in the second tray 380 are combined, one spherical ice may be generated.

In FIG. 21, the first tray 320 and the second tray 380 do not completely contact as in FIG. 20(*c*) and the front sides of the first tray and the second tray are separated from each other, so that the water in each cell can move between the cells.

As illustrated in FIG. 21(*a*), when water is supplied to the upper side of the cells 321*a*1 and 381*a*1 positioned on one side, the water moves into the inside of the cells 321*a*1 and 381*a*1. At this time, when water overflows from the lower cell 381*a*1, water may be moved to the adjacent cells 321*a*2 and 381*a*2. Since the plurality of cells are not completely isolated from each other, when the water level in the cell rises above a certain level, each cell can be filled with the water while the water moves to the surrounding cells.

In a case in which predetermined water is supplied from a water supply valve disposed in a water supply pipe provided outside the ice maker 200, a flow path may be closed so that water is no longer supplied to the ice maker 200.

Figure 22:
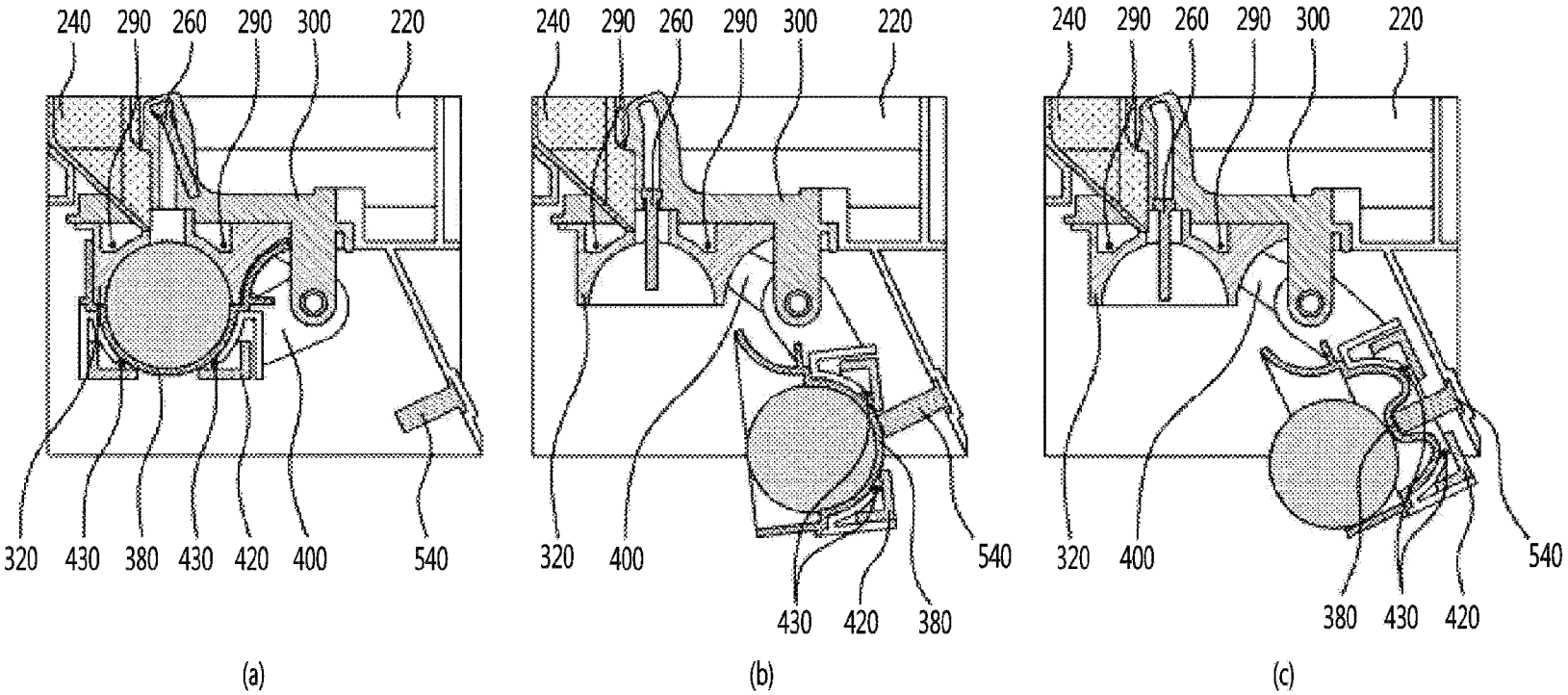
FIG. 22(*a*)-(*c*) is a view for explaining a process of ice being separated from an ice maker.

FIG. 22(*a*)-(*c*) is a diagram illustrating a process of ice being separated in an ice maker.

Referring to FIG. 22, when the second tray 380 is further rotated in the reverse direction in FIG. 20(*c*), as illustrated in FIG. 21(*a*), the first tray 320 may be disposed so as to form a spherical shape together with the second tray 380 and the cell. The second tray 380 and the first tray 320 are completely combined to each other and disposed so that water may be separated in each cell.

When cold air is supplied for a predetermined time in the state of FIG. 22(*a*), ice is generated in the ice making cell of the tray. While the water is changed to ice by cold air, the first tray 320 and the second tray 380 are engaged with each other as illustrated in FIG. 22(*a*) to maintain a state in which water does not move.

When ice is generated in the ice making cell of the tray, as illustrated in FIG. 22(*b*), in a state in which the first tray 320 is stopped, the second tray 380 is rotated in the forward direction.

At this time, since the ice has own weight thereof, the ice may drop from the first tray 320. Since the first pusher 260 presses the ice while descending, it is possible to prevent ice from being attached to the first tray 320.

Since the second tray 380 supports the lower portion of the ice, even if the second tray 380 is moved in the forward direction, the state in which the ice is mounted on the second tray 380 is maintained. As illustrated in FIG. 22(*b*), even in a state in which the second tray 380 is rotated to exceed a vertical angle, there may be a case where ice is attached to the second tray 380.

Therefore, in this embodiment, the second pusher 540 deforms the pressing part of the second tray 380, and as the second tray 380 is deformed, the attachment force between the ice and the second tray 380 is weakened and thus ice may fall from the second tray 380.

After the ice has fallen from the second tray 380, although not illustrated in FIG. 22, the ice may fall into the ice bin 600.

Figure 23:
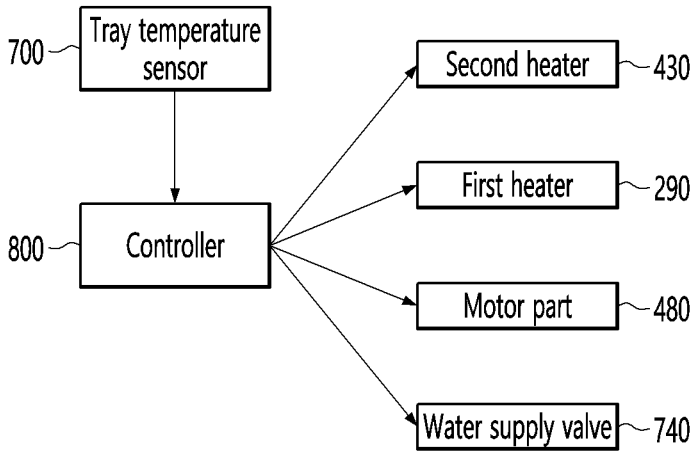
FIG. 23 is a control block diagram according to an embodiment.

FIG. 23 is a control block diagram according to an embodiment.

Referring to FIG. 23, in an embodiment of the present disclosure, a tray temperature sensor 700 for measuring the temperature of the first tray 320 or the second tray 380 is provided.

The temperature measured by the tray temperature sensor 700 is transmitted to the controller 800.

The controller 800 may control the driver 480 (or the motor part) to rotate the motor in the driver 480.

The controller 800 may control a water supply valve 740 that opens and closes a flow path of water supplied to the ice maker 200 so that water is supplied to the ice maker 200 or the supply of water to the ice maker is stopped.

When the driver 480 is operated, the second tray 380 or the full ice detection lever 520 may be rotated.

A second heater 430 may be installed in the second heater case 420. The second heater 430 may supply heat to the second tray 380. Since the second heater 430 is disposed under the second tray 380, it may be referred to as a lower heater.

A second heater 290 may be provided in the first heater case 280. The first heater 290 may supply heat to the first tray 320. Since the first heater 290 is disposed above the second heater 430, the first heater 290 may be referred to as an upper heater.

Power is supplied to the first heater 290 and the second heater 430 according to a command of the controller 800 to generate heat.

Figure 24:
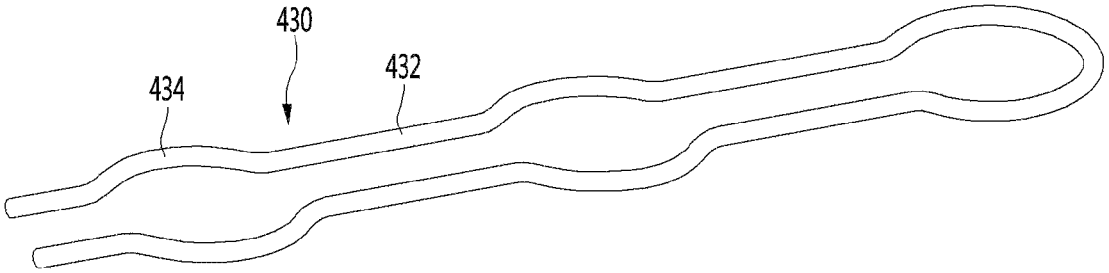
FIG. 24 is a view for explaining an example of a heater applied to an embodiment.

FIG. 24 is a view for explaining an example of a heater applied to an embodiment.

The second heater 430 illustrated in FIG. 24 is installed in the second heater case 420. The second heater 430 may be installed on the upper surface of the second heater case 420. The second heater 430 may be exposed above the second heater case 420.

Of course, the second heater 430 may be installed to be embedded in the second heater case 420.

The second heater 430 may include a straight part 432 and a curved part 434. Both the straight part 432 and the curved part 434 are formed of elements capable of generating heat. When a current flows through the straight part 432 and the curved part 434, heat may be entirely generated by resistance.

The straight part 432 means a portion extending in a linear direction. The curved part 434 may have a trajectory of a generally semicircular arc in the form of opening outward and then closing inward. The second heater 430 may be formed in the form of a single line and may have a shape in which the straight part 432 and the curved part 434 are alternately disposed to form a symmetrical shape to each other.

In the second heater 430, the curved part 434 may be disposed at a position where each cell of the second tray 380 is disposed. Since the cell has a hemispherical shape and the flat cross section is circular, the two curved parts 434 facing each other are disposed to form a portion of a circular arc.

The second heater 430 may have an approximately circular cross section.

In FIG. 24, only the second heater 430 has been described, but the above description applies equally to the first heater 290. That is, the first heater 290 may also be provided with a curved part and a straight part alternately like the second heater 430. However, unlike the second heater 430, the first heater 290 is installed in the first heater case 280 and is disposed above the tray.

Figure 25:
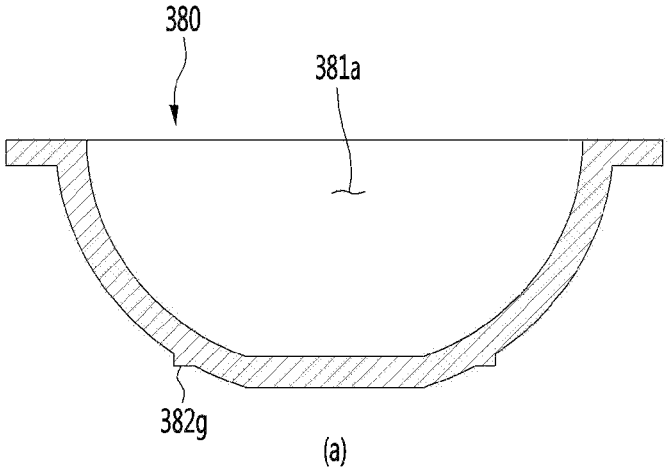
FIG. 25(*a*)-(*b*) is a view for explaining a second tray.
Figure 25:
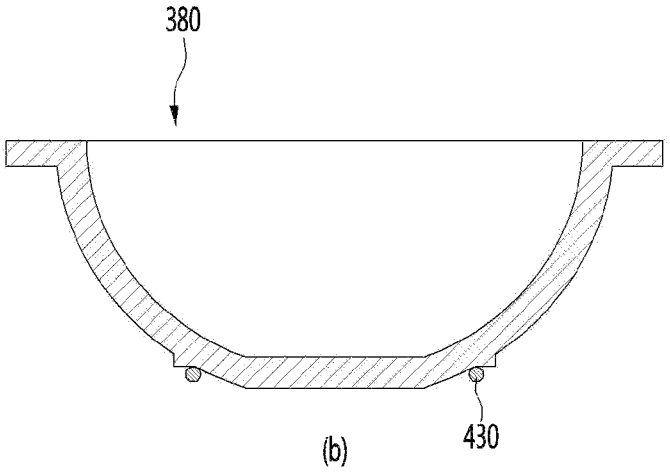

FIG. 25(*a*)-(*b*) is a view schematically illustrating a state in which the second heater contacts the second tray.

In FIG. 25, a cross-sectional view of one cell among the plurality of cells 381*a* of the second tray 380 is illustrated. The cells of the second tray 380 may have a substantially hemispherical shape, so that when the cells are filled with water and water is turned into ice, the hemispherical shape may be maintained by the second tray 380. The upper hemispherical shape is implemented by the first tray 320.

A heater contact part 382*g* is provided on the outer surface of each cell of the second tray 380. The heater contact part 382*g* may form a surface to which the second heater 430 can contact, as illustrated in FIG. 25(*b*).

The heater contact part 382*g* forms a flat surface, so that the second heater 430 may stably contact. In addition, since the second heater 430 includes a curved part of an approximately circular shape, the heater contact part 382*g* is disposed so that a certain portion overlaps by the second heater 430, so that the second heater 430 can compress the heater contact part 382*g*. Since the second heater 430 is installed in a compressed manner, the second tray 380 may remain in contact with the second heater 430 even if a tolerance occurs during assembly and mass production.

Figure 26:
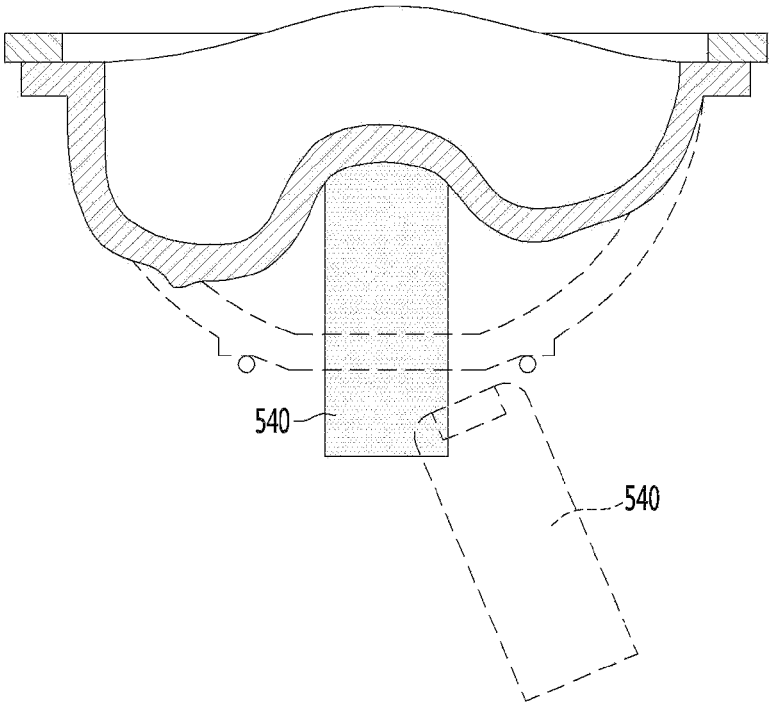
FIG. 26 is a view for explaining the operation of the second tray and the heater.

FIG. 26 is a view for explaining the operation of the second tray and the heater.

Referring to FIG. 26, a portion indicated by a dotted line indicates a state before the second pusher 540 presses the second tray 380, and a portion indicated by a solid line indicates a state in which the second pusher 540 presses the second tray 380.

Since the second heater 430 contacts the second tray 380 but is not fixed to be attached, regardless of a state in which the second pusher 540 presses or does not press the second tray 380, the second heater is placed in the same location.

The second heater 430 is fixed to the second heater case 420, and in FIG. 26, the second heater case 420 is omitted for convenience of description.

The second tray 380 may be made of a silicon material. When an external force is applied, the second tray 380 may be deformed around a portion to which the force is applied. Therefore, in a case in which ice is frozen in the cell of the second tray 380, when the second pusher 540 deforms the second tray 380, the ice may be separated from the second tray 380.

Specifically, the second heater 430 is compressed to the second tray 380 and maintains a state of being in contact with the second tray 380. Then, in order to separate the ice frozen in the second tray 380 from the second tray 380, the second pusher 540 may press the second tray 380. As the second tray 380 is deformed, the second heater 430 falls from the second tray 380 without contacting. This is because the second heater 430 is not integrally attached to the second tray 380. Therefore, compared to the method in which the second heater 430 is attached to the second tray 380, even if the second tray 380 is deformed to separate ice from the second tray 420, it is possible to prevent damage such as disconnection of the second heater 430 from occurring.

The present embodiment can be applied equally to a tray capable of generating spherical ice, as well as an ice maker generating square-shaped ice. That is, in addition to the form in which the upper side and the second tray are provided together in the ice maker, it is possible to equally apply the concept described above to the ice maker provided with only the second tray. In this embodiment, when the heater applies heat to the tray, that is, when ice is generated, the heater and the tray come into contact with each other. On the other hand, when ice is separated from the tray, that is, when ice is separated, since the heater and the tray can be separated, even if the shape of the tray is deformed, the heater is not damaged.

In the present embodiment, a brief description will be given of a process in which ice is finally made after water is supplied to the ice maker and ice is made.

As illustrated in FIG. 20(*b*), the second tray 380 is disposed so as not to be horizontal, but inclined at a predetermined angle. At this time, the second tray 380 may be rotated about 6 degrees relative to the horizontal plane to maintain an inclined state.

As illustrated in FIG. 20(*c*), since the second tray 380 is inclined when water is supplied to the tray, water supplied to one cell may spread to other cells.

On the other hand, when the ice making is in progress after the water supply is completed, the second tray 380 is rotated so that the second contact surface 382*c* of the second tray 380 is parallel to the horizontal surface as illustrated in FIG. 22(*a*). At this time, the first tray 320 and the second tray 380 are completely coupled to each other so that each cell is disposed to form a spherical shape.

When ice is made, the second heater 430 may be turned on so that ice can grow from the top of the ice making cell.

That is, power may be supplied to the second heater 430 so that heat is generated by the second heater 430. The second heater 430 is positioned closer to a lower end than an upper end of the ice making cell. On the other hand, on the upper side of the ice making cell, the temperature is lowered by the cold air supplied from the duct. That is, the upper side has a low temperature while the lower side has a high temperature based on the ice making cell, so that a condition in which ice is generated on the upper side is satisfied.

The temperature of the upper side of the ice making cell is low, so the ice is getting bigger, but the bubbles contained in the water are not collected by the ice, and the bubbles are gradually discharged downward so that the bubbles are not collected by the ice.

Therefore, almost no bubbles exist in the generated ice, and transparent ice can be manufactured. In this embodiment, the ice grows from the upper side to the lower side, because the temperature is maintained at the lower side than the upper side. Therefore, the direction of ice generation is kept constant, so that the ice may become transparent.

When the temperature of the tray is measured by the tray temperature sensor 700 and the temperature falls below a predetermined temperature, it may be determined that ice generation is completed as illustrated in FIG. 22(*a*). Accordingly, it is determined that ice can be provided to the user, and the first heater 290 may be operated.

The first heater 290 supplies heat after ice generation is completed, thereby creating conditions in which ice is easily separated from the tray. The first heater 290 applies heat to the first tray 320 so that ice is separated from the first tray 320.

When heat is applied by the first heater 290, the portion of the first tray 320 in contact with ice melts and is converted into water, and the ice is separated from the first tray 320.

The tray temperature sensor 700 measures the temperature of the tray, and when the temperature of the tray rises by a predetermined temperature, it may be determined that the portion of the ice in contact with the first tray 320 has melted. In this case, when the second tray 380 is rotated in the forward direction as illustrated in FIGS. 22(*b*) and 22(*c*), ice is separated from the first tray 320 and mounted on the second tray 380. In this case, since ice may not be separated from the first tray 320, the first pusher 260 pushes the ice from the first tray 320. Since an opening is provided above each of the first tray 320, the first pusher 260 may be disposed in each cell through the opening. The upper side of the first tray 320 is exposed to outside air through respective openings, and cold air supplied through the duct may be guided to the inside of the first tray 320 through the opening. Therefore, as the water contacts the cold air, the temperature of the water decreases and ice may be formed.

As the rotation angle of the second tray 380 increases, the second pusher 540 presses the second tray 380 to deform the second tray 380. Ice may be separated from the second tray 380, dropped downward, and finally stored in the ice bin.

Figure 27:
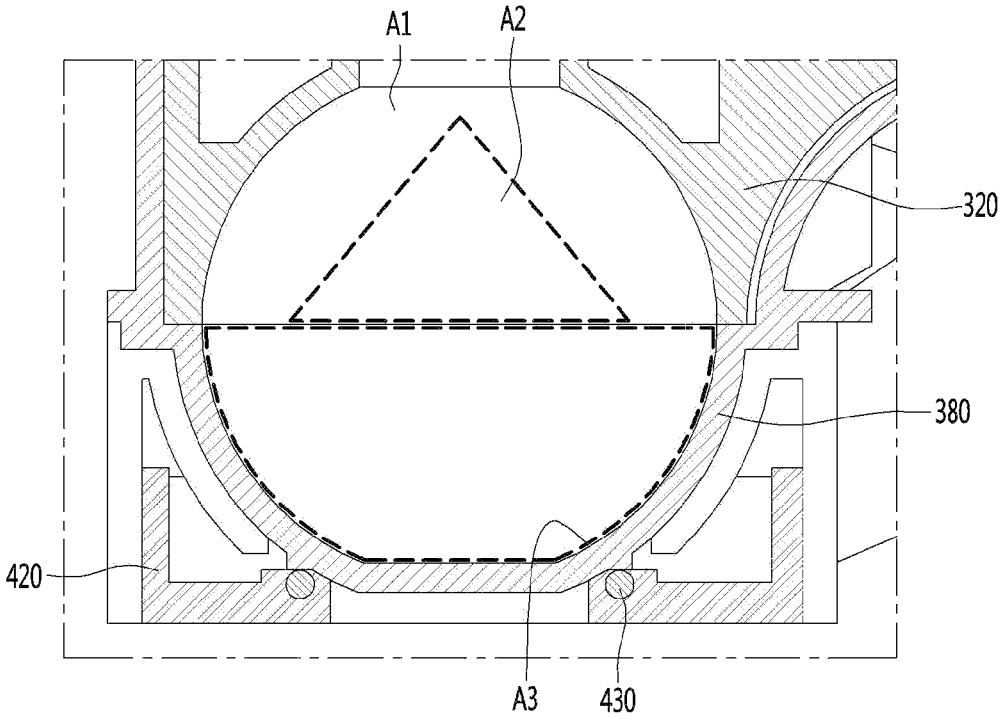
FIG. 27 is a view for explaining a process of generating ice.
Figure 28:
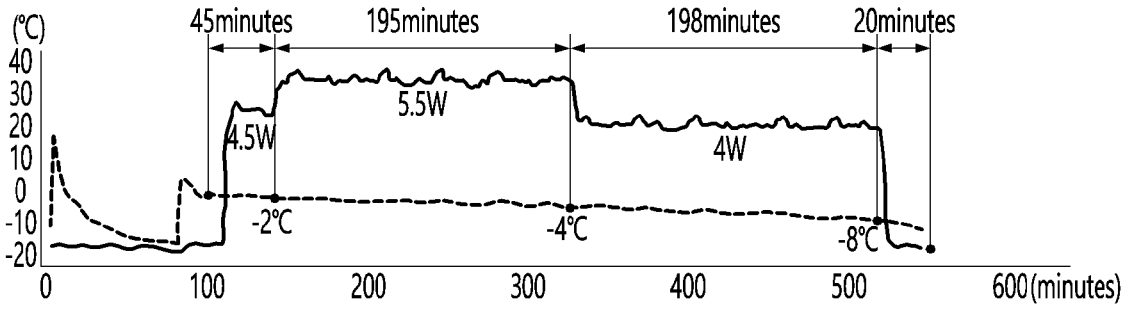
FIG. 28 is a view for explaining a second tray temperature and a heater temperature.

FIG. 27 is a view for explaining a process of generating ice, and FIG. 28 is a view for explaining a second tray temperature and a heater temperature.

A heater can be disposed at the bottom of the tray to make transparent ice. If the output of the heater is constantly input, the ice making speed is high at the beginning of ice making, that is, when ice is made at the top, while the ice making speed is low when ice making is performed at the lower end, so relatively opaque ice is generated in the upper part.

In addition, if the heating amount of the heater increases to make the upper part transparent, the rate at which ice is generated on the upper part may be slowed to generate transparent ice, but since the ice generation time at the low end portion is lengthened, the ice making time is lengthened and the amount of ice making may be reduced.

If the heating amount of the heater is constantly controlled while making ice, there is a difference between the rate at which ice is made at the top and the rate at which ice is made at the bottom.

Therefore, in this embodiment, transparent ice can be generated by changing the heating amount of the heater.

In order to manufacture transparent ice, it is necessary to adjust the freezing speed from the top to the lower end through the second heater 430 installed at the lower end. If it freezes quickly, air scratches occur, creating opaque ice. Therefore, in order to generate transparent ice, it has to be slowly frozen using a heater so that air is not trapped in the ice.

Since cold air is supplied from the upper side, when the upper ice grows, it grows rapidly and the lower part freezes slowly compared to the upper part. If the heater is heated according to the ice growth rate on the upper side, the ice making time is prolonged because it freezes too slowly when the ice on the lower side is generated, and when the heater is heated according to the lower freezing rate, ice with an opaque upper side is generated.

Therefore, in this embodiment, in order to make transparent ice while securing the ice making speed, the heater output may be varied in stages.

The ice generated by the ice maker according to the present embodiment can be divided into three regions as a whole. As illustrated in FIG. 27, the spherical ice can be divided into a first region A1, a second region A2, and a third region A3 as a whole.

The first region A1 may mean a portion in which transparent ice is generated even without heater control. The first region is a portion where water meets the first tray 320 and is a portion in which spherical ice is initially generated. Since the portion meeting the first tray 320 initially has a similar temperature distribution to the first tray 320, the temperature may be relatively low.

The second region A2 is not adjacent to the first tray 320 but is a portion which is positioned within a cell formed in the first tray 320. Since the second region is a portion disposed close to the center of the spherical ice, it is difficult for air to escape, and thus transparency may be difficult to be maintained. The second region is a portion surrounded by the first region and may mean a region similar to a triangular pyramid having a triangular cross section based on the drawing.

The third region A3 is a space in which ice is generated in a cell provided in the second tray 380. Since the third region has a hemispherical shape as a whole, but is a portion disposed close to the second heater 430, heat generated by the second heater 430 can be easily transferred.

In this embodiment, when ice is generated in the portion corresponding to the third region A3, the heating amount generated by the heater is changed. Furthermore, even when ice is generated in the portion corresponding to the third region A3, since the ice generating condition in the third region is different from the ice generating condition in the first region A1 or in the second region A2, the heating amount of the second heater 430 is changed. That is, by changing the temperature of the second heater 430, the speed at which ice freezes may be adjusted.

In FIG. 28, a dotted line indicates the temperature measured by the tray temperature sensor 700, and a solid line indicates the temperature of the second heater 430. Since the temperature of the second heater 430 varies according to the output of the second heater 430, the variable temperature of the second heater 430 described below may mean the variable output of the second heater 430.

Water is supplied to the ice maker 200, and the second heater 430 is not driven for a predetermined time. That is, since the second heater 430 does not generate heat, the tray is not heated. However, when water is supplied, since the temperature of the water is higher than the temperature of the freezing compartment in which the ice maker is located, the temperature of the tray measured by the tray temperature sensor 700 may be temporarily increased.

When the water supply is completed and a predetermined time elapses, the second heater 430 is driven. In this case, the second heater 430 may be driven with a first output for a first set time. In this case, ice may be generated in the first region A1. At this time, the second heater 430 generates heat in the first temperature range. For example, the first set time may mean approximately 45 minutes, and the first output may mean 4.5 W.

In addition, after the first set time has elapsed, the second heater 430 may be driven with the second output for the second set time. At this time, ice may be generated in the second region A2. At this time, the second heater 430 generates heat in the second temperature range. For example, the second set time may mean approximately 195 minutes, and the second output may mean 5.5 W.

After the second set time has elapsed, the second heater 430 may be driven with a third output for a third set time. In this case, ice may be generated in the third region A3. At this time, the second heater 430 generates heat in the third temperature range. For example, the third set time may mean approximately 198 minutes, and the third output may mean 4 W.

The average value of the first temperature range is smaller than the average value of the second temperature range. The average value of the second temperature range is greater than the average value of the third temperature range. The average value of the third temperature range is smaller than the average value of the first temperature range.

In this embodiment, water supply is started and the heater waits after the heater is turned off for a predetermined time, first heating is performed, when the predetermined temperature reaches, second heating is performed, in addition, when the next temperature reaches, third heating is performed, and finally the heater may be controlled in a method of turning off the heater.

Comparing the first temperature range, the second temperature range, and the third temperature range, the second temperature range is the highest, the first temperature range is the next highest, and the third temperature range is the lowest. While ice is generated in the first region A1, the second heater 430 is driven in the second highest temperature range.

While ice is frozen in the first region A1, there are many paths through which air contained in water can escape, so that the possibility of air being collected is relatively small. Accordingly, transparent ice may be generated in the first region even if the second heater 430 is not driven at the highest temperature.

In the second area A2, since a path through which air can escape is relatively small, and a cross-sectional area of ice frozen based on a spherical shape is large, the second heater 430 is driven at the highest temperature.

In the third area A3, ice is generated at a location relatively close to the second heater 430, and since heat generated from the second heater 430 can be easily transferred, the second heater 430 is driven at the lowest temperature.

The time when the second heater 430 is driven with the first output may be shorter than a time when the second heater 430 is driven with the second output or the third output. When driven by the first output, since ice is generated in the first region A1, the amount of ice generated is relatively small compared to the second region A2 or the third region A3. Therefore, the driving time with the first output is smaller than that of the second output or the third output, so that the overall ice freezing speed can be kept constant.

As illustrated in FIG. 28, when the temperature measured by the tray temperature sensor 700 during ice making after the water supply is finished is considered, it can be seen that the temperature gradually decreases from about 0 degrees to −8 degrees with a constant slope. As the temperature of the tray decreases at a constant rate, ice generated in the tray may also grow at a constant rate. Therefore, the air contained in the water is not trapped in the ice and is discharged to the outside, so that transparent ice can be manufactured.

It is also possible to control the heater by dividing the heater into more stages than in this embodiment.

Referring to FIG. 22, a process of separating ice from the first tray and the second tray after the spherical ice is generated will be described.

In this embodiment, heat may be supplied to the first tray 320 by using the first heater 290 installed on the first tray 320. When heat is supplied from the first heater 290 provided in the first tray 320, while the outer surface of the ice formed in the first tray 320 (the surface meeting the first tray 320) is heated, the ice is changed into water.

Ice may be separated from the first tray 320. Of course, the first pusher 260 may allow ice to be separated from the first tray 320, so that reliability of ice separation may be improved.

In addition, ice may be pressed from below by the second pusher 540 to be separated from the second tray 380.

In order to separate the ice after the ice is completed, the first heater 290 disposed above the first tray 320 is first driven in the state of FIG. 22(*a*). The temperature of the first tray 320 may increase by supplying heat from the first heater 290. The first heater 290 is driven until the tray temperature measured by the tray temperature sensor 700 increases or a predetermined time elapses.

While the first heater 290 is driven, the first tray 320 and the second tray 380 are not moved, and a state in which ice is meshed with the first tray 320 and the second tray 380 is maintained. That is, while ice is filled in the ice making cell formed in the first tray 320 and the second tray 380, the first heater 290 is driven to heat the first tray 320 and ice attached to the first tray 320.

After driving the first heater 290, when a predetermined time elapses or when a predetermined temperature is reached, it is determined that the surface of the ice in contact with the first tray 320 has melted, and the second tray 380 is rotated by the set angle.

At this time, the rotation angle is not a angle illustrated in FIG. 22(*b*), but it is preferable that the rotation angle is approximately 10 to 45 degrees positioned in the middle of FIG. 22(*a*) (a state in which the second tray is not rotated) and FIG. 22(*b*) (the second tray is rotated by 90 degrees or more). In this case, the set angle is an angle at which ice may not escape from the second tray 380. In a state in which the second tray 380 is rotated by the set angle, ice that may remain in the first tray 320 may fall to the second tray 380.

Meanwhile, even if the first heater 290 is driven in a state in which the second tray 380 is rotated by a set angle (approximately 10 to 45 degrees), since the ice located in the second tray 380 is at a distance from the first heater 290 and is in a state of being separated from the first tray 320, excessive melting of the ice may be prevented.

In this embodiment, even in a state in which the second tray 380 is rotated by a set angle and thus there is a high possibility that ice is separated from the first tray 320. the first heater 290 is driven and thus ice can be further heated if ice is not separated from the first tray 320, That is, when ice is kept in contact with the first tray 320, reliability that ice is separated from the tray 320 may be improved while the surface of the first tray 320 and the ice in contact with each other is changed to water by heat supplied from the first heater 290.

However, if the ice is already separated from the first tray 320, since the heat supplied from the first heater 290 is difficult to be transferred to the ice by the conduction method, it is possible to prevent the already separated ice from melting by the first heater 290.

When the first heater 290 is driven and a set time elapses in a state in which the second tray 380 is rotated by a set angle from the first tray 320, the driving of the first heater 290 is stopped.

Even after the first heater 290 is turned off, after waiting for a predetermined period of time (approximately 1 to 10 minutes), the second tray 380 is rotated to a position (ice separation position) pressurized by the second pusher 540 as illustrated in FIG. 22(*c*). That is, even in a state in which heat is not supplied by the first heater 290, when the second tray 380 is rotated by a set angle, ice can be separated by the second pusher 540 from the second tray 380.

Figure 29:
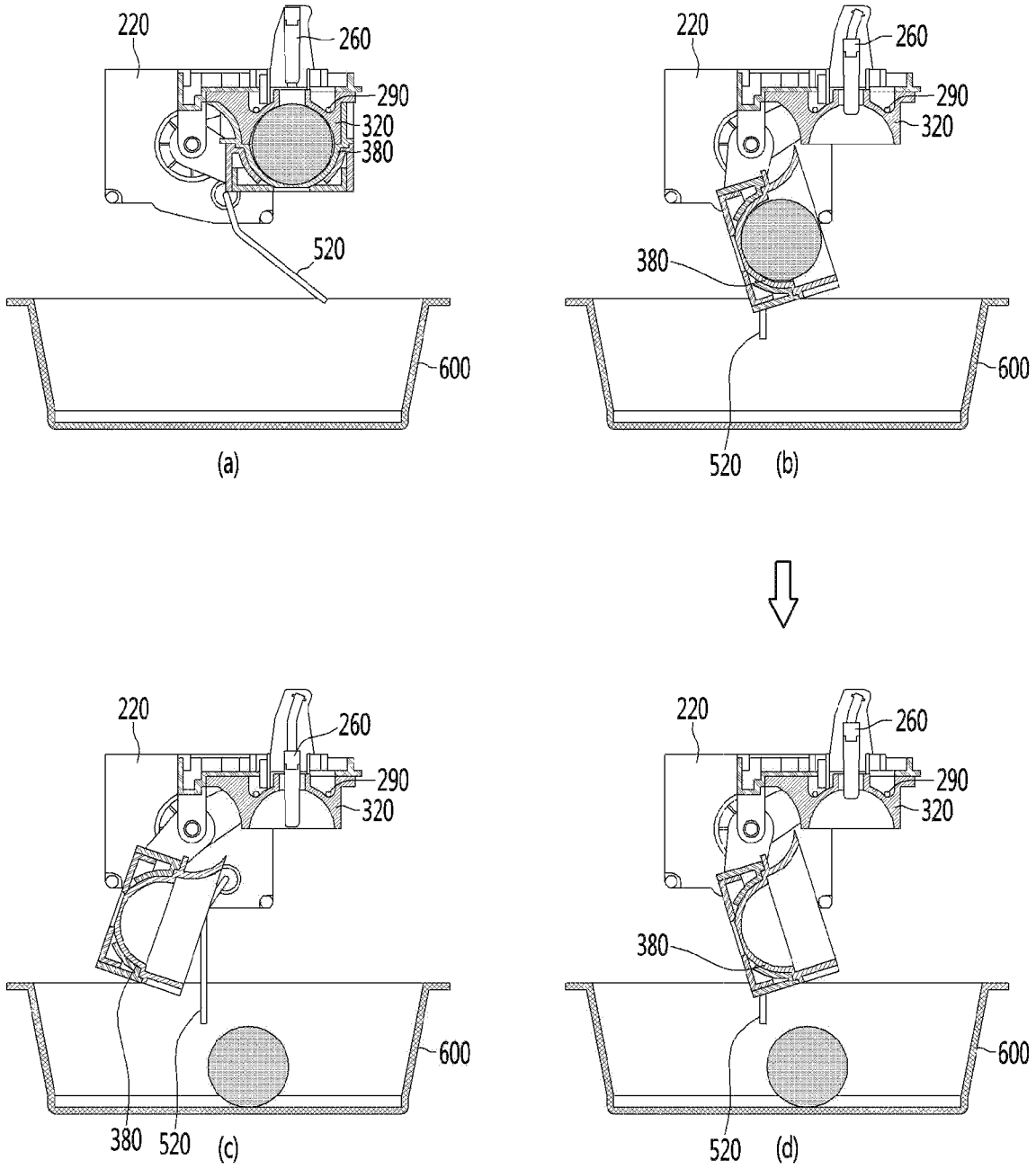
FIG. 29(*a*)-(*d*) is a view for explaining an operation in a case in which full ice is not detected in an embodiment of the present disclosure.
Figure 30:
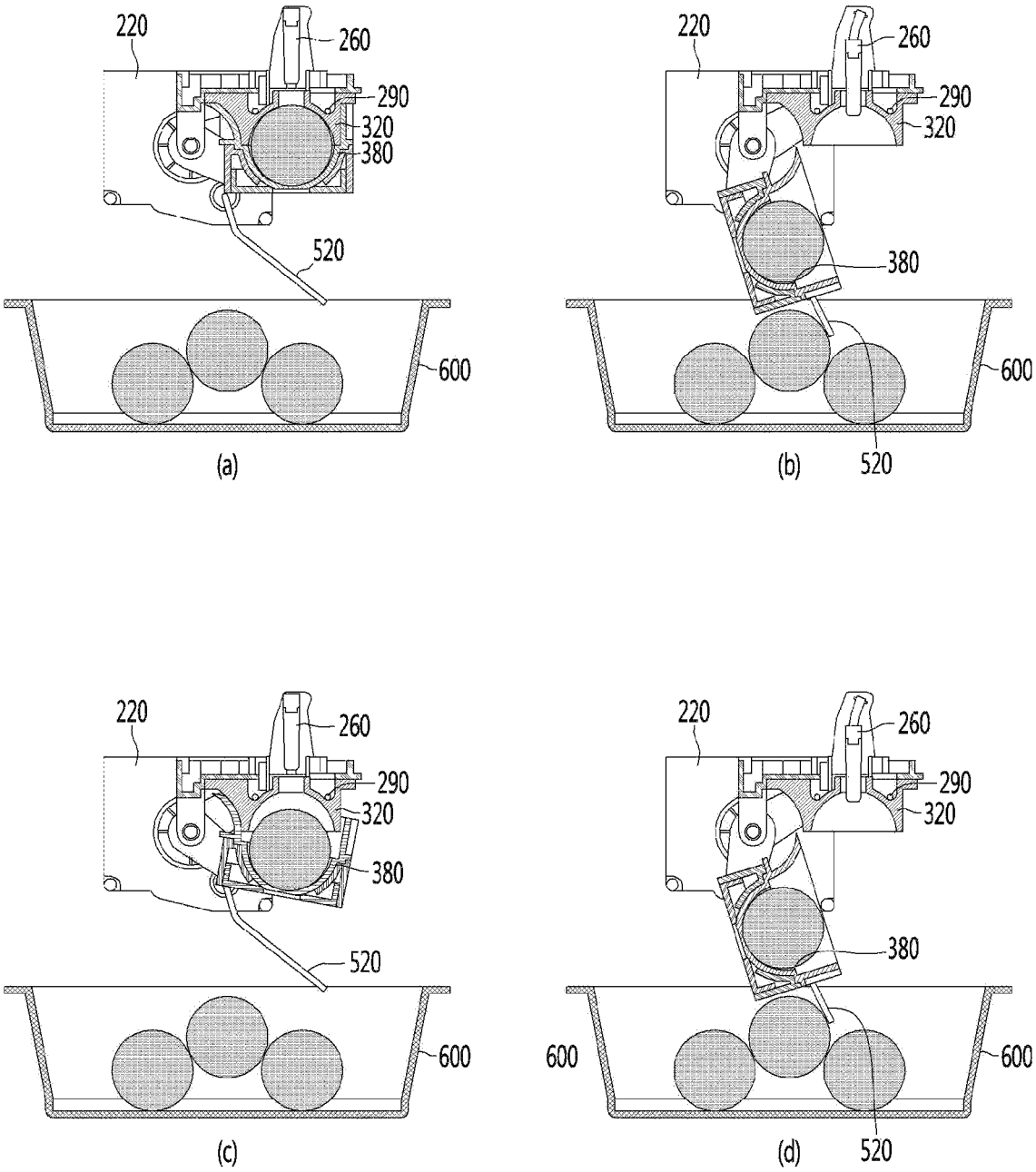
FIG. 30(*a*)-d) is a view for explaining an operation in a case in which full ice is detected in an embodiment of the present disclosure.

FIG. 29(*a*)-(*d*) is a view for explaining an operation in a case in which full ice is not detected in an embodiment of the present disclosure, and FIG. 30 is a view for explaining an operation in a case in which full ice is detected in an embodiment of the present disclosure.

A conventional technique for detecting full ice in an ice maker that manufactures ice has a method for operating the full ice detection part up and down. A twisting type ice maker, which is a method of discharging ice from the tray by twisting the tray after supplying water to the tray, detects whether ice is full by moving the lever up and down. That is, as the lever moves down, it can detect whether there is ice. In a case in which the lever is sufficiently lowered, it is determined that ice is not sufficiently stored in the lower portion of the tray, and in a case in which the lever is not sufficiently lowered, it is determined that ice is stored in the lower portion of the tray. Therefore, the ice is discharged from the tray.

However, in this embodiment, since the tray is composed of a first tray and a second tray, the space occupied by the tray becomes larger than that of the twisting ice maker Therefore, the space in which ice bins for storing ice can be located is also reduced. In addition, in the case of using a lever that moves up and down to determine whether ice is stored, there is a problem that ice located under the lever can be detected, but ice located on the side outside the lower part of the lever cannot be detected.

FIG. 29(*a*)-(*d*) is a view illustrating an operation in a case in which there is a space for additional ice storage in the ice bin 600 (in a case in which full ice is not detected).

As illustrated in FIG. 29(*a*), after the ice is completed, the first heater 290 is driven before the second tray 380 is rotated, so that the surface of ice which contacts the first tray 320 melts and ice may be separated from the first tray 320.

In a case in which the first heater 290 is driven for a predetermined time, the second tray 380 starts to rotate as illustrated in FIG. 29(*b*). At this time, the first pusher 260 penetrates the upper side of the first tray 320 and presses the ice to separate the ice from the first tray 320.

Even in a case in which ice is not sufficiently separated from the first tray 320 by the first heater 290, the ice may be reliably separated by the first pusher 260.

As the second tray 380 is rotated, the full ice detection lever 520 is also rotated. If the movement of the full ice detection lever 520 is not disturbed by ice while the full ice detection lever 520 is rotated to the position of FIG. 29(*b*), the second tray 380 is continuously rotated in a clockwise direction so that ice can separated from the second tray 380 while the second tray 380 is further rotated as illustrated in FIG. 29(*c*).

At this time, the full ice detection lever 520 maintains a stopped state at the position of FIG. 29(*b*). That is, initially, the second tray 380 and the full ice detection lever 520 are rotated together, but in a state in which the full ice detection lever 520 is sufficiently rotated, the full ice detection lever 520 is not rotated and only the second tray 380 is further rotated. The angle at which the full ice detection lever 520 is rotated may be approximately an angle disposed vertically with respect to the bottom surface of the ice bin 600, that is, a horizontal surface. That is, the full ice detection lever 520 is rotated in a clockwise direction up to an approximately vertical angle with respect to a horizontal plane, and the angle at which the rotation of the full ice detection lever 520 is stopped is preferably a position at which the full ice detection lever can be lowered to the lowest level while one end of the full ice detection lever 520 is rotated.

The full ice detection lever 520 and the second tray 380 may be rotated together or individually by the rotational force provided by the driver 480. The full ice detection lever 520 and the second tray 380 are connected to one rotation shaft provided by the driver 480 and may be rotated while drawing one rotation radius.

Since the second tray 380 is rotated by a rotation shaft, a trajectory in which the second tray 380 moves must be secured unlike when the second tray 380 is stopped. In addition, since the full ice detection lever 520 also detects full ice in a rotational manner, the full ice detection lever 520 must be rotated to a height lower than that of the second tray 380.

Therefore, the length of the full ice detection lever 520 extends longer than one end of the second tray 380, so that whether ice exists in the ice bin 600 should be detected. That is, the full ice detection lever 520 is connected to a rotation shaft provided in the driver 480 and thus may be rotated.

The full ice detection lever 520 starts to rotate when the second tray 380 is rotated, and since the second tray 380 is rotated after the ice is completed, whether ice is full can be detected after the ice is completed.

The full ice detection lever 520 is a swing type that rotates about a rotation shaft rather than a vertical movement method, so that whether ice is stored in the ice bin 600 may be detected while moving along a rotation trajectory.

After the ice is moved from the second tray 380 to the ice bin 600, as illustrated in FIG. 29(*d*), the second tray 380 rotates counterclockwise again. Before the full ice detection lever 520 is rotated to the position illustrated in FIG. 29(*b*), the full ice detection lever 520 maintains a stopped state. When the second tray 380 reaches the rotation angle as illustrated in FIG. 29(*b*), the ice detection lever 520 rotates counterclockwise with the second tray 380 and can return to the position of FIG. 29(*a*) which is the initial position.

As illustrated in FIG. 30(*a*), since ice is stored in the lower portion of the ice bin 600, in a situation in which it is difficult to additionally store ice in the ice bin 600, it is determined that ice is full and the ice is not moved to the ice bin 600.

First, in a case in which ice is completed, the first heater 290 is driven to separate the ice from the first tray 320. This process is the same as the content described in FIG. 29(*a*), so a repeated description will be omitted.

Subsequently, as illustrated in FIG. 30(*a*), the second tray 380 and the full ice detection lever 520 are rotated clockwise together to detect whether the ice bin 600 is full.

Before the full ice detection lever 520 is rotated to FIG. 29(*b*), as illustrated in FIG. 30(*b*), in a case in which the full ice detection lever 520 touches ice and cannot be rotated any more, it is determined that the ice bin 600 is filled with ice.

Accordingly, the full ice detection lever 520 and the second tray 380 are not rotated any more and are returned to a water supply position (FIG. 30(*c*)) where water is supplied to the tray. At this time, the second tray 380 and the full ice detection lever 520 are rotated together to return to the original position thereof.

As illustrated in FIG. 30(*d*), after a predetermined time has elapsed, whether the ice is filled is detected again. That is, by rotating the second tray 380 and the full ice detection lever 520 clockwise again, whether the ice bin 600 is full is detected.

Figure 31:
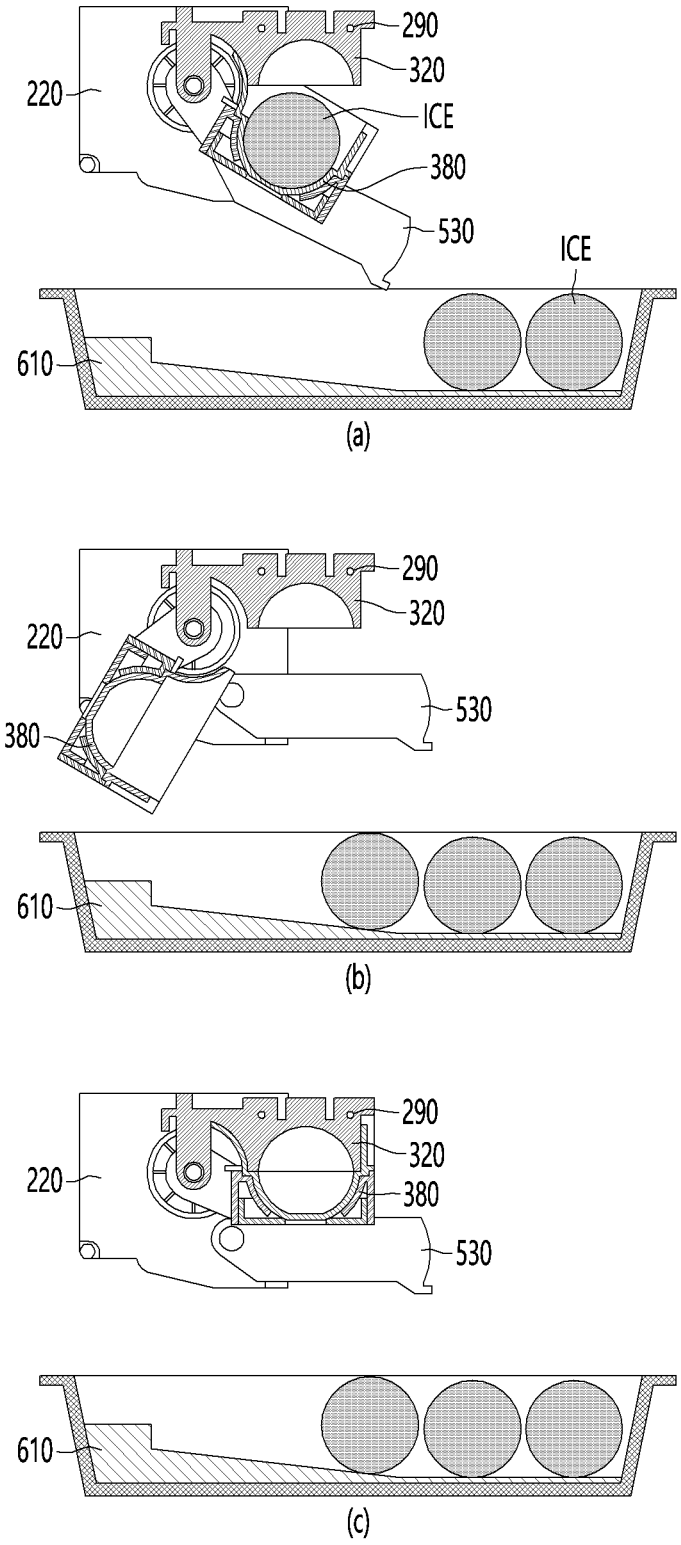
FIG. 31(*a*)-(*c*) is a view for explaining an operation in a case in which full ice is not detected in another embodiment of the present disclosure.
Figure 32:
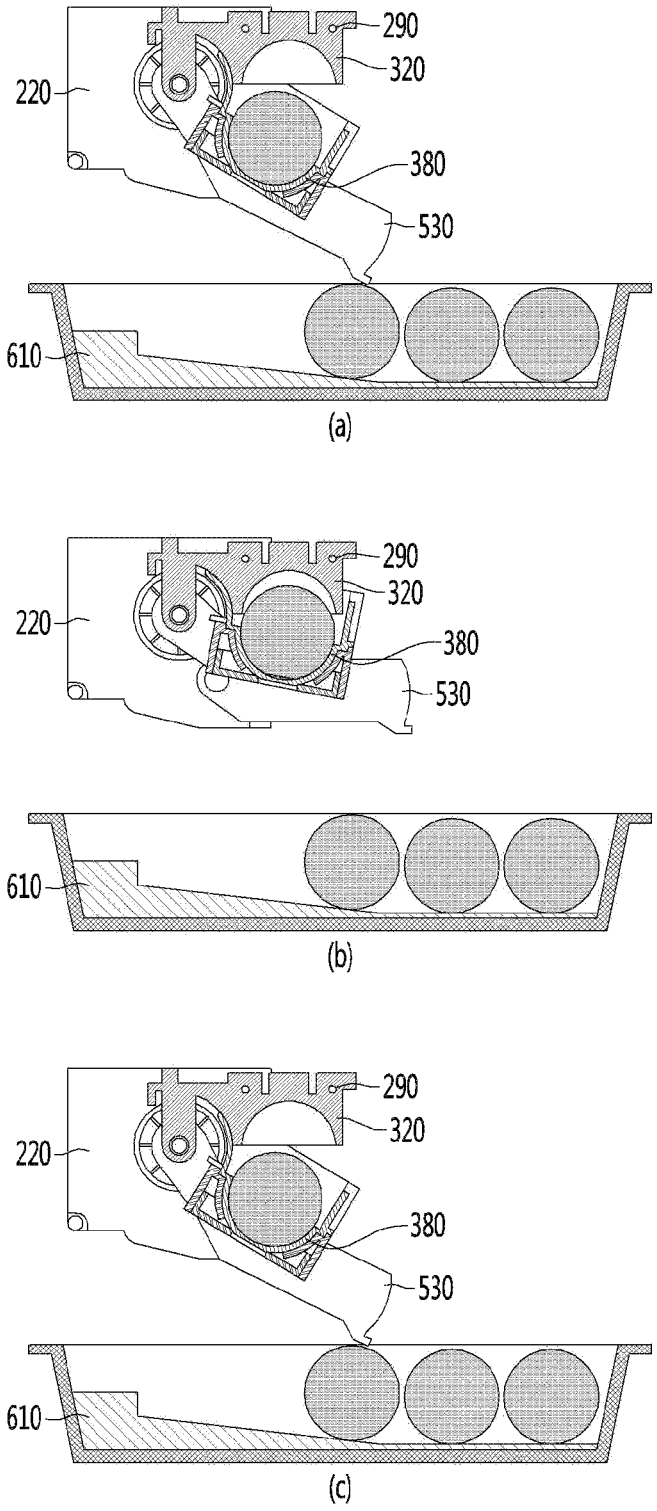
FIG. 32(*a*)-(*c*) is a view for explaining an operation in a case in which full ice is detected in another embodiment of the present disclosure.

FIG. 31(*a*)-(*c*) is a view for explaining an operation in a case in which full ice is not detected in another embodiment of the present disclosure, and FIG. 32(*a*)-(*c*) is a view for explaining an operation in a case in which full ice is detected in another embodiment of the present disclosure.

In another embodiment, unlike FIGS. 29 and 30, the thickness of the full ice detection lever is wider. It is provided in the form of a bar thicker than a wire, so that ice contained in the ice bin 600 can be detected.

In FIGS. 31 and 32, unlike the previous embodiment, an inclined plate 610 is disposed on the bottom of the ice bin 600. The inclined plate 610 is disposed to have a slope of a predetermined angle on the bottom of the ice bin 600 and serves to guide ice stored in the ice bin 600 to collect in a predetermined direction.

The inclined plate 610 is disposed such that a portion close to the second tray 380 has a high height and a portion far from the second tray 380 has a low height. Accordingly, ice separated from the second tray 380 and falling into the ice bin 600 is guided away from the second tray 380.

The description will be made with reference to FIGS. 31 and 32, but the content overlapping with the description of the previous embodiment will be omitted, and the differences will be mainly described.

As illustrated in FIG. 31, when the full ice detection lever 530 and the second tray 380 are rotated, if ice is not detected by the full ice detection lever 530 by the full ice detection lever 530, it is determined that the ice bin 600 has not been filled. Accordingly, as illustrated in FIG. 31(*b*), the full ice detection lever 530 returns to the initial position while rotating in a counterclockwise direction, and the second tray 380 is further rotated to fall ice to the ice bin 600 and to move.

The ice collected in the ice bin 600 is collected at a position away from the second tray 380 due to a height difference between the inclined plate 610.

As illustrated in FIG. 32, when the full ice detection lever 530 and the second tray 380 are rotated, if ice is not detected by the full ice detection lever 530, it is determined that the ice bin 600 is full with ice. Therefore, as illustrated in FIG. 32(*a*), when the full ice detection lever 530 touches ice, the full ice detection lever 530 and the second tray 380 are no longer clockwise and rotate counterclockwise again to return to the original position.

After a predetermined time has elapsed, the full ice detection lever 530 is rotated again to detect ice in the ice bin 600. The reason why the full ice detection lever 530 is rotated again is because a user withdraws ice from the ice bin 600 or an error in detecting whether the ice is full in the ice bin 600 may occur.

The inclined plate 610 applied in another embodiment may be applied in the same manner to the previous embodiment. In the case of making spherical ice, if the depth of the ice bin 600 is long, ice may be damaged when the ice falls from the tray to the ice bin 600. Therefore, the thickness of the ice bin 600 can store spherical ice, but it is better to have a shallow depth if possible. When this condition is satisfied, since the depth of the ice bin 600 is inevitably shallow, a storage space for ice may be insufficient. Therefore, the ice stored in the ice bin 600 is sequentially moved to a predetermined place, so that the ice can be spread evenly in the ice bin 600 so that the ice storage space may be widely used.

Figure 33:
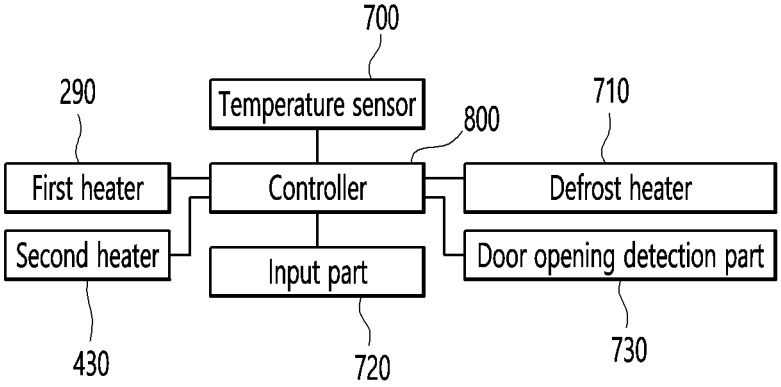
FIG. 33 is a block diagram of a refrigerator according to another embodiment of the present disclosure.
Figure 34:
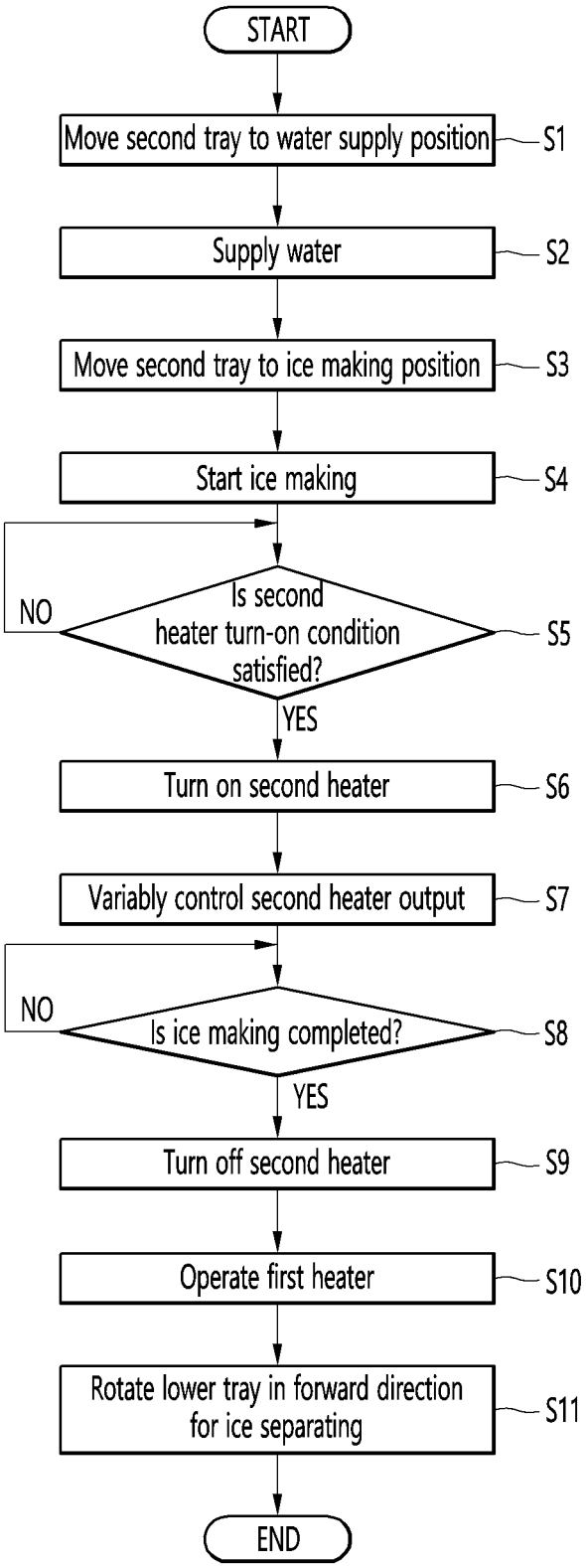
FIG. 34 is a flowchart illustrating a process of generating ice in an ice maker according to another embodiment of the present disclosure.

FIG. 33 is a block diagram of a refrigerator according to another embodiment of the present disclosure, and FIG. 34 is a flowchart illustrating a process of generating ice in an ice maker according to another embodiment of the present disclosure.

Figure 35:
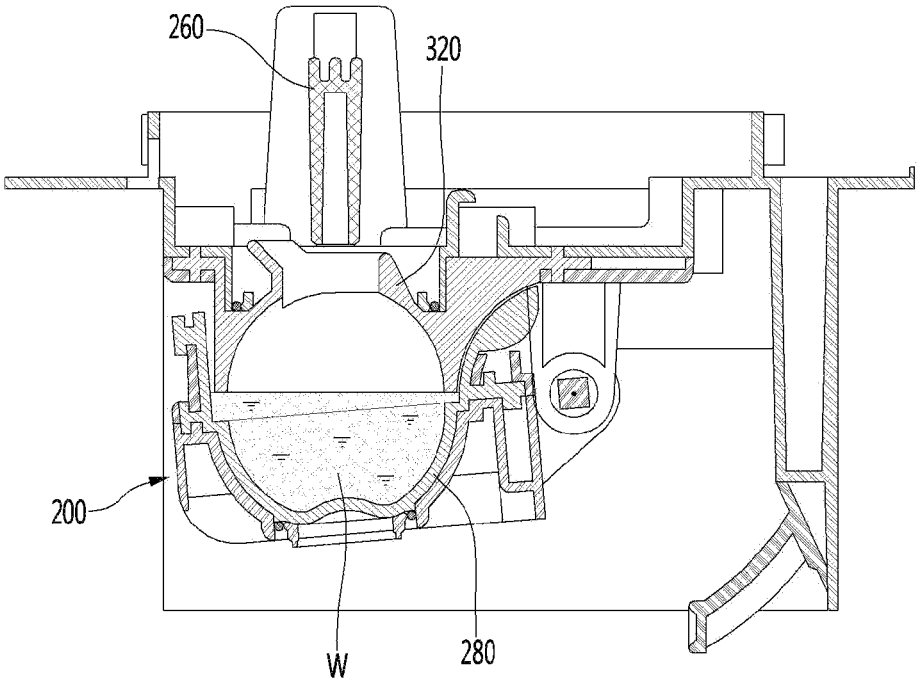
FIG. 35 is a cross-sectional view of an ice maker in a water supply state.
Figure 36:
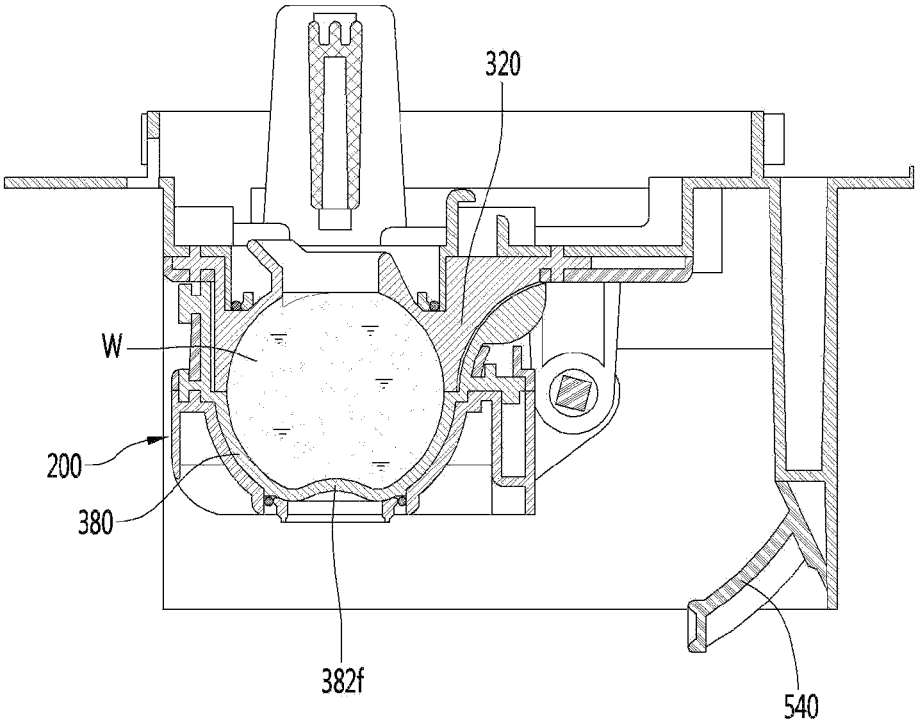
FIG. 36 is a cross-sectional view of an ice maker in an ice making state.
Figure 37:
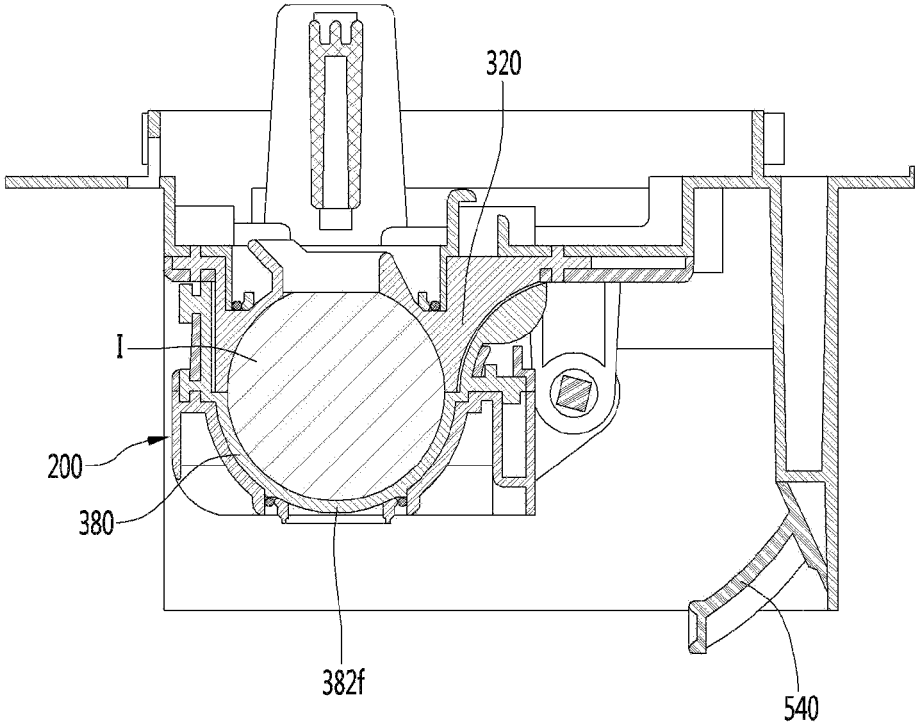
FIG. 37 is a cross-sectional view of an ice maker in a state in which ice making is completed.
Figure 38:
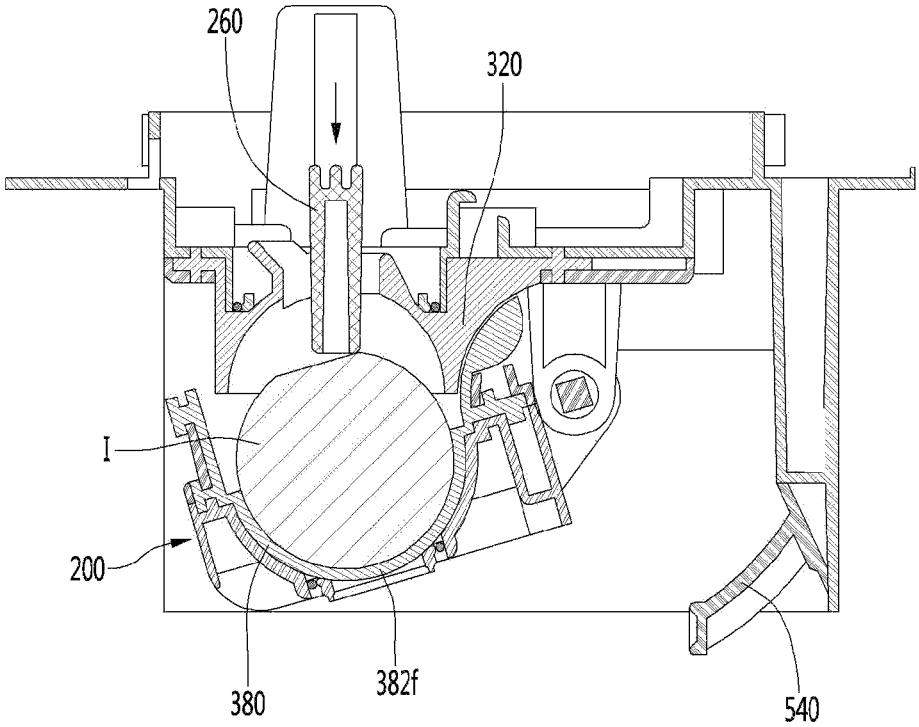
FIG. 38 is a cross-sectional view of an ice maker in an initial state of ice separation.
Figure 39:
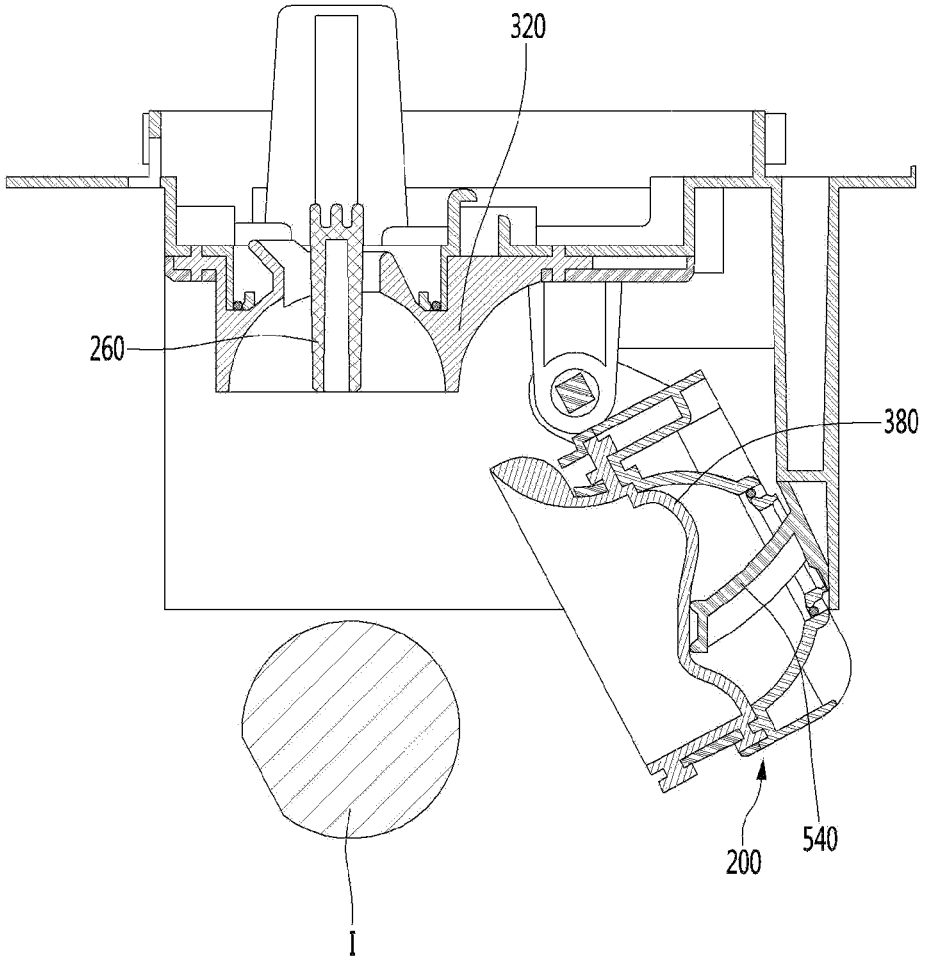
FIG. 39 is a cross-sectional view of an ice maker in a state in which ice separation is completed.

FIG. 35 is a cross-sectional view of an ice maker in a water supply state, FIG. 36 is a cross-sectional view of an ice maker in an ice making state, FIG. 37 is a cross-sectional view of an ice maker in a state in which ice making is completed, FIG. 38 is a cross-sectional view of an ice maker in an initial state of ice separation, and FIG. 39 is a cross-sectional view of an ice maker in a state in which ice separation is completed.

Referring to FIGS. 33 to 39, the refrigerator according to the present embodiment may further include a controller 800 that controls the first heater 290 and the second heater 430.

The refrigerator may further include a defrost heater 710 for defrosting an evaporator for supplying cold air to the freezing compartment 32.

The refrigerator may further include a door opening detection part 730 that detects an opening of a door for opening and closing a storage chamber (for example, a freezing compartment) in which the ice maker 200 is installed.

For example, when the ice maker 200 is provided in the freezing compartment 32, the door opening detection part 730 may detect the opening of the freezing compartment door.

The refrigerator may further include an input part 720 configured to set and change a target temperature of a storage chamber in which the ice maker 200 is provided.

For example, target temperatures of the refrigerating compartment 18 and the freezing compartment 32 may be set and changed through the input part 720.

The controller 800 may adjust the output of the second heater 430 during the ice making process.

In the ice making process, when a defrost is started, a door opening and closing is detected, or a change in a target temperature of the storage chamber is detected, the current output of the second heater may be maintained or changed in response thereto.

Specific output control of the second heater 430 will be described later with reference to the drawings.

In order to generate ice in the ice maker 200, first, the second tray 380 is moved to a water supply position (51).

As an example, while the second tray 380 is moved to an ice separation position to be described later, the controller 800 may control the driver 400 to rotate the second tray 380 in a reverse direction.

At the water supply position of the second tray 380, the second contact surface 382*c* of the second tray 380 is spaced apart from the first contact surface 322*c* of the first tray 320.

In the present embodiment, the direction in which the second tray 380 is rotated (counterclockwise based on the drawing) for ice separation is referred to as a forward direction, and the opposite direction (clockwise) is referred to as a reverse direction.

At the water supply position of the second tray 380, water supply starts (S2).

When the water supply is completed, a portion of the water supplied may be filled in the second tray 380, and another portion of the water supplied may be filled in the space between the first tray 320 and the second tray 380.

In the present embodiment, the second tray 380 does not have, for example, a channel for mutual communication between the three second cells 381*a*.

As described above, even if there is no channel for water movement in the second tray 380, the second contact surface 382*c* of the second tray 380 is spaced apart from the first contact surface 322*c* of the first tray 320. Therefore, when a specific second cell is filled with water during the water supply process, water may flow to another second cell along the second contact surface 382*c* of the second tray 380. Accordingly, the plurality of second cells 381*a* of the second tray 380 may be filled with water.

When the water supply is completed, the second tray 380 is moved to the ice making position.

For example, as illustrated in FIG. 36, the controller 800 may control the driver 400 so that the second tray 380 is rotated in a reverse direction.

When the second tray 380 is rotated in the reverse direction, the second contact surface 382*c* of the second tray 380 becomes close to the first contact surface 322*c* of the first tray 320. Then, the water between the second contact surface 382*c* of the second tray 380 and the first contact surface 322*c* of the first tray 320 is divided and distributed inside each of the plurality of first cells 321*a*. When the upper surface 251*e* of the second tray 380 and the lower surface 151*e* of the first tray 320 are completely in close contact, the upper chamber 152 is filled with water.

The position of the second tray 380 in a state in which the second contact surface 382*c* of the second tray 380 and the first contact surface 322*c* of the first tray 320 are in close contact can be referred to as the ice making position.

In the state in which the second tray assembly 211 moves to the ice making position, ice making is started (S4).

During ice making, since the pressing force of water (or the expansion force of water) is less than the force for deforming the pressing portion 382*f* of the second tray 380, the pressing portion 382*f* is not deformed and maintains the original shape thereof.

After the start of ice making, the controller 800 determines whether the turn-on condition of the second heater 430 is satisfied (S5).

That is, in the case of the present embodiment, the second heater 430 is not turned on immediately after ice making starts, and the second heater 430 is turned on only when the turn-on condition of the second heater 430 is satisfied (S6).

Specifically, generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In the present embodiment, the second heater 430 is not turned on until the water changes into ice. If the second heater 430 is turned on before reaching the freezing point of water in the ice making cell 320*a*, the rate at which the temperature of water reaches the freezing point is slowed by the heat of the second heater 430, and as a result, ice generation rate slows down. That is, the second heater is unnecessarily operated regardless of the transparency of the ice. Accordingly, according to the present embodiment, when the turn-on condition of the second heater 430 is satisfied, the second heater 430 is turned on, so that power cannot be consumed due to unnecessary operation of the second heater 430.

In the present embodiment, when the temperature sensed by the temperature sensor 700 reaches the turn-on reference temperature, the controller 800 determines that the turn-on condition of the second heater 430 is satisfied. For example, the turn-on reference temperature is a temperature for determining that water has started to freeze in the uppermost side (opening side) of the ice making cell 320*a*.

In this embodiment, since the remaining portion of the ice making cell 320*a* other than the aperture is blocked by the first tray 320 and the second tray 380 and thus the water in the ice making cell 320*a* directly contacts the cold air through the opening 324, ice starts to be generated from the uppermost side of the ice making cell 320*a* where the opening 324 is located.

In this embodiment, the temperature sensor 700 does not directly detect the temperature of ice, and the temperature sensor 700 contacts the first tray 320 to detect the temperature of the first tray 320.

By this structural disposition, in order to determine that ice has started to be generated in the ice making cell 320*a* based on the temperature sensed by the temperature sensor 700, the turn-on reference temperature may be set to a sub-zero temperature.

That is, in a case in which the temperature sensed by the temperature sensor 700 reaches the turn-on reference temperature, since the turn-on reference temperature is a sub-zero temperature, the ice temperature of the ice making cell 320*a* is a sub-zero temperature and is lower than the turn-on reference temperature. Therefore, it can be indirectly determined that ice is generated in the ice making cell 320*a*.

When the second heater 430 is turned on, heat from the second heater 430 is transferred to the second tray 380. Therefore, when ice making is performed in a state in which the second heater 430 is turned on, heat is supplied to the water contained in the second cell 381*a* within the ice making cell 320*a* and thus ice is generated from above in the ice making cell 320*a*.

In this embodiment, since ice is generated from the top in the ice making cell 320*a*, the bubbles in the ice making cell 320*a* move downward. Since the density of water is greater than the density of ice, bubbles in the water can easily move downwards and collect downwards.

Since the ice making cell 320*a* is formed in a spherical shape, the horizontal cross-sectional area is different for each height of the ice making cell 320*a*. Assuming that the same amount of cool air is supplied to the ice making cell 320*a*, if the output of the second heater 430 is the same, the horizontal cross-sectional area is different for each height of the ice making cell 320*a* and thus the rate at which ice is generated may vary depending on the height. In other words, the height at which ice is generated per unit time is not uniform. In this case, bubbles in the water are included in the ice without moving downward, and the ice becomes opaque.

Accordingly, in the present embodiment, the controller 800 controls the output of the second heater 430 by varying according to the height at which ice is generated in the ice making cell 320*a* (S7).

The horizontal cross-sectional area of ice increases as it goes from the top to the bottom, then reaches a maximum at the boundary between the first tray 320 and the second tray 380, and then decreases to the bottom. In response to the change in the horizontal cross-sectional area according to the height, the controller 800 may vary the output of the second heater 430. Variable control of the output of the second heater 430 will be described later with reference to the drawings.

Ice is in contact with the upper surface of the pressing portion 382*f* of the second tray 380 while ice is continuously generated from the top to the bottom in the ice making cell 320*a*. When ice is continuously generated in this state, the pressing portion 382*f* is pressed and deformed as illustrated in FIG. 37, and when ice making is completed, ice in a sphere shape may be generated.

The controller 800 may determine whether ice making is completed based on the temperature sensed by the temperature sensor 700 (S8).

When it is determined that ice making is completed, the controller 800 turns off the second heater 430 (S9).

In the present embodiment, since the distance between the temperature sensor 700 and each ice making cell 320*a* is different, in order to determine that ice generation has been completed in all ice making cells 320*a*, the controller 800 can start the ice separation after a predetermined time has elapsed from the time it is determined that ice making is completed.

When the ice making is completed, the controller 800 operates the first heater 290 to remove the ice (S10).

When the first heater 290 is turned on, heat from the first heater 290 is transferred to the first tray 320 so that ice may be separated from the surface (inner surface) of the first tray 320. In addition, the heat of the first heater 290 is transferred to the contact surface between the first tray 320 and the second tray 380, so that the portion between the first contact surface 322*c* of the first tray 320 and the second contact surface 382*c* of the second tray 380 is in a state of being capable of being separated.

When the first heater 290 is operated for a set time, the controller 800 turns off the first heater 290. The controller 800 operates the driver 400 so that the second tray 380 is rotated in a forward direction (S11).

As illustrated in FIG. 38, when the second tray 380 is rotated in the forward direction, the second tray 380 is separated from the first tray 320 and spaced apart from the first tray 320.

The rotational force of the second tray 380 is transmitted to the first pusher 260 by the connection part 350. Then, the first pusher 260 is lowered, so that the first pusher 260 can press the ice.

During the ice separation process, ice may be separated from the first tray 320 before the first pusher 260 presses the ice. That is, ice may be separated from the surface of the first tray 320 by the heat of the first heater 290. In this case, the ice may be rotated together with the second tray 380 in a state of being supported by the second tray 380.

Alternatively, even if the heat of the first heater 290 is applied to the first tray 320, there may be a case where ice is not separated from the surface of the first tray 320. Accordingly, when the second tray 380 is rotated in the forward direction, ice may be separated from the second tray 380 in a state in which the ice is in close contact with the first tray 320.

In this state, in the process of rotating the second tray 380, the first pusher 260 passing through the opening 324 presses the ice in close contact with the first tray 320, so that the ice may be separated from the first tray 320. Ice separated from the first tray 320 may be supported by the second tray 380 again.

In a case in which ice is rotated together with the second tray 380 in a state in which ice is supported by the second tray 380, even if no external force is applied to the second tray 380, the ice can be separated from the tray 380 by the own weight thereof.

If, in the process of rotating the second tray 380, even if ice is not separated from the second tray 380 by the own weight thereof, when the second tray 380 is pressed by the second pusher 540 as illustrated in FIG. 37, ice may be separated from the second tray 380.

Specifically, in a process in which the second tray 380 is rotated, the second tray 380 comes into contact with the second pusher 540. When the second tray 380 is continuously rotated in the forward direction, the second pusher 540 presses the second tray 380 so that the second tray 380 is deformed, and the pressing force of the the second pusher 540 is transferred to the ice so that the ice may be separated from the surface of the second tray 380. Ice separated from the surface of the second tray 380 may fall downward and be stored in the ice bin.

After the ice is separated from the second tray 380, the controller 800 controls the driver 400 to rotate the second tray 380 in the reverse direction.

When the second pusher 540 is spaced apart from the second tray 380 in a process in which the second tray 380 is rotated in the reverse direction, the deformed second tray 380 may be restored to the original shape thereof.

In the process of rotating the second tray 380 in the reverse direction, a rotational force is transferred to the first pusher 260, so that the first pusher 260 rises, and the first pusher 260 is removed from the ice making cell 320*a*. When the second tray 380 reaches the water supply position, the driver 400 is stopped, and water supply starts again.

Figure 40:
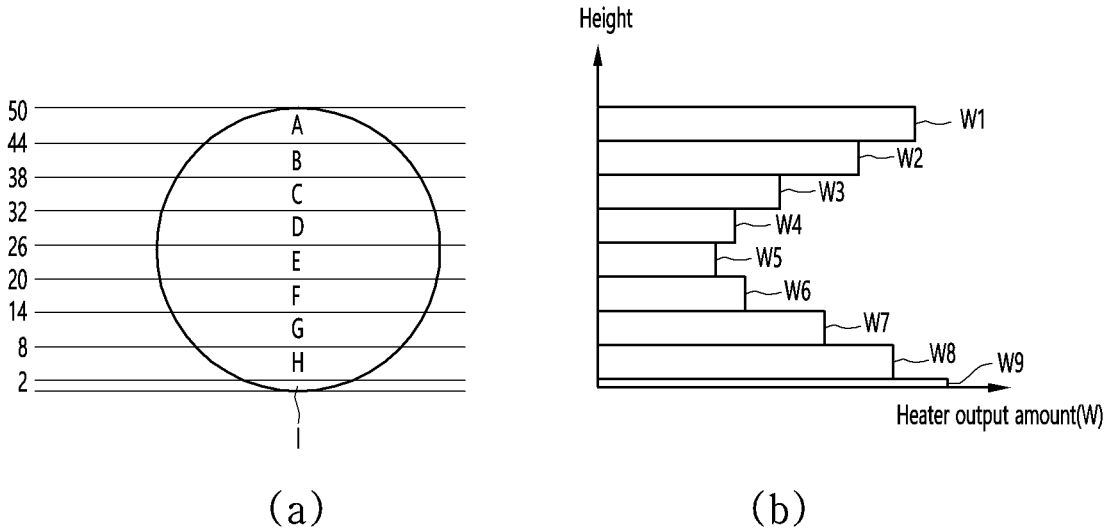
FIG. 40(*a*)-(*b*) is a diagram for explaining an output of a second heater for each height of ice generated in an ice making cell.

FIG. 40 is a diagram for explaining an output of a second heater for each height of ice generated in an ice making cell. FIG. 40(*a*) illustrates that the spherical ice making cell is divided into a plurality of sections by height, and FIG. 40(*b*) illustrates the output amount of the second heater for each height section of the ice making cell.

In this embodiment, as an example, a case in which a spherical ice making cell (or ice spacing) having a diameter of 50 mm is divided into 9 sections (A section to I section) at 6 mm interval (reference interval) is described, and it should be noted that there is no limit to the diameter of the ice making cell (or the diameter of ice) and the number of divided sections.

Figure 42:
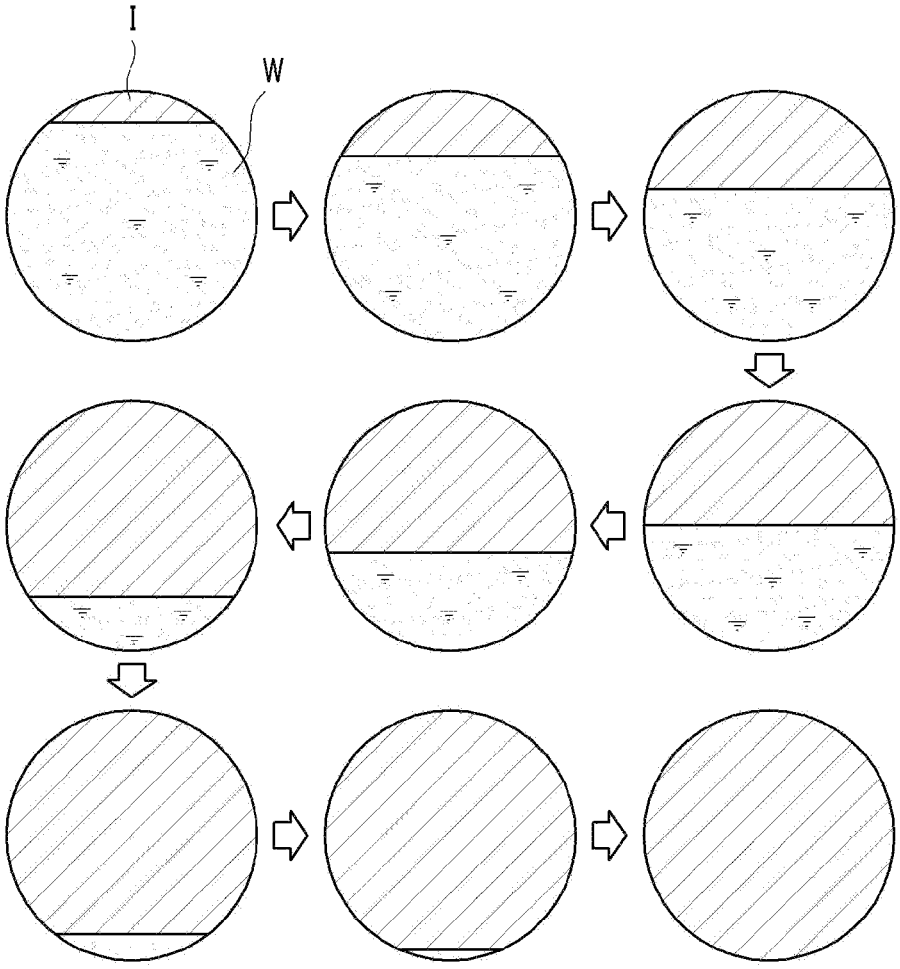
FIG. 42 is a view illustrating step by step a process in which ice is generated for each ice height section.

FIG. 41 is a graph illustrating a temperature sensed by a temperature sensor and an output amount of a second heater during a water supply and ice making process, and FIG. 42 is a view illustrating step by step a process in which ice is generated for each ice height section.

In FIG. 42, I is the generated ice and W is water.

Referring to FIGS. 40 and 41, in a case in which the ice making cells are divided by the reference interval, the height of each divided section is the same between section A and section H, and section I is lower than the rest of sections. Of course, depending on the diameter of the ice making cell (or the diameter of ice) and the number of divided sections, the heights of all divided sections may be the same.

Among the plurality of sections, since section E is a section including the maximum horizontal diameter of the ice making cell, the volume is maximum, and the volume decreases from section E to the upper section and the lower section.

As described above, assuming that the same amount of cool air is supplied and the output of the second heater 430 is constant, the ice generation rate in the E section is the slowest, and the ice generation rate in the A section and section I is the fastest.

In this case, since the ice generation rate is different for each section, the transparency of the ice varies for each section, and there is a problem that the ice generation rate is too fast in a specific section, including air bubbles.

In the present disclosure, the second heater 430 is controlled so that the rate at which ice is generated for each section is the same or similar while allowing the bubbles in the water to move downward during the ice generation process.

Specifically, since the volume of the E section is the largest, the output W5 of the second heater 430 in the E section may be set as low as the maximum. Since the volume of section D is smaller than the volume of section E, the rate of ice generation increases as the volume decreases, it is necessary to delay the rate of ice generation. Accordingly, the output W6 of the second heater 430 in section D may be set higher than the output W5 of the second heater 430 in section E.

For the same reason, since the volume of section C is smaller than the volume of section D, the output W3 of the second heater 430 of section C may be set higher than the output W4 of the second heater 430 of section D. In addition, since the volume of section B is smaller than the volume of section C, the output W2 of the second heater 430 in section B may be set higher than the output W3 of the second heater 430 in section C. In addition, since the volume of section A is smaller than the volume of section B, the output W1 of the second heater 430 in section A may be set higher than the output W2 of the second heater 430 in section B.

For the same reason, since the volume of section F is smaller than the volume of section E, the output W6 of the second heater 430 of section F is set higher than the output W5 of the second heater 430 of section E. Since the volume of the section G is smaller than the volume of the section F, the output W7 of the second heater 430 of the section G may be set higher than the output W6 of the second heater 430 of the section F. Since the volume of section H is smaller than the volume of section G, the output W8 of the second heater 430 in section H may be set higher than the output W7 of the second heater 430 in section G. Since the volume of section I is smaller than the volume of section H, the output W9 of the second heater 430 of section I may be set higher than the output W8 of the second heater 430 of section H.

Accordingly, looking at the output change pattern of the second heater 430, after the second heater 430 is turned on for the first time, the output of the second heater 430 may be gradually reduced from the first section to the intermediate section.

In the intermediate section of the ice making cell 320*a* (the section in which the horizontal diameter is the maximum), the output of the second heater 430 may be minimized. From the next section of the intermediate section of the ice making cell 320*a*, the output of the second heater 430 may be increased step by step again.

As illustrated in FIG. 41, as the height of the generated ice increases, the temperature sensed by the temperature sensor 700 decreases. The section reference temperature for each section may be determined in advance and may be stored in a memory (not illustrated).

Accordingly, when the temperature sensed by the temperature sensor 700 in the current section reaches a section reference temperature of the next section, the controller 800 may be changed to the output of the second heater 430 corresponding to the current section to the output of the second heater corresponding to the next section.

In FIG. 40(*a*), it is assumed that the pressing part does not exist in the second tray 380 for easy understanding.

In the present embodiment, since the pressing part is provided in the second tray 380, actually, section I may not exist according to the number of sections in the ice making cell 320*a*. Alternatively, section I may correspond to a section in which the pressing part is located.

In any case, the section including the pressing part may correspond to the final section among the plurality of sections, and the output of the second heater 430 may be determined based on the volume of the section.

By controlling the output of the second heater 430, the transparency of the ice becomes uniform for each section, and bubbles are collected in the lowermost section, so that bubbles are collected in a local part of the ice as a whole and the rest of the ice may be transparent as a whole.

Figure 43:
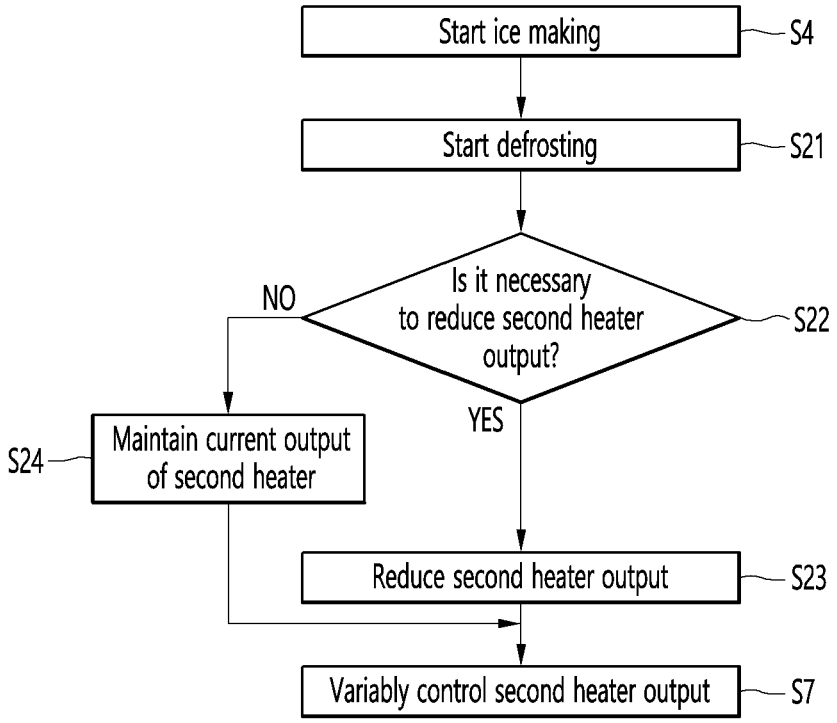
FIG. 43 is a view for explaining a method for controlling a second heater in a case in which defrosting of an evaporator starts in an ice making process.

FIG. 43 is a view for explaining a method for controlling a second heater in a case in which defrosting of an evaporator starts in an ice making process.

Referring to FIGS. 40 and 43, while ice is started (S4) and ice is generated by turning on the second heater 430 during the ice making process, the defrosting of the evaporator for supplying cold air to the freezing compartment 32 can be started (S21).

As an example, defrost may be performed by turning on the defrost heater 710, but it is noted that there is no limitation in the method of performing the defrost in the present disclosure.

When defrosting is performed by the defrost heater 710, the cold air may not be supplied to the freezing compartment 32, the amount of cold air supplied may be small, or the temperature of the supplied cold air may be high.

Accordingly, during the defrosting process, the temperature of the cold air around the ice maker 200 increases, and accordingly, the temperature sensed by the temperature sensor 700 is high.

As described above, when defrosting is performed while the second heater 430 is operated, substantially the heat supplied to the ice making cell 320*a* becomes excessive. In this case, there is a problem in that ice is not generated at a desired time period due to a slow rate of ice generation, and there is a problem that the transparency of each section of the generated ice is changed.

Accordingly, when defrosting starts during the ice making process, the controller 800 may determine whether it is necessary to reduce the output of the second heater 430 (S22).

The controller 800 may determine whether the current section is a section before the intermediate section, and if the current section is a section before the intermediate section, it may determine that the output of the second heater 430 needs to be reduced.

For example, in FIG. 40, when defrosting starts while ice is being generated in section B, the controller 800 can reduce the output of the second heater 430 as an output (W3) corresponding to section C, which is the next section.

In this way, by reducing the output of the second heater 430, excessive heat may be prevented from being supplied to the ice making cell 320*a*, and unnecessary power consumption of the second heater may be reduced. In this way, after reducing the output of the second heater 430, the controller 800 may variably control the output of the second heater 430 for each section.

For example, in a state in which the output of the second heater 430 is reduced, the controller 800 determine whether the temperature sensed by the temperature sensor 700 reaches the section reference temperature corresponding to the next section to the section in which the output is reduced. In addition, in a case in which the sensed temperature reaches the section reference temperature corresponding to the next section, the output variable control of the second heater 430 is normally performed.

Specifically, when the defrosting starts while the second heater 430 is operating at an output of W2 in section B, the output of the second heater 430 is reduced and thus operates at an output of W3.

When the temperature sensed by the temperature sensor 700 reaches a section reference temperature corresponding to section C, which is the next section of section B, the controller 800 controls the second heater 430 to correspond to the output W3 of section C to work with the output of W3. Sequentially, the output of the second heater 430 may be adjusted as an output corresponding to section D to section H.

In summary, the controller 800 reduces the output of the second heater 430 only in the current section, and when the next section starts based on the temperature change, the output variable control of the second heater 430 can be normally performed in the next section (S7).

As described above, in a case in which the defrost start time is a section before the intermediate section, the delay time of ice generation can be minimized by reducing the output of the second heater 430.

Meanwhile, in a state in which the current section is an intermediate section, the controller 800 may determine that the output of the second heater is reduced or maintained. As an example, the controller 800 may turn off the second heater 430 when the current section is an intermediate section (section E) and the temperature sensed by the temperature sensor 700 is equal to or higher than the turn-off reference temperature. In this case, the turn-off reference temperature may be set as the temperature of above zero.

Thereafter, when the temperature sensed by the temperature sensor 700 reaches a section reference temperature corresponding to the next section (section F), the second heater 430 is operated as an output W6 corresponding to the next section (section F), and the output variable control of the second heater 430 is normally performed (S7).

In addition, when the current section is an intermediate section (section E) and the temperature sensed by the temperature sensor 700 is less than the turn-off reference temperature, the controller 800 may maintain the output of the second heater 430 (S24).

Alternatively, the controller 800 may maintain the output of the second heater 430 in a state in which the current section is an intermediate section (section E).

In this way, while the output of the second heater 430 is maintained, when the temperature sensed by the temperature sensor 700 reaches the reference temperature for a section corresponding to the next section (section F), the second heater 430 is operated with the output corresponding to the next section (section F) to normally perform variable control of the output of the second heater 430 (S7).

On the other hand, in a case in which the current section is a section after the intermediate section, since there is not much time remaining until the ice is completed, the controller 800 maintains the output of the second heater 430 as the current output, and until ice generation is completed, the output variable control of the second heater 430 may be normally performed.

Alternatively, in a case in which the current section is a section after the intermediate section, the controller 800 may maintain the output of the second heater 430 as the current output in the current section, and then reduce the output of the second heater 430 when the temperature detected by the temperature sensor 700 reaches the reduction reference temperature.

For example, the controller 800 may reduce the output of the second heater 430 to the output of the previous section. Referring to FIG. 38, in a case in which the current section is the G section, when the temperature sensed by the temperature sensor 700 reaches the reduced reference temperature, the output of the second heater 430 can be reduced to output W6 corresponding to section F which is the previous section.

Thereafter, when the temperature sensed by the temperature sensor 700 reaches a section reference temperature corresponding to the next section (section H), the second heater 430 is operated as an output corresponding to the next section (section H), and thus the output variable control of the second heater 430 can be normally performed. In this case, the reduced reference temperature may be set equal to or lower than the turn-off reference temperature.

According to the present embodiment, there is an advantage in that transparent ice can be generated by adjusting the output of the second heater in response to a temperature increase of the cold air around the ice maker during the defrosting process.

Figure 44:
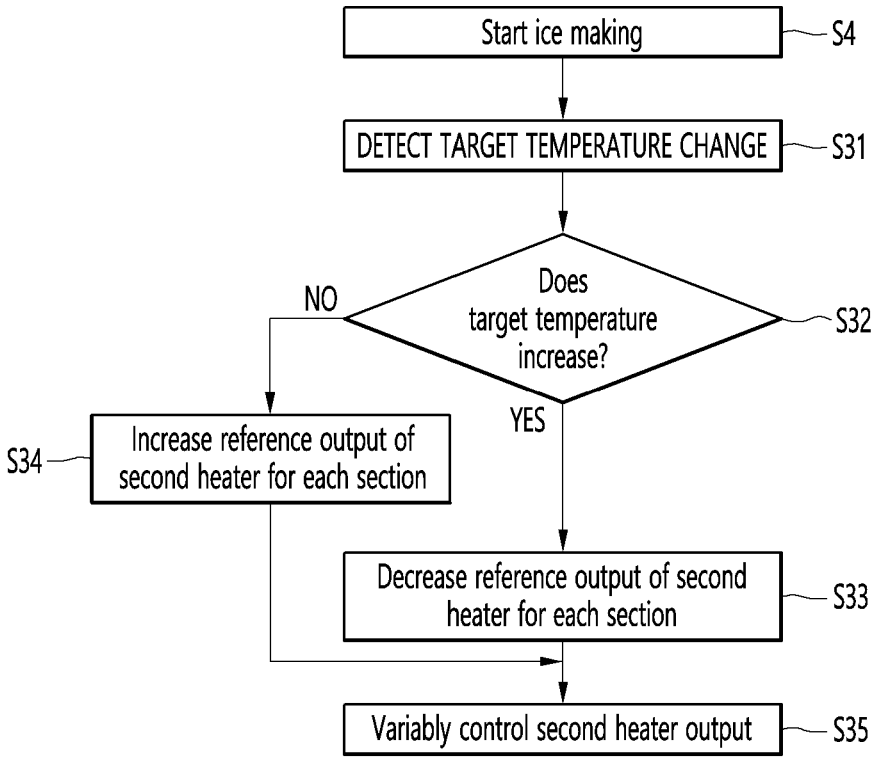
FIG. 44 is a view for explaining a method for controlling a second heater in a case in which a target temperature of a freezing compartment is changed during an ice making process.

FIG. 44 is a view for explaining a method for controlling a second heater in a case in which a target temperature of a freezing compartment is changed during an ice making process.

Figure 45:
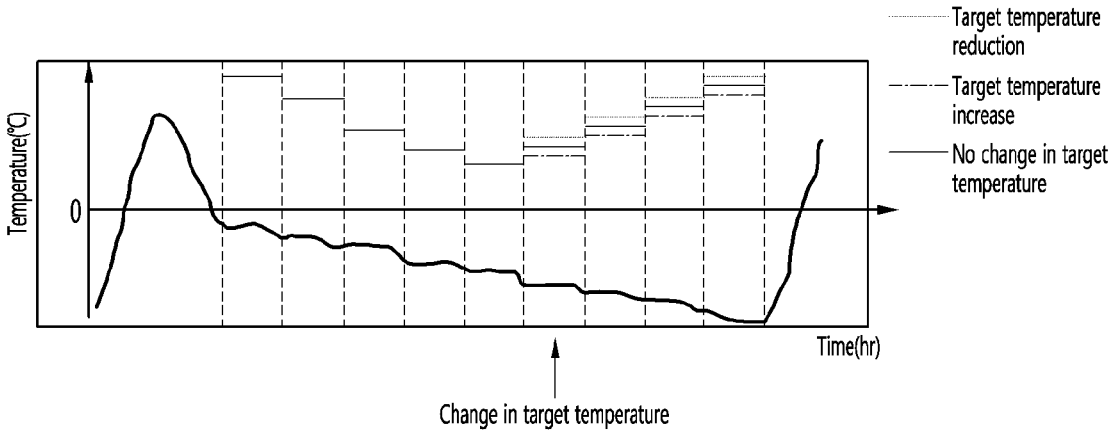
FIG. 45 is a graph illustrating a change in output of a second heater according to an increase or decrease in a target temperature of a freezing compartment.

FIG. 45 is a graph illustrating a change in output of a second heater according to an increase or decrease in a target temperature of a freezing compartment.

Referring to FIGS. 44 and 45, the amount of cool air (or the cooling power or cool air temperature of the compressor) is determined in accordance with the target temperature of the freezing compartment 32, and the determined amount of cool air is supplied to the freezing compartment. The reference output of the second heater 430 for each section is determined in consideration of a predetermined amount of cool air.

However, when the target temperature of the freezing compartment 32 is varied, the amount of cool air supplied to the freezing compartment 32 is varied, and accordingly, the temperature of the cold air around the ice maker 200 may vary.

If the target temperature of the freezing compartment 32 decreases, the amount of cool air supplied to the freezing compartment 32 increases, so that the temperature of the cold air around the ice maker 200 decreases, thereby increasing the rate of ice generation. On the other hand, when the target temperature of the freezing compartment 32 increases, the amount of cool air supplied to the freezing compartment 32 decreases, so that the temperature of the cold air around the ice maker 200 increases, thereby slowing the rate of ice generation. Therefore, the ice making time becomes longer.

Accordingly, in the present embodiment, the controller 800 may control the output of the second heater 430 so that transparent ice can be generated at a constant ice making rate regardless of the variation of the target temperature.

For example, ice making starts (S4), and a target temperature change of the freezing compartment 32 is sensed through the input part 720 during the ice making process (S31). Then, the controller 800 determines whether the target temperature increases (S32).

As a result of the determination in step S32, if the target temperature is increased, the controller 800 reduces the reference output of each of the current section and the remaining section, and operates the second heater 430 with the reduced reference output. Then, until the ice making is completed, the output variable control of the second heater 430 for each section may be normally performed (S35).

On the other hand, if the target temperature decreases, the controller 800 increases the reference output of each of the current section and the remaining section (S34), and operates the second heater 430 with the increased reference output. Then, until the ice making is completed, the output variable control of the second heater 430 for each section may be normally performed (S35). In this embodiment, the reference output to increase or decrease may be predetermined.

According to the present embodiment, by increasing or decreasing the reference output for each section of the second heater in consideration of a case in which the amount of cold air is varied according to the target temperature change, there is an advantage in that transparent ice can be generated at a constant ice making speed.

Figure 46:
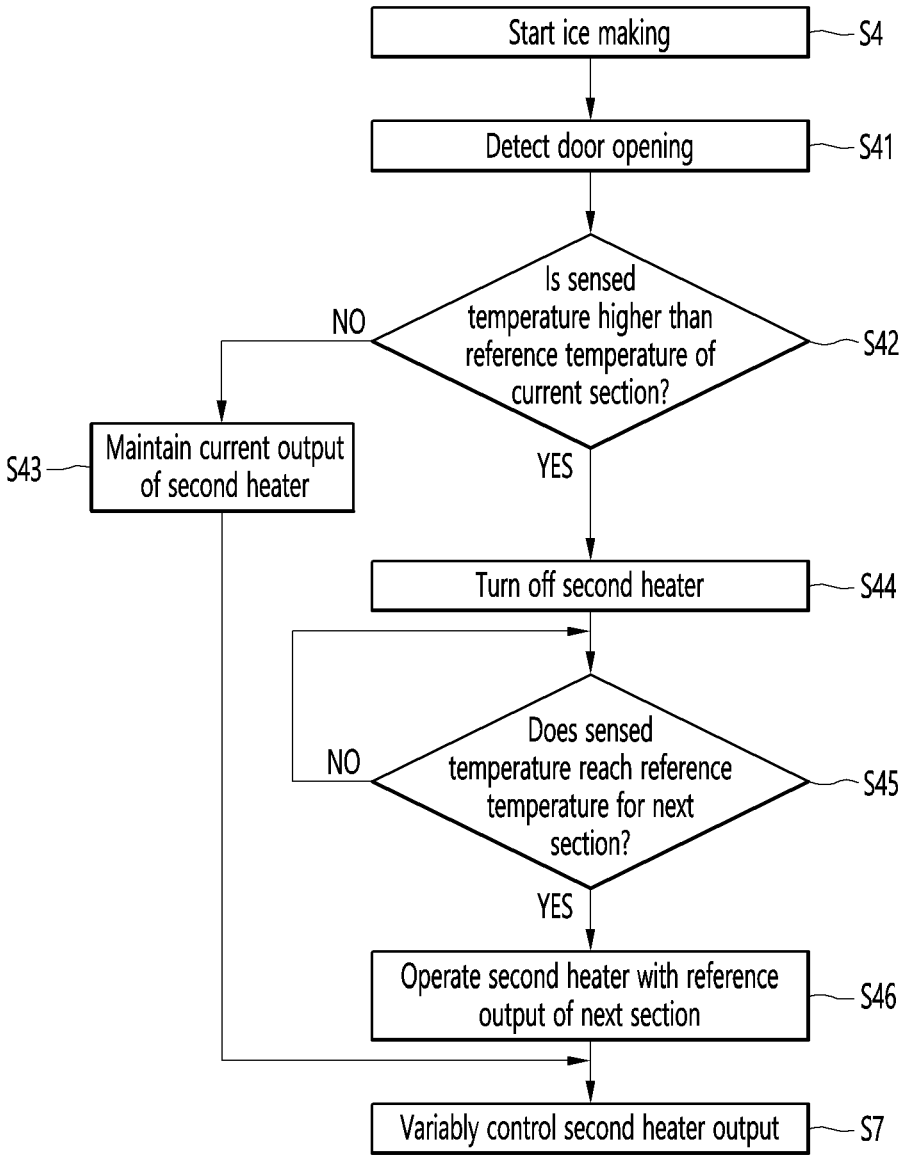
FIG. 46 is a view for explaining a method for controlling a second heater in a case in which a door opening is detected during an ice making process.

FIG. 46 is a view for explaining a method for controlling a second heater in a case in which a door opening is detected during an ice making process.

Referring to FIG. 46, while ice making starts (S4) and ice is generated by turning on the second heater 430 during the ice making process, the opening of the freezing compartment door 30 that opens and closes the freezing compartment 32 may be detected. Of course, in a case in which the ice maker 200 is provided in the refrigerating compartment 18, the opening of the refrigerating compartment doors 10 and 20 may be detected.

After the opening of the door is detected and the closing of the door is detected, the controller 800 determines whether the temperature detected by the temperature sensor 700 is higher than the reference temperature of the current section (S42).

For example, when the door is opened, external air is supplied to the freezing compartment 32, so that the temperature inside the freezing compartment 32 rises. When the temperature inside the freezing compartment 32 rises, the temperature around the ice maker 200 rises, so that the temperature sensed by the temperature sensor 700 increases. The longer the opening time of the door, the greater the width of the temperature increase.

As a result of determination in step S42, in a case in which the temperature sensed by the temperature sensor 700 is higher than the reference temperature of the current section, the controller 800 reduces the current output of the second heater 430. For example, the controller 800 may turn off the second heater 430 (S44).

On the other hand, in a case in which the temperature sensed by the temperature sensor 700 is not higher than the reference temperature of the current section, the controller 800 maintains the current output of the second heater 430. That is, in a case in which the door opening time is short, since there is little temperature change, the output of the second heater 430 is maintained.

In a case in which the second heater 430 is turned off, the controller 800 may determine whether the temperature sensed by the temperature sensor 700 has reached the reference temperature of the next section (S45).

In a case in which the door is closed, the temperature detected by the turn-off temperature sensor 700 of the second heater 430 decreases, and when the sensed temperature reaches the reference temperature of the next section, the controller 800 operates the second heater 430 as the reference output of the next section (S46). In which, until the ice making is completed, the output variable control of the second heater 430 for each section may be normally performed (S7).

According to the present embodiment, by controlling the second heater in consideration of the temperature change of the freezing compartment due to the door opening and closing, there is an advantage that transparent ice can be generated at a constant ice making rate.

The present disclosure is not limited to the above-described embodiments, and as can be seen from the appended claims, modifications may be made by those of ordinary skill in the field to which the present disclosure belongs, and such modifications are within the scope of the present disclosure.

The invention claimed is:

1. An ice maker comprising:

a first tray configured to define a first portion of a cell;

a second tray configured to define a second portion of the cell;

a heater configured to be disposed adjacent to one of the first tray and the second tray; and a controller configured to control the heater, wherein the heater is configured to be turned on while cold air is provided to the cell, and wherein in a state in which the heater is turned on, the controller is configured to control the heater to vary an output of the heater while the cold air is provided to the cell, the controller is configured to operate the heater at a first output for a first time period and then the controller is configured to operate the heater at a second output greater than the first output for a second time period, wherein the first time period is different from the second time period, and the first output is greater than a difference between the first output and the second output.

2. The ice maker of claim 1, wherein the second tray is below the first tray, and wherein the heater is positioned adjacent to the second tray.

3. The ice maker of claim 2, wherein the heater is in contact with the second tray.

4. The ice maker of claim 1, wherein a temperature of the heater is maintained in a first temperature range by varying the output of the heater, is maintained in the second temperature range, and then is maintained in the third temperature range.

5. The ice maker of claim 4, wherein an average value of the first temperature range is less than an average value of the second temperature range.

6. The ice maker of claim 5, wherein an average value of the third temperature range is less than the average value of the second temperature range.

7. The ice maker of claim 6, wherein the average value of the third temperature range is less than the average value of the first temperature range.

8. The ice maker of claim 1, wherein, during an ice making process, in a state in which the heater is turned on, the controller is configured to control the heater to increase the output of the heater.

9. The ice maker of claim 8, wherein the controller is configured to control the heater such that after the output of the heater increases, the output of the heater decreases.

10. The ice maker of claim 1, wherein in a state in which the heater is turned on, the controller is configured to control the heater to vary the output of the heater from the second output to a third output.

11. The ice maker of claim 10, wherein the third output is smaller than the second output.

12. The ice maker of claim 11, wherein the third output is smaller than the first output and the third output is greater than zero.

13. The ice maker of claim 11, wherein a time driven by the first output is shorter than a time driven by the second output or driven by the third output.

14. A refrigerator comprising:

a storage chamber;

a cold air supply configured to supply cold air;

a first tray configured to define a first portion of a cell that forms a space in which liquid is changed into ice by the cold air;

a second tray to define a second portion of the cell that forms a space in which liquid introduced into the space is to change into ice;

a heater configured to be disposed adjacent to one of the first tray and the second tray; and a controller configured to control the heater, wherein during an ice making process, in a state in which the heater is turned on, the controller is configured to control the heater to increase an output of the heater from a first output to a second output and decrease the output of the heater from the second output to a third output, wherein the controller is configured to operate the heater at the first output for a first time period, the controller is configured to operate the heater at the second output for a second time period, the controller is configured to operate the heater at the third output for a third time period, wherein the second time period is different from the third time period, wherein the first output is less than the third output and the first output is greater than zero.

15. A refrigerator comprising:

a storage chamber;

a cold air supply configured to supply cold air;

a first tray configured to define a first portion of a cell that forms a space in which liquid is changed into ice by the cold air;

a second tray to define a second portion of the cell that forms a space in which liquid introduced into the space is to change into ice; and a heater configured to be disposed adjacent to one of the first tray and the second tray; and a controller configured to control the heater, wherein during an ice making process, the controller is configured to operate the heater at a first output for a first time period and then the controller is configured to operate the heater at a second output for a second time period, wherein the first time period is shorter than the second time period.

16. The refrigerator of claim 15, wherein the second output is greater than the first output, and the third output is smaller than the second output.

17. The refrigerator of claim 15, wherein after operation of the heater at the second output, the controller is configured to operate the heater at a third output for a third time period.

18. The refrigerator of claim 17, wherein the second output is greater than the first output, and the third output is smaller than the second output.

19. The refrigerator of claim 17, wherein the first time period is shorter than the third time period, and the second time period is shorter than the third time period.

* * * * *